US006026903A

United States Patent [19]

Shy et al.

[11] Patent Number: 6,026,903

[45] **Date of Patent: *Feb. 22, 2000**

[54] BIDIRECTIONAL DISAPPEARING PLUG

[75] Inventors: Perry C. Shy, Southlake; John C. Gano, Carrollton; David L. Reesing, Irving; Michael P. Adams, Dallas; James R. Longbottom, Whitesboro, all of Tex.; Bill W. Loughridge, Duncan; Lance E. Brothers, Ninnekah, both of Okla.

[73] Assignee: Halliburton Energy Services, Inc., Dallas, Tex.

[ * ] Notice: This patent is subject to a terminal disclaimer.

[21] Appl. No.: 09/042,094

[22] Filed: Mar. 13, 1998

Related U.S. Application Data

[63] Continuation-in-part of application No. 08/561,754, Nov. 22, 1995, Pat. No. 5,685,372, which is a continuation-in-part of application No. 08/236,436, May 2, 1994, Pat. No. 5,479,986, and a continuation of application No. 08/667,306, Jun. 20, 1996, Pat. No. 5,765,641.

[51] Int. Cl.[7] ..... E21B 33/13

[52] U.S. Cl. ..... 166/292; 166/192

[58] Field of Search ..... 166/285, 292, 166/281, 396, 192, 128, 135

[56] References Cited

U.S. PATENT DOCUMENTS

| | | | |
|---|---|---|---|
| 5,181,569 | 1/1993 | McCoy et al. | 166/317 |
| 5,253,706 | 10/1993 | Reid | 166/135 |
| 5,404,956 | 4/1995 | Bohlen et al. | 166/387 |
| 5,417,285 | 5/1995 | Van Buskirk et al. | 166/292 |
| 5,441,111 | 8/1995 | Whiteford | 166/387 |
| 5,607,017 | 3/1997 | Owens et al. | 166/288 |

*Primary Examiner*—William Neuder

*Attorney, Agent, or Firm*—William M. Imwalle; Marlin R. Smith

[57] ABSTRACT

A bidirectional disappearing plug member and plug assembly is capable of blocking pressurized fluid flow from opposing axial directions in a flowbore. In a preferred embodiment, the plug member, which blocks flow through the flowbore, may be readily and at least partially dissolved through the application of at least one pressurization and depressurization within a tubing string above the plug assembly. Construction of the plug assembly permits the plug member to be conveniently emplaced in a fluid-filled wellbore by permitting fluid flow around the plug member during the emplacement process. The plug member may then be secured within the plug assembly to block fluid flow from either axial direction. Operation of a plug rupture sleeve or mandrel, for at least partially dissolving the plug member, may be controlled by a ratchet assembly or linear indexing apparatus requiring multiple pressurizations and depressurizations before the plug member is exposed to wellbore fluids and thereby at least partially dissolved.

20 Claims, 33 Drawing Sheets

BIDIRECTIONAL DISAPPEARING PLUG

CROSS-REFERENCE TO RELATED APPLICATIONS

This application is a continuation of U.S. application Ser. No. 08/667,306 filed Jun. 20, 1996, now U.S. Pat. No. 5,765,641, and is further a continuation-in-part of U.S. application Ser. No. 08/236,436, filed May 2, 1994, now U.S. Pat. No. 5,479,986. U.S. application Ser. No. 08/667,306 is a continuation-in-part of U.S. application Ser. No. 08/561,754, filed Nov. 22, 1995, now U.S. Pat. No. 5,685,372, which is a continuation-in-part of U.S. application Ser. No. 08/236,436, now U.S. Pat. No. 4,479,986. A related application, entitled "Linear Indexing Apparatus and Methods of Using Same" was filed on Jun. 20, 1996 as U.S. application Ser. No. 08/667,305 and is now U.S. Pat. No. 5,826,661. All of these prior applications and U.S. patents are hereby incorporated herein by reference.

BACKGROUND OF THE INVENTION

The present invention relates generally to tools used in subterranean wells and, in a preferred embodiment thereof, more particularly provides a temporary plug which may be readily dispersed to reestablish flow through a flowbore.

In conventional practice, when an axially extending flow passage or flowbore of a tubing string within a subterranean wellbore must be closed off, it is common to establish a plug within the flowbore to close off the flow of fluids across the plugged off area. For example, retrievable tubing plugs are intended to be easily removed from a flowbore. They are typically run into the tubing on coiled tubing or cable and removed the same way.

If it becomes necessary to reestablish fluid access to that portion of the tubing string closed off by the plug, any other tools present in the flowbore must be removed therefrom before workers can attempt to remove the plug. Removal of the tools and reestablishing of access to the previously closed off portion of the tubing string will usually entail significant cost and rig time. It is, therefore, desirable to develop a plug which may be readily removed or dispersed without either significant expense or rig time.

Some flowbore blocking means have been developed which have a central frangible element that is either pierced or smashed by mechanical means, such as a special wireline tool having a sinker bar and a star bit, or shattered by an increased pressure differential applied at the earth's surface. Also known is a one piece, frangible ceramic sealing element which may be closed to block flow through a flowbore. After use, the element is shattered by impacting with a tooth-faced blind box hammer under force of gravity. Remaining pieces of the ceramic element must then be washed out of the wellbore with completion fluid or the like.

Unfortunately, these designs are not suitable for many customers since elimination of the pieces of the frangible elements, such as by washing them out or by pushing them to the bottom of the well, must be done before the customer can resume operations and is a time-consuming and expensive prospect. Some designs which use a mechanical impact means to destroy the flow blocker require an additional tool run on wireline or coiled tubing to lower and then remove the impact means.

Recently, temporary plugs have been developed which are, in preferred embodiments thereof, composed primarily of a compressed mixture of salt and sand, and which are the subject matter of U.S. Pat. No. 5,479,986 and U.S. application Ser. No. 08/561,754. These types of plugs may be rapidly dispersed, essentially in their entirety, by exposure of the salt and sand mixture to wellbore fluids.

Prior destructible flowbore blocker systems are effective in most situations. However, these systems have generally been configured to block pressurized fluid from one direction, usually downward from the earth's surface, through the flowbore. Some systems, for example, have used hinged, flapper-type valves which pivot closed to block flow through the flowbore. Flow is then reestablished by increasing pressure above the valve to cause destruction of a frangible portion of the valve.

Flapper-type valves are also known in which the frangible portion is destroyed mechanically by, for example, dropping a bar or impacting the frangible portion with another tool. Usually, if significant fluid pressure is applied to these valves from opposite the direction they are intended to block flow from, the valve will open and flow will occur axially through the valve.

Another known plug assembly includes a plug member which has a frangible portion that is shaped in an arcuate fashion such that one side of the plug member presents a convex surface and another side presents a concave surface. So configured, the plug member is significantly more resistant to pressure from its convex side than its concave side. Application of a significant fluid pressure differential from the concave side will likely cause the plug member to be destroyed. As a result, the plug member is, from a practical standpoint, capable of blocking fluid pressure from only a single direction.

From the foregoing, it can be seen that it would be quite desirable to provide a plug which is relatively inexpensive to manufacture, is capable of resisting pressure applied thereto from both axial directions (i.e., is "bidirectional"), and is capable of being dispersed so that no significant restriction or debris remains in the flowbore (i.e., is "disappearing"). It is accordingly an object of the present invention to provide such a bidirectional disappearing plug.

SUMMARY OF THE INVENTION

In carrying out the principles of the present invention, in accordance with an embodiment thereof, a bidirectional disappearing plug is provided which is capable of selectively blocking flow through a flowbore of a tubing string disposed within a subterranean well. The plug may subsequently be conveniently disposed of, leaving little or no restriction to flow through the flowbore, and leaving no significant debris in the flowbore.

The invention features a novel plug and plug assembly which is capable of blocking pressurized fluid flow from opposing directions in a flowbore. The plug may be readily and substantially disposed of through the application of at least one pressurization and depressurization within the tubing string above the plug assembly.

Construction of the plug assembly permits the plug to be emplaced in a fluid filled wellbore by permitting fluid flow around the plug during the emplacement process. The plug may then be secured within the plug assembly to block flow from either axial direction.

Operation of a plug rupture sleeve is controllable by a ratchet assembly or a linear indexing apparatus. The ratchet assembly permits the flowbore to be pressurized and depressurized from the surface a specified number of times, up to the pressure limit of the plug member, without destroying the plug. A ratchet sleeve and the plug rupture sleeve are sequentially moved to a series of intermediate upper and lower positions. The ratchet assembly controls the rupture sleeve and maintains it in positions where it is unable to prematurely destroy the plug member.

The plug may finally be destroyed by pressurizing the flowbore to cause the rupture sleeve to penetrate the plug member and destroy the plug's integrity. Where the linear indexing apparatus is utilized, a mandrel of the apparatus may sealingly engage the plug assembly, such that a subsequent flowbore pressurization causes wellbore fluids to enter the plug member to destroy the plug's integrity. The plug assembly has particular application in horizontal or directional wells where the well is often in an underbalanced condition.

In broad terms, apparatus operatively positionable in a subterranean well having fluid disposed therein is provided. The apparatus includes a tubular outer housing and a plug member assembly. The outer housing has an inner axial flow passage formed therethrough. The plug member assembly includes a substantially porous body portion enclosed within a generally impermeable case. The plug member assembly is received in the outer housing and is capable of blocking axial fluid flow through the outer housing flow passage.

Additionally, a bidirectional disappearing plug operatively positionable on a tubing string within a subterranean wellbore is provided. The plug includes a generally tubular housing, a porous compound, and first and second wall portions.

The housing has interior and exterior side surfaces and first and second opposite ends. The interior side surface has a profile formed thereon. The porous compound is disposed substantially radially within the housing interior side surface and is at least partially dissolvable.

Each of the first and second wall portions enclose one of the first and second opposite ends, and each of the first and second wall portions is capable of preventing fluid communication between the wellbore and the compound.

Furthermore, a method of selectively blocking a fluid-containing flowbore using an at least partially dissolvable plug member is provided by the present invention. The method comprises the steps of disposing a plug assembly within the flowbore to block fluid flow through the flowbore, the plug assembly containing the plug member and a fluid passage around the plug member through which fluid within the flowbore passes as the plug is disposed into the flowbore, and setting the plug assembly by closing the fluid passage to block fluid flow through the flowbore.

DETAILED DESCRIPTION

Figure 1A:
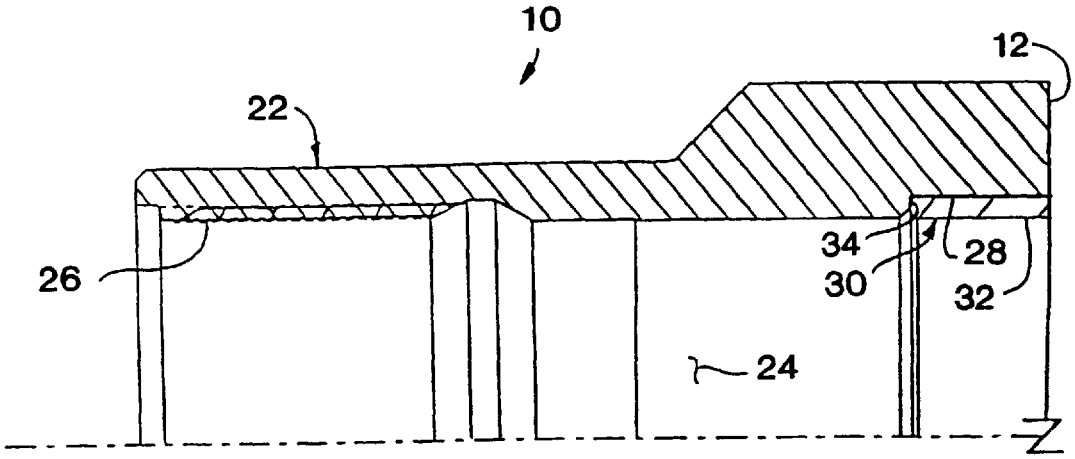
FIGS. 1A–1C are quarter-sectional views of successive axial portions of a first linear indexing apparatus embodying principles of the present invention, the apparatus being shown in a configuration in which it is run into a subterranean well.
Figure 1B:
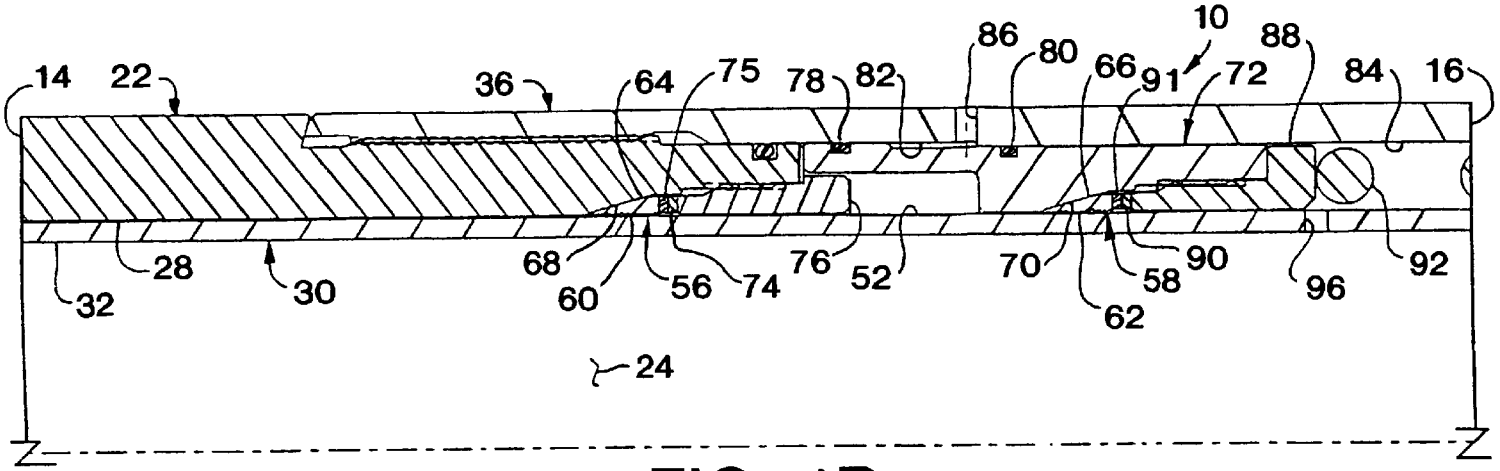
Figure 1C:
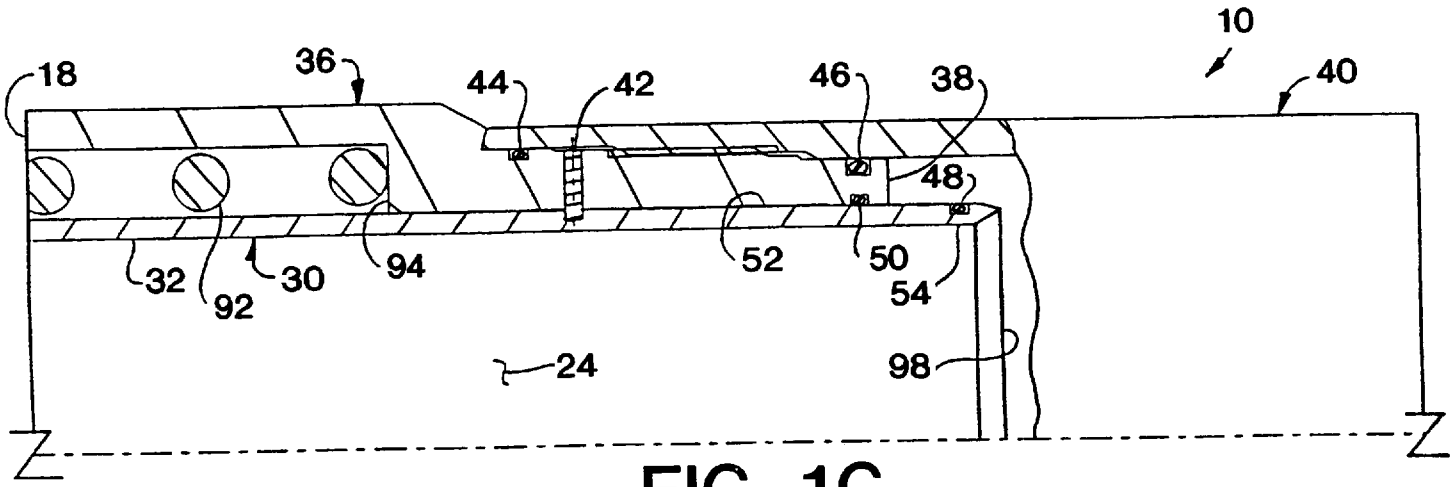

Illustrated in FIGS. 1A–1C is a linear indexing apparatus 10 which embodies principles of the present invention. The apparatus 10 is shown in a configuration in which the apparatus is run into a subterranean well. In the following detailed description of the embodiment of the present invention representatively illustrated in the accompanying figures, directional terms, such as "upper", "lower", "upward", "downward", etc., are used in relation to the illustrated apparatus 10 as it is depicted in the accompanying figures, the upward direction being to the left, and the downward direction being to the right in the figures. It is to be understood that the apparatus 10 may be utilized in vertical, horizontal, inverted, or inclined orientations without deviating from the principles of the present invention.

For convenience of illustration, FIGS. 1A–1C show the apparatus 10 in successive axial portions, but it is to be understood that the apparatus is a continuous assembly, lower end 12 of FIG. 1A being continuous with upper end 14 of FIG. 1B, lower end 16 of FIG. 1B being continuous with upper end 18 of FIG. 1C.

The apparatus 10 includes a generally tubular upper housing 22 and an axial flow passage 24 extending through the apparatus 10. The upper housing 22 permits the apparatus 10 to be suspended from a tubing string (not shown) within a subterranean well, and further permits fluid communication between the interior of the tubing string and the axial flow passage 24. An upper portion 26 of the upper housing 22 may be internally threaded as shown, or it may be externally threaded, provided with circumferential seals, etc., to permit sealing attachment of the apparatus 10 to the tubing string.

The upper housing 22 has an axially extending internal bore 28 formed thereon, in which a generally tubular mandrel 30 is axially and slidingly received. The axial flow passage 24 extends axially through an internal bore 32 formed on the mandrel 30. When the apparatus 10 is configured as shown in FIGS. 1A–1C, axially upward displacement of the mandrel 30 relative to the upper housing 22 is prevented by contact between the mandrel and a radially inwardly extending shoulder 34 internally formed on the upper housing.

The upper housing 22 is threadedly and sealingly attached to a generally tubular lower housing 36. The lower housing 36 extends axially downward from the upper housing 22. At a lower end portion 38 thereof, the lower housing 36 is threadedly and sealingly attached to a generally tubular lower adapter 40. The lower adapter 40 extends axially downward from the lower housing 36 and permits attachment of tubing, other tools, etc. (not shown) below the apparatus 10.

The mandrel 30 is releasably secured against axially downward displacement relative to the upper and lower housings 22, 36 by a shear pin 42 installed radially through lower end portion 38 and into the mandrel. Note that lower end portion 38 has two external circumferential seals 44, 46 installed thereon which sealingly engage the lower adapter 40, and an internal circumferential seal 50 installed thereon which sealingly engages an outer side surface 52 of the mandrel 30. Seal 44 isolates the interior of the apparatus 10 from fluid communication with the exterior of the apparatus. Seals 46, 50, and an external circumferential seal 48 installed on a lower end portion 54 of the mandrel 30, have purposes which will be readily apparent to one of ordinary skill in the art upon consideration of the embodiment of the present invention shown in FIGS. 3A–7C and accompanying descriptions thereof hereinbelow.

Two slips 56, 58 are radially outwardly disposed relative to the outer side surface 52 of the mandrel 30. The slips 56, 58 are generally wedge-shaped and each slip has a toothed inner side surface 60, 62, respectively, which grippingly engages the mandrel outer side surface 52 when a radially sloped and axially extending surface 64, 66, respectively, formed on each of the slips axially engages a corresponding and complementarily shaped surface 68, 70, respectively, internally formed on the upper housing 22 and a generally tubular piston 72 disposed radially between the lower housing 36 and the mandrel 30. Applicant prefers that the mandrel outer side surface 52 have a toothed or serrated profile formed on a portion thereof where the slips 56, 58 may grippingly engage the outer side surface 52 to enhance the gripping engagement therebetween, but it is to be understood that such toothed or serrated profile is not required in an apparatus 10 embodying principles of the present invention. It is also to be understood that other means may be provided for grippingly engaging the mandrel 30 without departing from the principles of the present invention.

The upper slip 56 prevents axially upward displacement of the mandrel 30 relative to the upper housing 22 at any time. If an axially upwardly directed force is applied to the mandrel 30, tending to upwardly displace the mandrel, gripping engagement between the upper slip 56 and the mandrel outer side surface 52 will force the sloped surface 64 of the slip 56 into axial engagement with the sloped surface 68 of the upper housing, thereby radially inwardly biasing the slip 56 to increasingly grippingly engage the mandrel outer side surface 52, preventing axial displacement of the mandrel relative to the slip 56.

Initial minimal gripping engagement between the slip 56 and the mandrel outer side surface 52 is provided by a circumferential wavy spring washer 74 and a flat washer 75 disposed axially between the slip 56 and a generally tubular retainer 76 internally threadedly attached to the upper housing 22. However, the initial gripping engagement, also known to those skilled in the art as "preload", between the slip 56 and the mandrel outer side surface 52 is not sufficient to prevent axially downward displacement of the mandrel 30 relative to the upper housing 22, as described in further detail hereinbelow.

The piston 72 is axially slidingly disposed within the lower housing 36 and has two axially spaced apart circumferential seals 78, 80 externally disposed thereon. Each of the seals 78, 80 sealingly engages one of two axially extending bores 82, 84, respectively, internally formed on the lower housing 36. A radially extending port 86 formed through the lower housing 36 provides fluid communication between the exterior of the apparatus 10 and that outer portion of the piston 72 axially between the seals 78, 80.

The upper bore 82 is radially enlarged relative to the lower bore 84, thus forming a differential area therebetween. The piston 72 is otherwise in fluid communication with the axial flow passage 24. Therefore, if fluid pressure in the axial flow passage 24 exceeds fluid pressure external to the apparatus 10, the piston 72 is biased axially downward by a force approximately equal to the difference in the fluid pressures multiplied by the differential area between the bores 82, 84. Similarly, if fluid pressure external to the apparatus 10 is greater than fluid pressure in the axial flow passage 24, the piston 72 is biased axially upward by a force approximately equal to the difference in the fluid pressures multiplied by the differential area between the bores 82, 84.

In the configuration of the apparatus 10 shown in FIGS. 1A–1C, the piston 72 is prevented from displacing axially upward relative to the upper housing 22 by axial contact between the piston and the upper housing. The piston 72 may, however, be axially downwardly displaced relative to the upper housing 22 by applying a fluid pressure to the axial flow passage 24 which exceeds fluid pressure external to the apparatus 10 by a predetermined amount. The amount of the difference in the fluid pressures required to axially downwardly displace the piston 72 is described in greater detail hereinbelow.

A generally tubular retainer 88 is threadedly attached to the into piston 72. The slip 58, a circumferential wavy spring washer 90, and a flat washer 91 are axially retained between the sloped surface 70 on the piston 72 and the retainer 88. The washer 90 maintains a preload on the slip 58, so that the slip 58 minimally grippingly engages the mandrel outer side surface 52.

When the piston 72 is axially downwardly displaced relative to the lower housing 36, the gripping engagement of the slip 58 with the mandrel outer side surface 52 forces the slip 58 into axial engagement with the sloped surface 70 on the piston 72, thereby radially inwardly biasing the slip 58. Such radially inward biasing of the slip 58 causes the slip 58 to increasingly grippingly engage the mandrel outer side surface 52, forcing the mandrel 30 to axially downwardly displace along with the piston 72. Thus, the increased gripping engagement between the slip 58 and the mandrel outer side surface 52 caused by axially downward displacement of the piston 72 also causes the mandrel 30 to displace along with the piston, and enables the axially downward displacement of the mandrel 30 to be metered by the displacement of the piston. Therefore, the mandrel 30 may be incrementally indexed axially downward, with each increment being equal to a corresponding axially downward displacement of the piston 72.

The piston 72 is biased axially upward by a spirally wound compression spring 92. The spring 92 is installed axially between the retainer 88 and a radially inwardly extending shoulder 94 internally formed on the lower housing 36, and radially between the lower housing 36 and the mandrel 30. In its configuration shown in FIGS. 1A–1C, the spring 92 axially upwardly biases the piston 72 such that it axially contacts the upper housing 22. A radially extending port 96 formed through the mandrel 30 permits fluid communication between the axial flow passage 24 and the spring 92, retainer 88, piston 72, etc.

In operation, the apparatus 10 may be suspended from a tubing string, as hereinabove described, and positioned within a subterranean well. An annulus is thus formed radially between the apparatus 10 and tubing string, and the bore of the well. With the axial flow passage 24 in fluid communication with the interior of the tubing string extending to the earth's surface, and sealingly isolated from the annulus, a positive pressure differential may be created from the axial flow passage to the annulus by, for example, applying pressure to the interior of the tubing at the earth's surface, or reducing pressure in the annulus at the earth's surface. It is to be understood that the pressure differential may be created in other manners without departing from the principles of the present invention.

In order for the pressure differential to cause axially downward displacement of the piston 72 relative to the lower housing 36, the downwardly biasing force resulting from the pressure differential being applied to the differential piston area between the bores 82 and 84 must exceed the sum of at least three forces: 1) the axially upwardly biasing force of the spring 92; 2) a force required to shear the shear pin 42; and 3) a force required to overcome the minimal gripping engagement of the slip 56 with the mandrel outer surface 52. When the sum of these forces is exceeded by the downwardly biasing force resulting from the pressure differential, the shear pin 42 will be sheared and the piston 72, slip 58, wavy spring 90, washer 91, retainer 88, and mandrel 30 will displace axially downward relative to the lower housing 36.

Figure 2A:
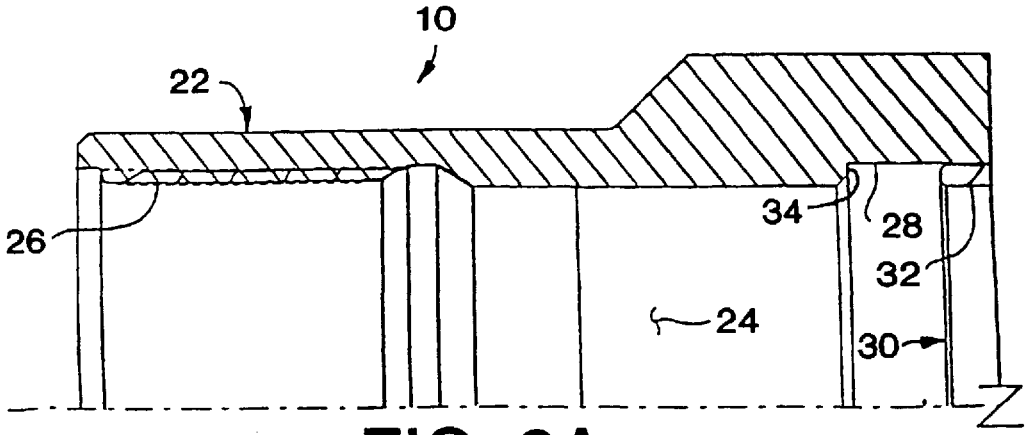
FIGS. 2A–2C are quarter-sectional views of successive axial portions of the first linear indexing apparatus, the apparatus being shown in a configuration in which a mandrel of the apparatus has been axially indexed.
Figure 2B:
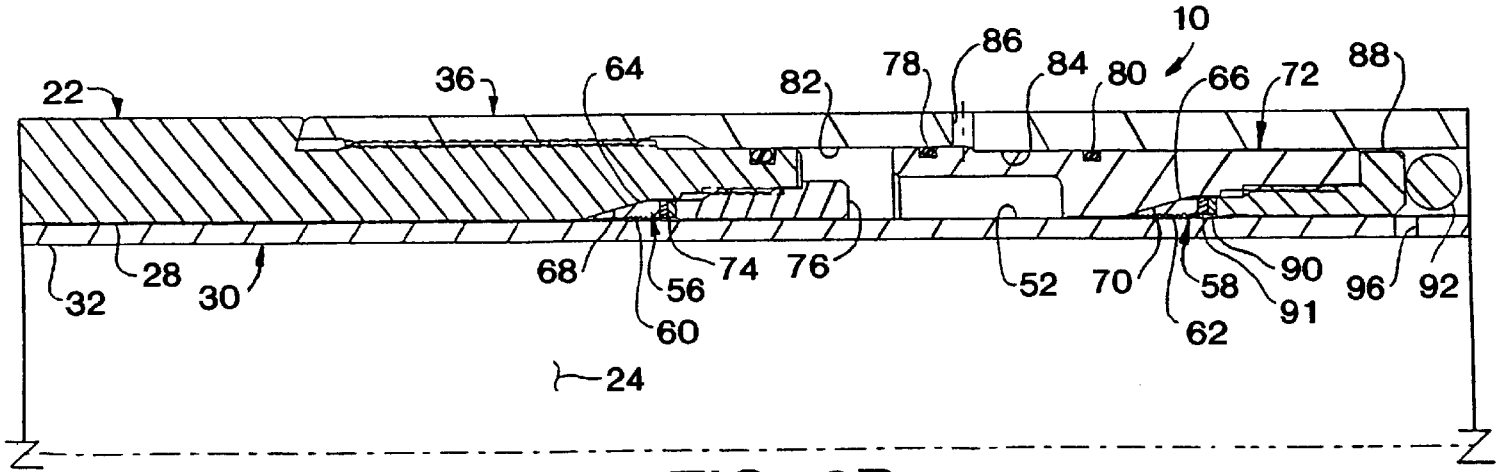
Figure 2C:
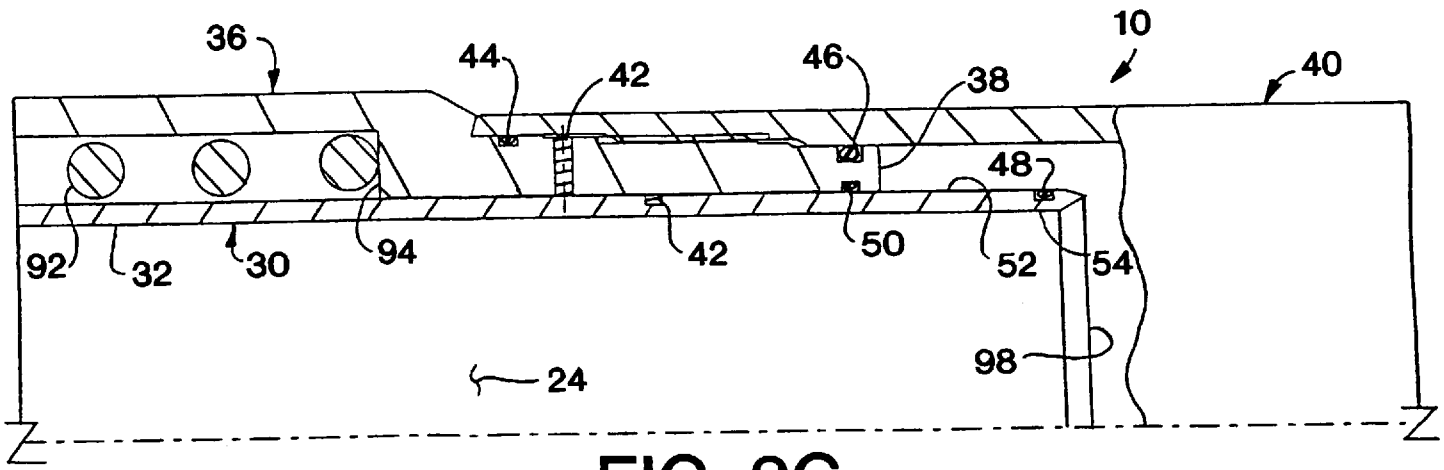

Referring additionally now to FIGS. 2A–2C, the apparatus 10 is representatively illustrated with the piston 72, slip 58, wavy spring 90, washer 91, retainer 88, and mandrel 30 axially downwardly displaced relative to the lower housing 36. The shear pin 42 has been sheared and the spring 92 has been further axially compressed by such displacement. Note that, with the apparatus 10 in the configuration shown in FIGS. 2A–2C, the pressure differential is still being applied, the fluid pressure in the axial flow passage 24 exceeding the fluid pressure in the annulus external to the apparatus 10 by an amount sufficient to overcome the upwardly biasing force exerted by the spring 92.

As shown in FIGS. 2A–2C, the mandrel 30 has been axially downwardly displaced relative to the upper slip 56. Since the upper slip 56 prevents upward displacement of the mandrel 30, as more fully described hereinabove, this downward displacement of the a mandrel 30 may not be reversed. Thus, each time the mandrel 30 is downwardly displaced, such displacement is incremental and is added to any prior downward displacement of the mandrel 30 relative to the lower housing 36.

The piston 72, lower slip 58, retainer 88, wavy spring 90, and washer 91 may be returned to their positions as shown in FIG. 1B, wherein the piston 72 axially contacts the upper housing 22, by reducing the pressure differential between the axial flow passage 24 and the annulus external to the apparatus 10. When the pressure differential has been reduced sufficiently, the upwardly biasing force exerted by spring 92 on the retainer 88 will overcome the downwardly biasing force exerted by the pressure differential acting on the differential piston area between the bores 82, 84 and the minimal gripping engagement between the lower slip 58 and the mandrel outer side surface 52, thereby permitting the piston, lower slip, retainer, wavy spring 90, and washer 91 to axially upwardly displace relative to the lower housing 36. Note, however, that the mandrel 30 will remain in its axially downwardly displaced position as shown in FIGS. 2A–2C, the upper slip 56 preventing upward displacement of the mandrel 30 as more fully described hereinabove.

It will be readily appreciated by one of ordinary skill in the art that, if the pressure differential is alternately and repetitively increased and decreased as described above, the mandrel 30 will progressively displace axially downward, thus incrementally indexing downward relative to the lower housing 36. Such incrementally indexing displacement of the mandrel 30 may be utilized for any of a variety of useful purposes. Examples include radially expanding or contracting a seat in a ball catcher sub; setting a packer, testing the packer, and then releasing a setting tool from the packer; incrementally opening and closing a valve, and regulating flow through the valve depending on the number of incremental indexes of the mandrel 30; firing explosive charges, wherein safety is enhanced by the necessity of deliberately applying multiple pressure differentials to fire the charges; and setting, testing, and releasing a plug. The apparatus 10 may be utilized for these and many other purposes without departing from the principles of the present invention.

As representatively illustrated in FIGS. 1A–2C, the apparatus 10 has a mandrel 30 which includes a sharp axially downwardly facing circumferential edge 98 formed on the lower end portion 54 thereof. The edge 98 may be indexed incrementally downward to pierce a membrane of an expendable plug (not shown) to thereby expend the plug in a manner that will become apparent to one of ordinary skill in the art upon consideration of the detailed description hereinbelow accompanying FIGS. 3A–7C. The mandrel 30 also has installed thereon the seal 48, which, when the mandrel is sufficiently indexed incrementally downward, may be used to close a bypass flow passage (not shown) of an expendable plug to thereby prevent bypass flow around the plug in a manner that will become apparent to one of ordinary skill in the art upon consideration of the detailed description accompanying FIGS. 3A–7C hereinbelow. It is to be understood that the mandrel 30 may be otherwise configured to accomplish other purposes without departing from the principles of the present invention.

Although the apparatus 10 as representatively illustrated in FIGS. 1A–2C utilizes differential pressure to achieve axially downward displacement of the mandrel 30 in a linearly incremental indexing fashion, it will be readily appreciated by one of ordinary skill in the art that other means may be utilized to axially downwardly displace the mandrel. For example, the mandrel 30 may be provided with a conventional shifting profile (not shown) internally formed thereon for cooperative engagement with a conventional shifting tool (not shown) conveyed into the flow passage 24 on wireline, slickline, coiled tubing, etc. These and other means may be utilized to cause axially downward displacement of the mandrel 30 without departing from the principles of the present invention.

Figure 3A:
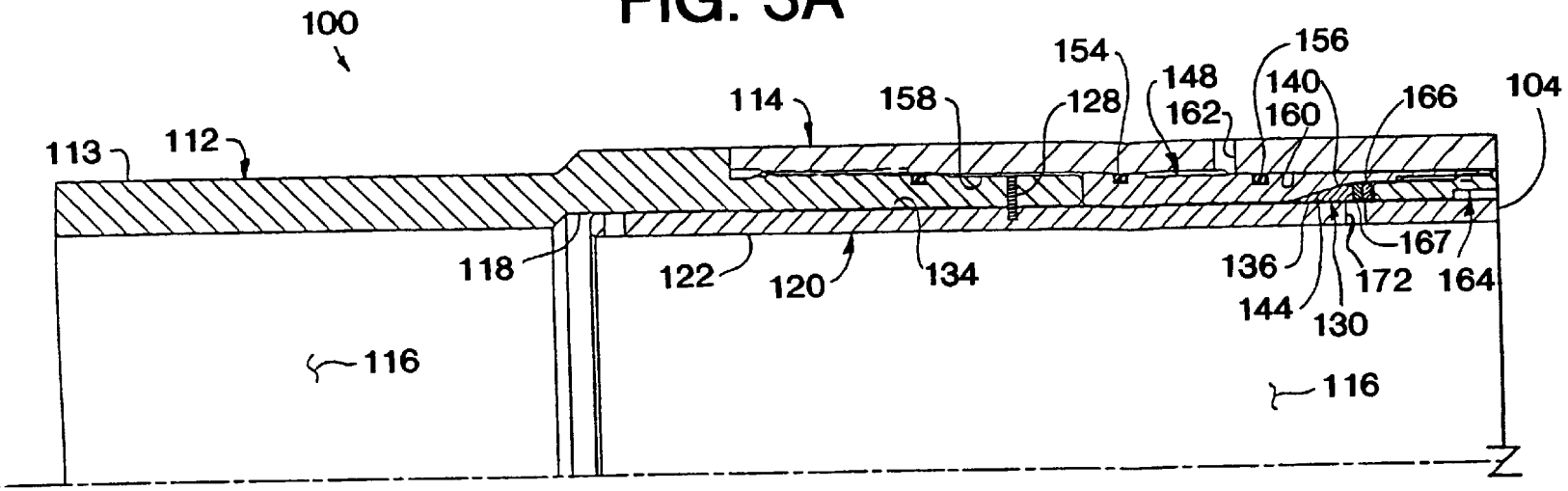
FIGS. 3A–3C are quarter-sectional views of successive axial portions of a second linear indexing apparatus embodying principles of the present invention, the apparatus being shown in a configuration in which it is run into a subterranean well with a bidirectional disappearing plug embodying principles of the present invention.
Figure 3B:
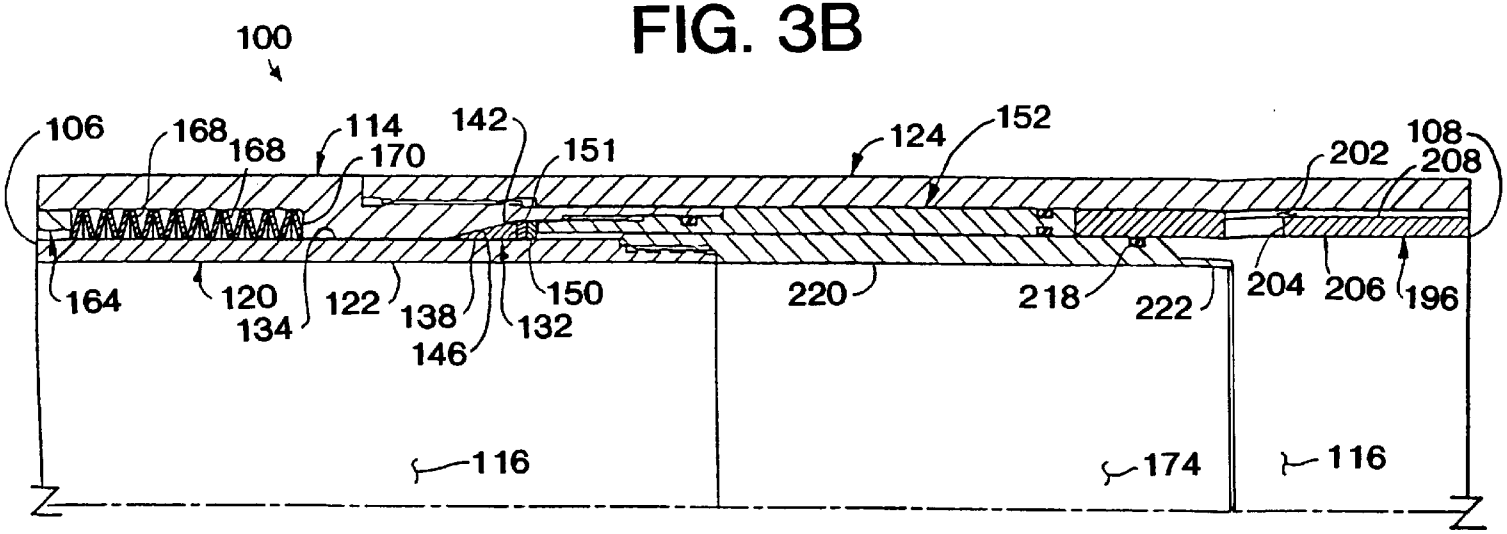
Figure 3C:
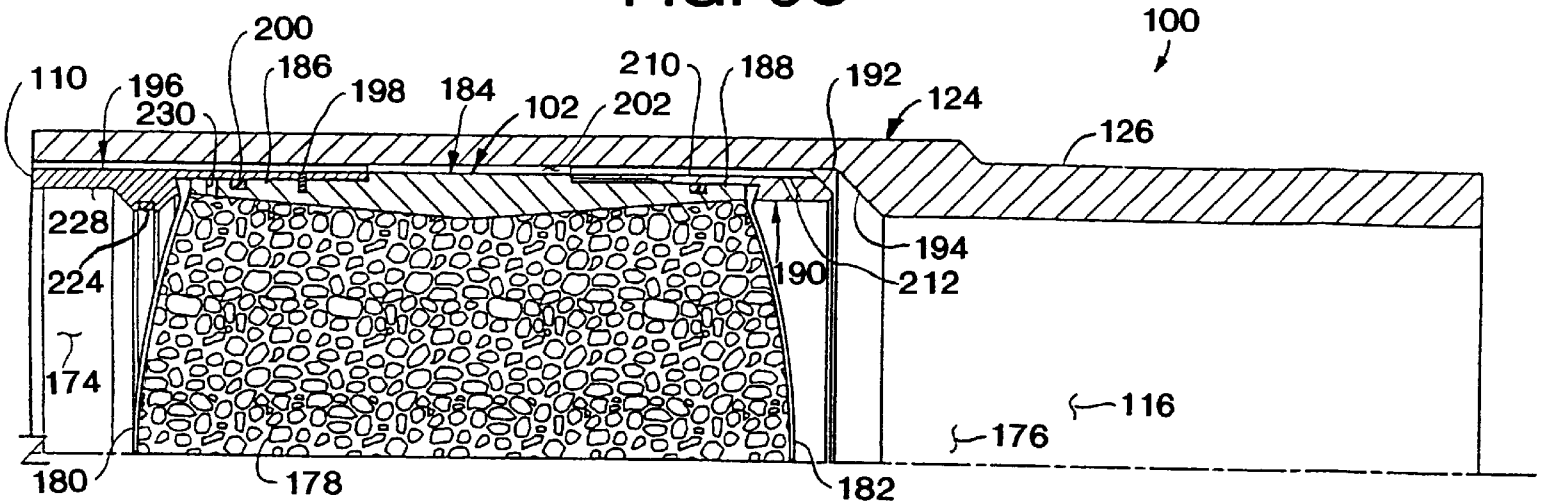

Turning now to FIGS. 3A–3C, an alternate construction of a linear indexing apparatus 100 embodying principles of the present invention is representatively illustrated. The apparatus 100 demonstrates various modifications which may be made without departing from the principles of the present invention. Additionally, the apparatus 100 is shown incorporating an expendable plug 102 therein. It is to be understood that it is not necessary for the apparatus 100 to incorporate the expendable plug 102 therein. The expendable plug 102 is capable of preventing fluid flow axially upwardly and downwardly through the apparatus 100, and is further capable of "disappearing", i.e., being expended and leaving no obstruction. The construction and manner of operating the expendable plug 102 is more fully described hereinbelow.

The apparatus 100 is shown in a configuration in which the apparatus is run into a subterranean well. In the following detailed description of the embodiment of the present invention representatively illustrated in the accompanying figures, directional terms, such as "upper", "lower", "upward", "downward", etc., are used in relation to the illustrated apparatus 100 as it is depicted in the accompanying figures, the upward direction being to the left, and the downward direction being to the right in the figures. It is to be understood that the apparatus 100 may be utilized in vertical, horizontal, inverted, or inclined orientations without deviating from the principles of the present invention.

For convenience of illustration, FIGS. 3A–3C show the apparatus 100 in successive axial portions, but it is to be understood that the apparatus is a continuous assembly, lower end 104 of FIG. 3A being continuous with upper end 106 of FIG. 3B, and lower end 108 of FIG. 3B being continuous with upper end 110 of FIG. 3C.

A generally tubular upper adapter 112 is threadedly and sealingly attached to a generally tubular upper housing 114 of the apparatus 100. An axial flow passage 116 extends through the apparatus 100. The upper adapter 112 permits the apparatus 100 to be suspended from a tubing string (not shown) within a subterranean well, and further permits fluid communication between the interior of the tubing string and the axial flow passage 116. An upper portion 113 of the upper adapter 112 may be internally threaded as shown on upper housing 22 of the previously described apparatus 10, or it may be externally threaded, provided with circumferential seals, etc., to permit sealing attachment of the apparatus 100 to the tubing string.

The upper adapter 112 has an axially extending internal bore 118 formed thereon, in which a generally tubular mandrel 120 is axially and slidingly received. The axial flow passage 116 extends axially through an internal bore 122 formed on the mandrel 120.

The upper housing 114 is threadedly and sealingly attached to a generally tubular lower housing 124. The lower housing 124 extends axially downward from the upper housing 114. At a lower end portion 126 thereof, the lower housing 124 may be threadedly and sealingly attached to tubing, other tools, etc. below the apparatus 100. For this purpose, lower end portion 126 may be internally or externally threaded, provided with seals, etc.

The mandrel 120 is releasably secured against axially upward or downward displacement relative to the upper and lower housings 114, 124 by a shear pin 128 installed radially through the upper adapter 112 and into the mandrel. Upper and lower slips 130, 132, respectively, are radially outwardly disposed relative to an outer side surface 134 of the mandrel 120. The slips 130, 132 are generally wedge-shaped and each slip has a toothed inner side surface 136, 138, respectively, which grippingly engages the mandrel outer side surface 134 when a radially sloped and axially extending surface 140, 142, respectively, formed on each of the slips axially engages a corresponding and complementarily shaped surface 144, 146, respectively, internally formed on the upper housing 114 and a generally tubular piston 148 disposed radially between the upper housing 114 and the mandrel 120.

Applicant prefers that each of the slips 130, 132 is comprised of circumferentially distributed individual segments, only one of which is visible in FIGS. 3A–3C. Such wedge-shaped slip segments are well known to those of ordinary skill in the art. However, it is to be understood that other means may be provided for preventing axially upward displacement of the mandrel 120 without departing from the principles of the present invention.

Applicant prefers that the mandrel outer side surface 134 have a toothed or serrated profile formed on a portion thereof where the slips 130, 132 may grippingly engage the outer side surface 134 to enhance the gripping engagement therebetween, but it is to be understood that such toothed or serrated profile is not required in an apparatus 100 embodying principles of the present invention. It is also to be understood that other means may be provided for grippingly engaging the mandrel 120 without departing from the principles of the present invention.

The lower slip 132 prevents axially upward displacement of the mandrel 120 relative to the upper housing 114 at any time. If an axially upwardly directed force is applied to the mandrel 120, tending to upwardly displace the mandrel, gripping engagement between the lower slip 132 and the mandrel outer side surface 134 will force the sloped surface 142 of the slip 132 into axial engagement with the sloped surface 146 of the upper housing 114, thereby radially inwardly biasing the slip 132 to increasingly grippingly engage the mandrel outer side surface 134, preventing axial displacement of the mandrel relative to the slip 132.

Initial minimal gripping engagement between the slip 132 and the mandrel outer side surface 134 is provided by a circumferential wavy spring washer 150 disposed axially between the slip 132 and a generally tubular retainer 152 internally threadedly and sealingly attached to the upper housing 114. A flat washer 151 transmits a compressive force from the wavy spring washer 150 to the circumferentially distributed segments of slip 132. The initial gripping engagement between the slip 132 and the mandrel outer side surface 134 is not sufficient to prevent axially downward displacement of the mandrel 120 relative to the upper housing 114, as described in further detail hereinbelow.

The piston 148 is axially slidably disposed within the upper housing 114 and has two axially spaced apart circumferential seals 154, 156 externally disposed thereon. Each of the seals 154, 156 sealingly engages one of two axially extending bores 158, 160, respectively, internally formed on the upper housing 114. A radially extending port 162 formed through the upper housing 114 provides fluid communication between the exterior of the apparatus 100 and that outer portion of the piston 148 axially between the seals 154, 156.

The upper bore 158 is radially enlarged relative to the lower bore 160, thus forming a differential area therebetween. The piston 148 is otherwise in fluid communication with the axial flow passage 116. Therefore, if fluid pressure in the axial flow passage 116 exceeds fluid pressure external to the apparatus 100, the piston 148 is biased axially downward by a force approximately equal to the difference in the fluid pressures multiplied by the differential area between the bores 158, 160. Similarly, if fluid pressure external to the apparatus 100 is greater than fluid pressure in the axial flow passage 116, the piston 148 is thereby biased axially upward by a force approximately equal to the difference in the fluid pressures multiplied by the differential area between the bores 158, 160.

In the configuration of the apparatus 100 shown in FIGS. 3A–3C, the piston 148 is prevented from displacing axially upward relative to the upper housing 114 by axial contact between the piston and the upper adapter 112. The piston 148 may, however, be axially downwardly displaced relative to the upper housing 114 by applying a fluid pressure to the axial flow passage 116 which exceeds fluid pressure external to the apparatus 100 by a predetermined amount. The amount of the difference in the fluid pressures required to axially downwardly displace the piston 148 is described in greater detail hereinbelow.

A generally tubular retainer 164 is threadedly attached to the piston 148 and extends axially downward therefrom. The slip 130 and a circumferential wavy spring washer 166 are axially retained between the sloped surface 144 on the piston 148 and the retainer 164. The washer 166 maintains a preload on the slip 130, so that the slip 130 minimally grippingly engages the mandrel outer side surface 134. A flat washer 167 transmits the preload from the wavy spring washer 166 to the circumferentially distributed segments of the slip 130.

When the piston 148 is axially downwardly displaced relative to the upper housing 114, the gripping engagement of the slip 130 with the mandrel outer side surface 134 forces the slip 130 into axial engagement with the sloped surface 144 on the piston 148, thereby radially inwardly biasing the slip 130. Such radially inward biasing of the slip 130 causes the slip to increasingly grippingly engage the mandrel outer side surface 134, forcing the mandrel 120 to axially downwardly displace along with the piston 148. Thus, the increased gripping engagement between the slip 130 and the mandrel outer side surface 134 caused by axially downward displacement of the piston 148 also causes the mandrel 120 to displace along with the piston, and enables the axially downward displacement of the mandrel 120 to be metered by the displacement of the piston. Therefore, the mandrel 120 may be incrementally indexed axially downward, with each increment being equal to a corresponding axially downward displacement of the piston 148.

The piston 148 is biased axially upward by an axially stacked series of bellville spring washers 168. The spring washers 168 are installed axially between the retainer 164 and a radially inwardly extending shoulder 170 internally formed on the upper housing 114, and radially between the upper housing and the mandrel 120. In its configuration shown in FIGS. 3A–3C, the spring washers 168 axially upwardly bias the piston 148 such that it axially contacts the upper adapter 112. A radially extending port 172 formed through the mandrel 120 permits fluid communication between the axial flow passage 116 and the spring washers 168, retainer 164, piston 148, etc.

In operation, the apparatus 100 may be suspended from a tubing string, as hereinabove described, and positioned within a subterranean well. An annulus is thus formed radially between the apparatus 100 and tubing string, and the bore of the well. With the axial flow passage 116 in fluid communication with the interior of the tubing string extending to the earth's surface, and sealingly isolated from the annulus, a positive pressure differential may be created from the axial flow passage to the annulus by, for example, applying pressure to the interior of the tubing at the earth's surface, or reducing pressure in the annulus at the earth's surface. It is to be understood that the pressure differential may be created in other manners without departing from the principles of the present invention.

In order for the pressure differential to cause axially downward displacement of the piston 148 relative to the upper housing 114, the downwardly biasing force resulting from the pressure differential being applied to the differential piston area between the bores 158 and 160 must exceed the sum of at least three forces: 1) the axially upwardly biasing force of the spring washers 168; 2) a force required to shear the shear pin 128; and 3) a force required to overcome the minimal gripping engagement of the slip 132 with the mandrel outer surface 134. When the sum of these forces is exceeded by the downwardly biasing force resulting from the pressure differential, the shear pin 128 will be sheared and the piston 148, slip 130, wavy spring 166, washer 167, retainer 164, and mandrel 120 will displace axially downward relative to the upper housing 114.

The expendable plug 102 is contained within the lower housing 124. As will be readily apparent to an ordinarily skilled artisan upon consideration of the further description thereof hereinbelow, the plug 102 functions primarily to selectively permit and prevent fluid communication between upper and lower portions 174, 176, respectively, of the axial flow passage 116.

In very basic terms, the plug 102, as representatively illustrated in FIGS. 3A–7C, permits fluid communication between the upper and lower portions 174, 176, respectively, when the apparatus 100 is being run into the subterranean well, so that the tubing string may fill with fluids. When it is desired, the plug 102 may be operated to prevent such fluid communication by, for example, applying a fluid pressure to the upper portion 174 which is greater than a fluid pressure in the lower portion 176. Prevention of fluid communication between the upper and lower portions 174, 176, respectively, may be desired to, for example, enable setting a hydraulically set packer (not shown) in the subterranean well on the tubing string above the apparatus 100.

Thereafter, when it is desired to again permit fluid communication between the upper and lower portions 174, 176, respectively, such as when it is desired to flow production or stimulation fluids through the axial flow passage 116, the plug 102 may be expended by incrementally indexing the mandrel 120 axially downward in a manner more fully described hereinbelow. It is to be understood that fluid communication may be prevented or permitted between the upper and lower portions 174, 176, respectively, for purposes other than setting hydraulically set packers and flowing production or stimulation fluids therethrough without departing from the principles of the present invention.

The expendable plug 102 includes a dispersible solid substance 178 contained axially between upper and lower membranes 180, 182, respectively, and radially within a housing 184. The substance 178 is preferably granular and may be a mixture of sand and salt. The upper and lower membranes 180, 182, respectively, are preferably made of an elastomeric material, such as rubber. The construction and manner of manufacturing an expendable plug similar to expendable plug 102 is more fully described hereinbelow in the written description accompanying FIGS. 14A–19B.

The housing 184 is generally tubular and has upper and lower end portions 186, 188, respectively, formed thereon. The upper membrane 180 is circumferentially adhesively bonded to the upper end portion 186 at an outer edge of the upper membrane. In a similar manner, the lower membrane 182 is circumferentially adhesively bonded to the lower end portion 188 at an outer edge of the lower membrane. Thus, with the substance 178 contained within the housing 184 and membranes 180, 182, fluid flow axially through the housing is prevented.

A generally tubular lower sleeve 190 is threadedly and sealingly attached to the lower end portion 188 and extends axially downward therefrom. The lower sleeve 190 is axially slidingly received within the lower housing 124. A radially sloped and axially extending seat surface 192 is formed on the lower sleeve 190 axially opposite a complementarily shaped seal surface 194 internally formed on the lower housing 124. Preferably, the seat surface 192 and seal surface 194 are polished, honed, or otherwise formed to permit sealing engagement therebetween.

With the apparatus 100 in its configuration as representatively illustrated in FIGS. 3A–3C, fluid flow is permitted between the seat surface 192 and the seal surface 194. However, as more fully described hereinbelow, when the lower sleeve 190 is axially downwardly displaced relative to the lower housing 124, seat surface 192 may sealingly engage seal surface 194 to thereby prevent fluid flow therebetween. It is to be understood that other means may be utilized to prevent fluid flow therebetween without departing from the principles of the present invention, for example, a circumferential seal, such as an o-ring (not shown), may be carried on the lower sleeve 188 or the lower housing 124, such that axial engagement of the lower housing and lower sleeve results in sealing engagement therebetween.

A generally tubular upper sleeve 196 radially outwardly overlaps the housing 184 and is axially slidingly engaged therewith. The upper sleeve 196 is releasably secured against axial displacement relative to the housing 184 by a shear pin 198 installed radially through the upper sleeve and into the housing. As shown in FIG. 3C, the upper sleeve 196 sealingly engages the upper membrane 180 at its peripheral edge axially opposite the upper portion 186 of the housing 184. A circumferential seal 200, carried externally on the housing 184, sealingly engages the upper sleeve 196.

In the configuration shown in FIGS. 3A–3C, fluid is prevented from flowing through the axial flow passage 116 from the upper portion 174, through the housing 184, and thence to the lower portion 176. However, a bypass flow passage 202 is provided whereby fluid in the upper portion 174 may enter a radially extending port 204 formed through an upper portion 206 of the upper sleeve 196, flow through an axially extending channel 208 formed externally on the upper sleeve 196, flow radially between the housing 184 and the lower housing 124, enter an axially extending channel 210 formed externally on the lower sleeve 190, and flow between seat surface 192 and seal surface 194 into the lower portion 176. Thus, it will be readily appreciated that, as long as the port 204 is open, fluid may flow axially through the bypass flow passage 202.

Such flow of fluid through the bypass flow passage 202 is advantageous when, for example, the apparatus 100 is being run into a subterranean well on a tubing string. If the well contains fluid therein, the bypass flow passage 202 will permit the fluid to fill the tubing string as it is run into the well. Therefore, in one mode of operation, fluid will flow from the lower portion 176 to the upper portion 174 via the bypass flow passage 202.

Figure 4A:
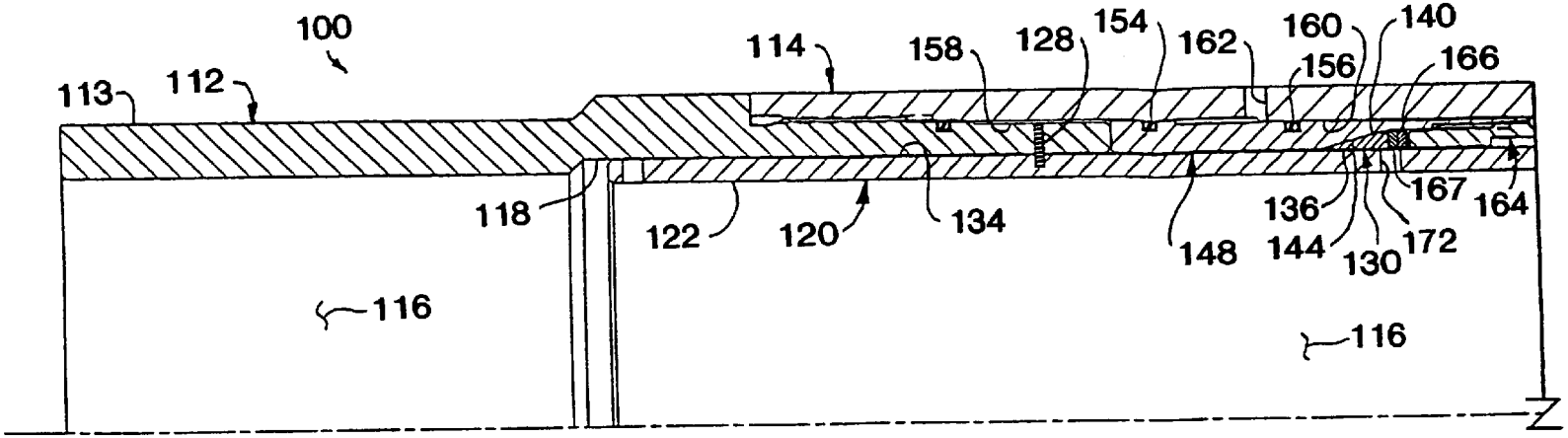
FIGS. 4A–4C are quarter-sectional views of successive axial portions of the second linear indexing apparatus, the apparatus being shown in a configuration in which it has been positioned in the well, the bidirectional disappearing plug preventing fluid flow in a first axial direction through the apparatus.
Figure 4B:
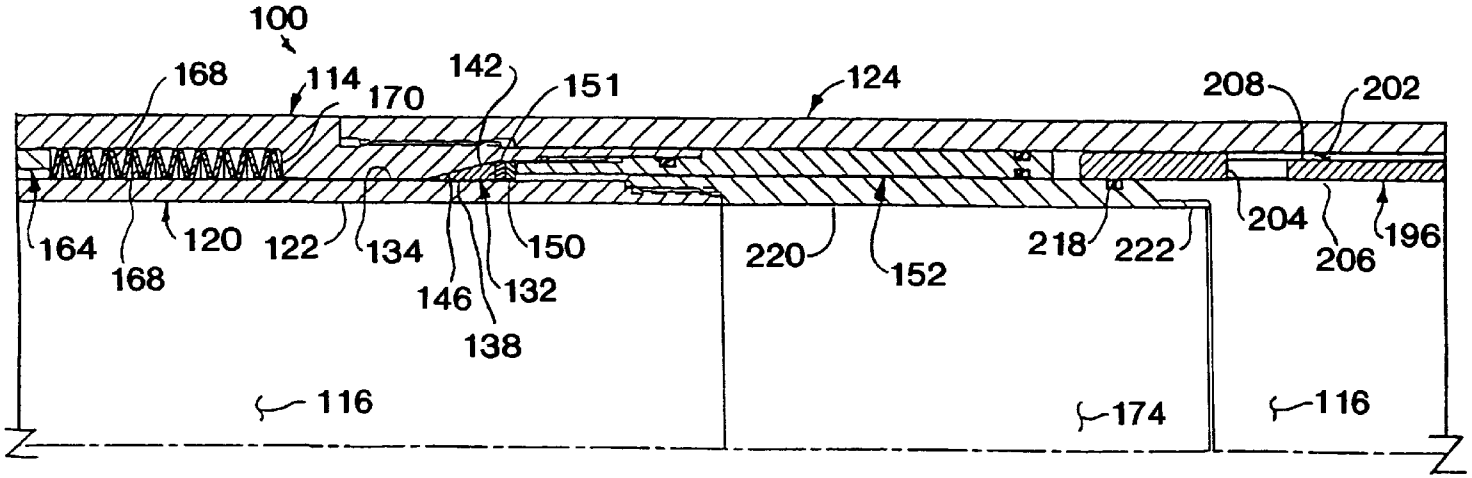
Figure 4C:
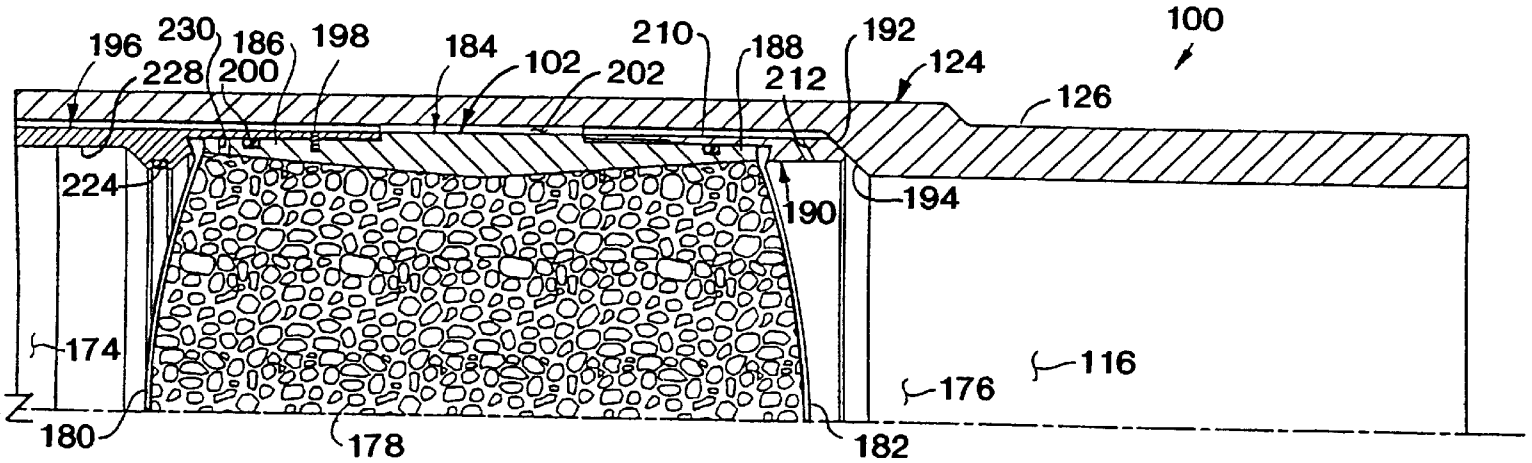

Referring additionally now to FIGS. 4A–4C, the apparatus 100 is representatively illustrated in a configuration in which the bypass flow passage 202 has been substantially closed by axially downwardly shifting the plug 102 with respect to the lower housing 124. Seat surface 192 now sealingly engages seal surface 194 to thereby prevent fluid flow therebetween.

Such axially downward shifting of the plug 102 is accomplished by flowing fluid from the upper portion 174 to the lower portion 176 of the axial flow passage 116 at a flow rate sufficient to cause a pressure differential axially across the plug and overcome any friction between the plug 102 and the lower housing 124. When that flow rate is achieved, the plug 102 will displace axially downward until the seat surface 192 contacts the seal surface 194.

Fluid flow from the upper portion 174 to the lower portion 176 may be accomplished by pumping the fluid from the earth's surface through the interior of the tubing string to the axial flow passage 116 of the apparatus 100. When this method is utilized, fluid pressure in the tubing string and, thus, the upper portion 174, will increase as the plug 102 is displaced axially downward and the seat surface 192 contacts the seal surface 194. The fluid pressure increase in the upper portion 174 consequently produces an increase in the pressure differential axially across the plug 102, forcing the seat surface 192 to sealingly contact the seal surface 194. At this point, fluid flow through the bypass flow passage 202 is substantially restricted, flow therethrough being permitted only via a relatively small radially extending port 212 formed through the lower sleeve 190.

It will be readily appreciated by one of ordinary skill in the art that the fluid pressure increase in the upper portion 174 and in the tubing string above the apparatus 100 may be utilized for many useful purposes. For example, the fluid pressure increase may be utilized to set a hydraulically set packer (not shown) or operate a formation testing tool (not shown), either of which may be installed on the tubing string above the apparatus 100. The fluid pressure increase may also be utilized to incrementally index the mandrel 120 axially downward in a manner that will be more fully described hereinbelow.

Figure 5A:
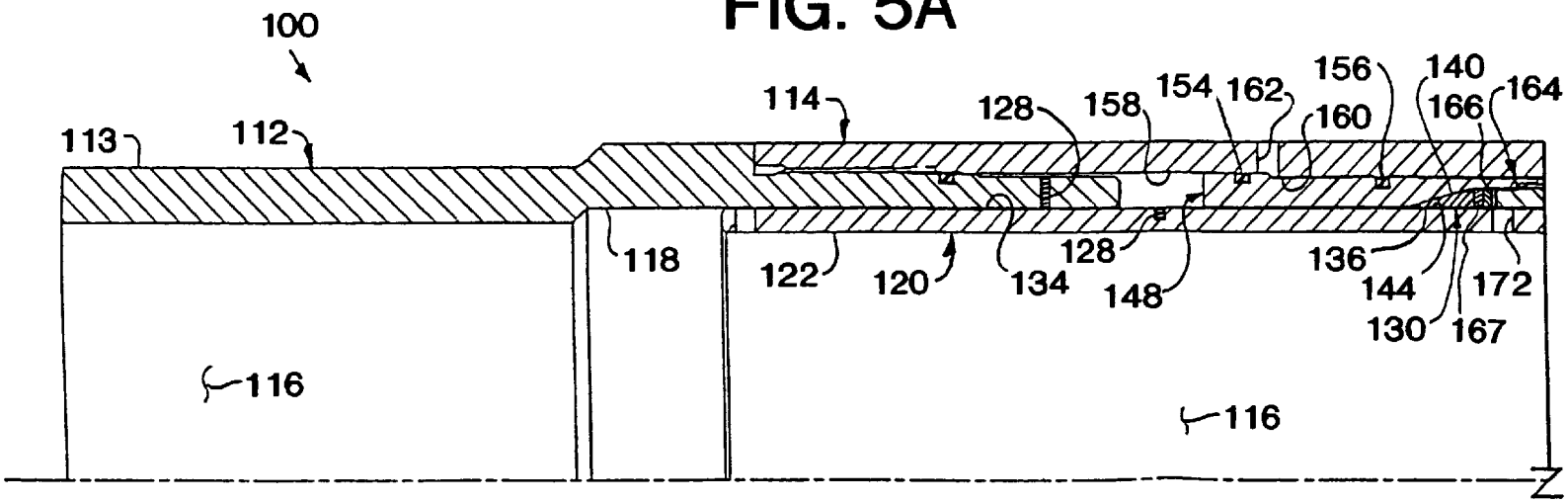
FIGS. 5A–5C are quarter-sectional views of successive axial portions of the second linear indexing apparatus, the apparatus being shown in a configuration in which a mandrel of the apparatus has been axially indexed.
Figure 5B:
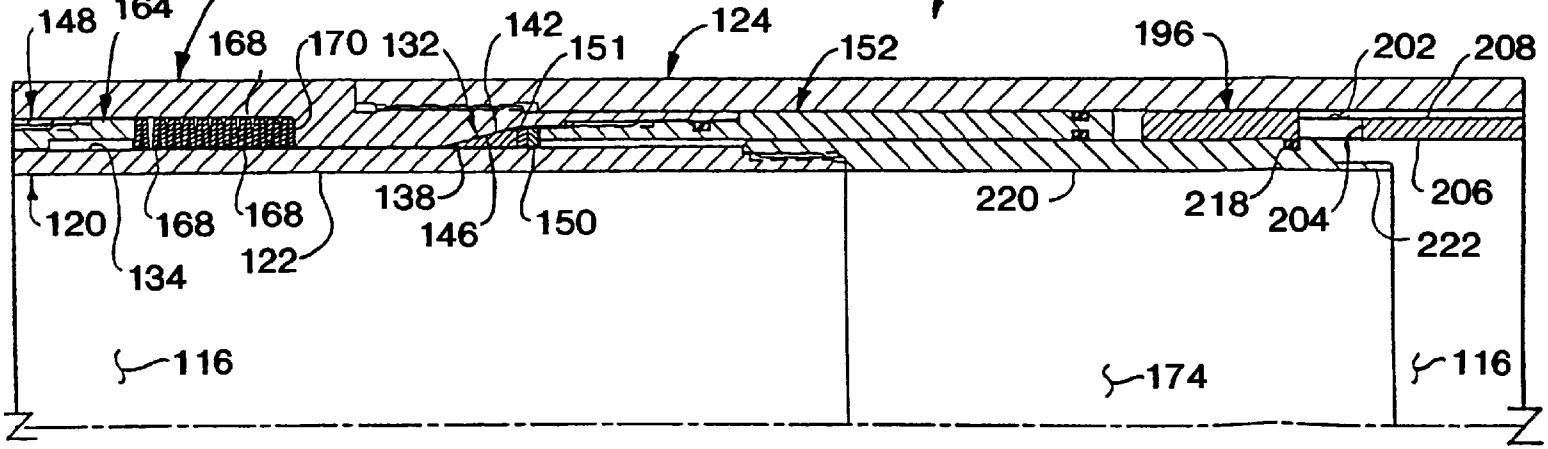
Figure 5C:
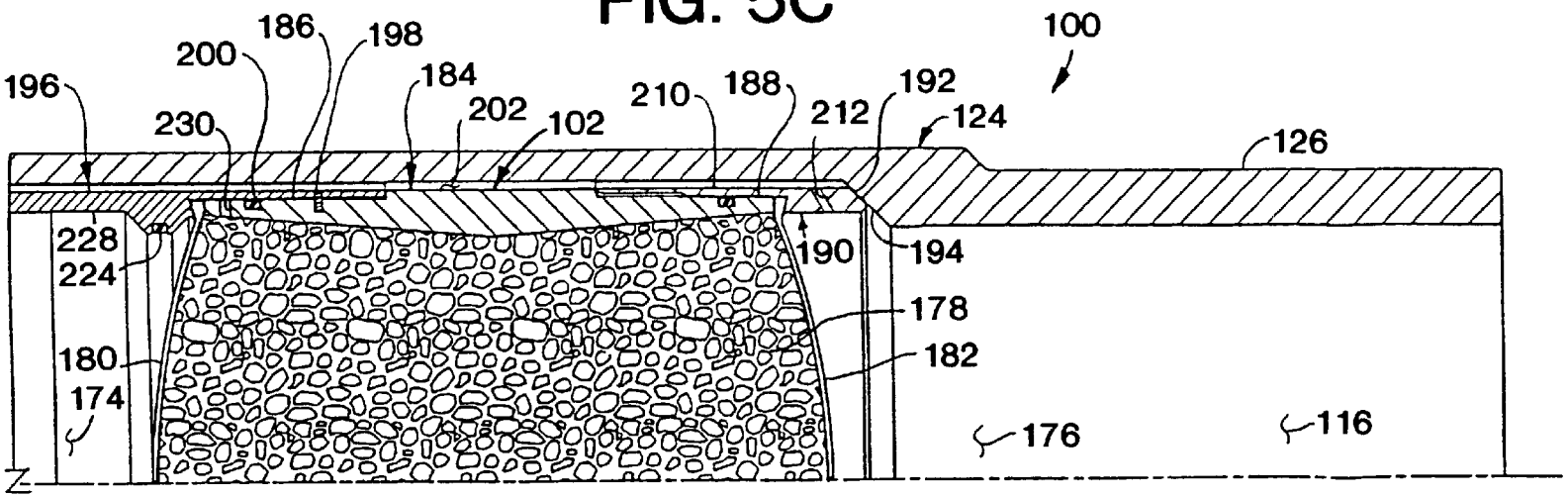

Referring additionally now to FIGS. 5A–5C, the apparatus 100 is representatively illustrated with the piston 148, slip 130, wavy spring 166, washer 167, retainer 164, and mandrel 120 axially downwardly displaced relative to the upper housing 114. Such downward displacement has resulted from applying the predetermined pressure differential from the axial flow passage 116 to the exterior of the apparatus 100 as further described hereinabove. The shear pin 128 has been sheared and the bellville spring washers 168 have been further axially compressed by the downward displacement of the retainer 164. Note that, with the apparatus 100 in the configuration shown in FIGS. 5A–5C, the pressure differential is still being applied, the fluid pressure in the axial flow passage 116 exceeding the fluid pressure in the annulus external to the apparatus 100 by an amount sufficient to overcome the upwardly biasing force exerted by the bellville spring washers 168.

The mandrel 120 has been axially downwardly displaced relative to the lower slip 132. Since the lower slip 132 prevents upward displacement of the mandrel 120, as more fully described hereinabove, this downward displacement of the mandrel 120 may not be reversed. Thus, each time the mandrel 120 is downwardly displaced, such displacement is incremental and is added to any prior downward displacement of the mandrel 120 relative to the upper housing 114.

The piston 148, upper slip 130, retainer 164, wavy spring 166, and washer 167 may be returned to their positions as shown in FIGS. 4A–4C, wherein the piston 148 axially contacts the upper adapter 112, by reducing the pressure differential. When the pressure differential has been reduced sufficiently, the upwardly biasing force exerted by the bellville spring washers 168 on the retainer 164 will overcome the downwardly biasing force exerted by the pressure differential acting on the differential piston area between the bores 158, 160 and the minimal gripping engagement between the upper slip 130 and the mandrel outer side surface 134, thereby permitting the piston 148, upper slip 130, retainer 164, wavy spring 166, and washer 167 to axially upwardly displace relative to the upper housing 114. Note, however, that the mandrel 120 will remain in its axially downwardly displaced position as shown in FIGS. 5A–5C, the lower slip 132 preventing upward displacement of the mandrel 120 as more fully described hereinabove.

Figure 6A:
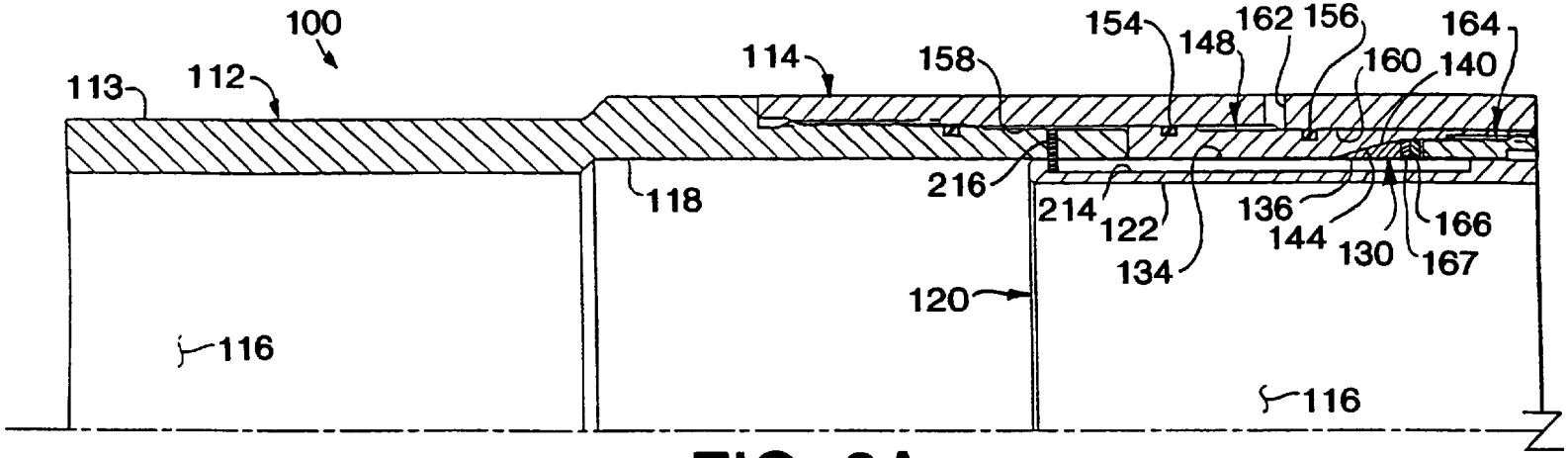
FIGS. 6A–6C are quarter-sectional views of successive axial portions of the second linear indexing apparatus, the apparatus being shown in a configuration in which the mandrel engages an expulsion portion of the bidirectional disappearing plug.
Figure 6B:
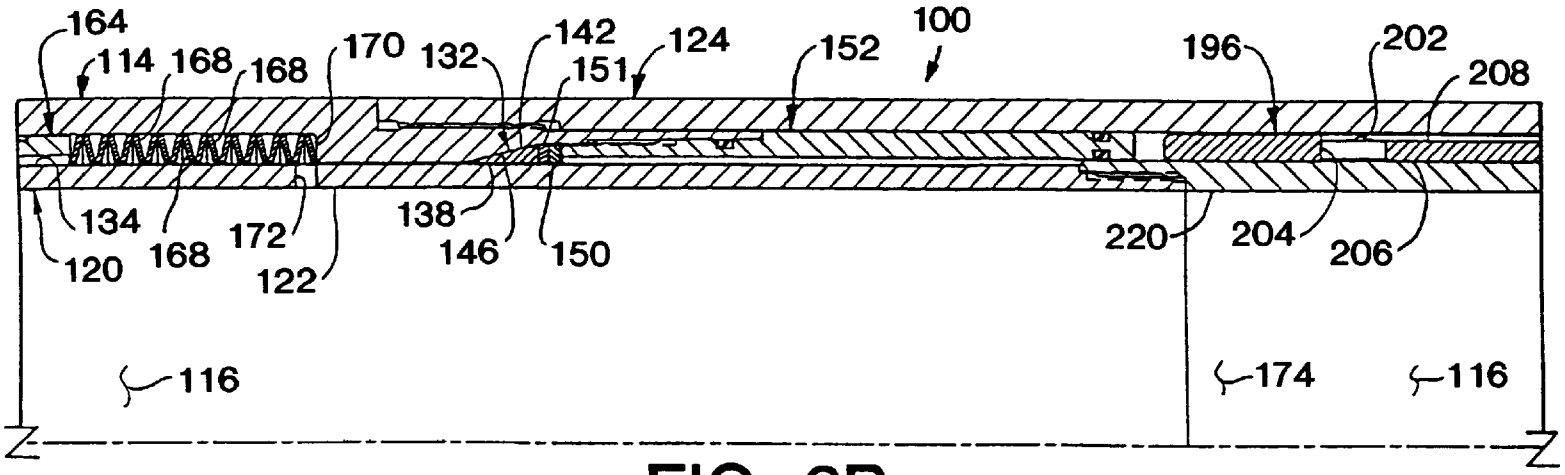
Figure 6C:
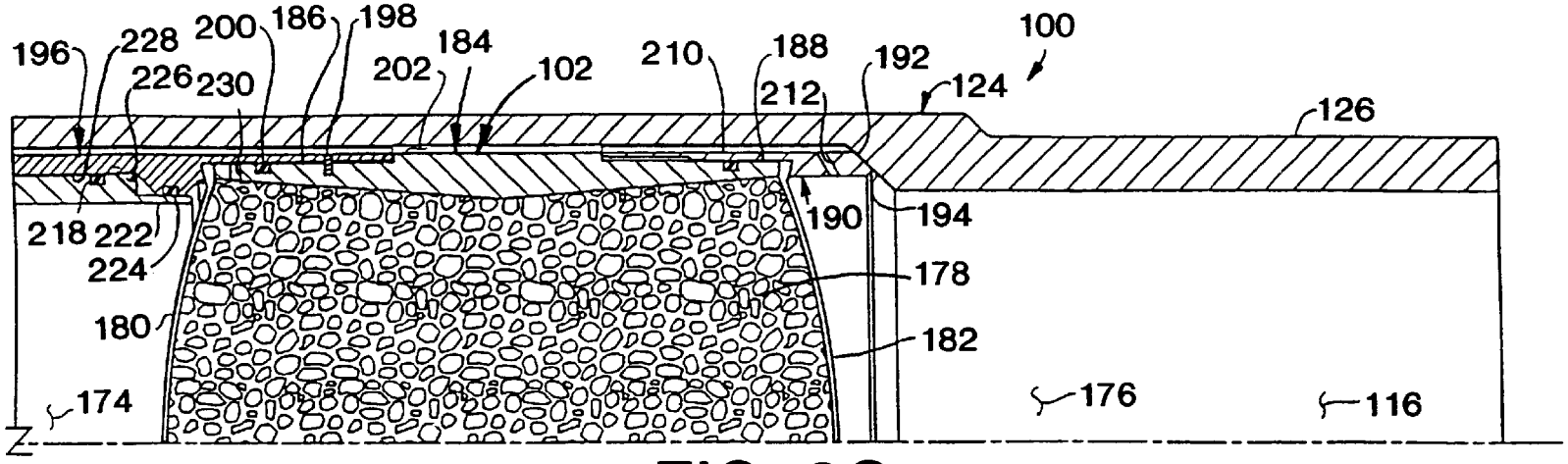

Referring additionally now to FIGS. 6A–6C, the apparatus 100 is representatively illustrated with the differential pressure having been reduced so that the upwardly biasing force exerted by the bellville spring washers 168 on the retainer 164 has overcome the downwardly biasing force exerted by the pressure differential acting on the differential piston area between the bores 158, 160 and the minimal gripping engagement between the upper slip 130 and the mandrel outer side surface 134. The piston 148, upper slip 130, retainer 164, wavy spring 166, and washer 167 have axially upwardly displaced relative to the upper housing 114, the piston again axially contacting the upper adapter 112.

As will be readily appreciated by a person of ordinary skill in the art, FIGS. 6A–6C show the apparatus 100 in a configuration in which the pressure differential has been applied and reduced a number of times, representatively, five times. Each time the differential pressure has been applied and then reduced, the mandrel 120 has remained in its axially downwardly displaced position, the lower slip 132 preventing upward displacement of the mandrel 120. Thus, with each successive application of the differential pressure, the mandrel 120 is incrementally downwardly displaced relative to the upper housing 114 a distance approximately equal to the corresponding axially downward displacement of the piston 148.

As shown in FIGS. 6A–6C, the mandrel 120 and upper adapter 112 have been rotated about their longitudinal axes by 180 degrees relative to their positions shown in FIGS. 5A–5C. An axially extending slot 214 externally formed on the outer side surface 134 of the mandrel 120 is now visible in FIG. 6A. A pin 216, installed radially through the upper adapter 112 is slidingly received in the slot 214. Note that, as representatively illustrated in FIG. 6A, the pin 216 axially contacts an upper end of the slot 214. The pin 216 prevents further axially downward displacement of the mandrel 120 relative to the upper housing 114 in a manner that will be more fully described hereinbelow.

A circumferential seal 218, carried externally on a tubular lower portion 220 of the mandrel 120, is now slidingly received within the upper sleeve upper portion 206 axially downward from the port 204, as shown in FIGS. 6A–6C. Thus, as long as seal 218 internally sealingly engages the upper sleeve upper portion 206 axially downward from the port 204, fluid flow through the bypass flow passage 202 is prevented, and the expendable plug 102 is permitted to seal against fluid pressure acting axially upward against its lower membrane 182. In this manner, the upper portion 174 of the axial flow passage 116 may be placed in fluid and pressure isolation from the lower portion 176 of the axial flow passage. As will be more fully described hereinbelow, and as shown in FIG. 6C, seal 218 eventually enters a radially enlarged internal bore 228 of the upper sleeve upper portion 206, and no longer sealingly engages the upper sleeve upper portion.

A radially reduced and axially extending tubular projection 222 formed on the mandrel lower portion 220 now sealingly engages a circumferential seal 224 carried internally on the upper sleeve upper portion 206 axially between the port 204 and the upper membrane 180, as shown in FIG. 6C. An axially collapsible annular chamber 226 is thus formed axially between seals 218 and 224, and radially between the upper sleeve upper portion 206 and the mandrel lower portion 220. Note that projection 222 sealingly engages the seal 224 after the seal 218 has entered the radially enlarged bore 228, thereby preventing fluid from becoming trapped between the seals 218 and 224.

As will be readily apparent to one of ordinary skill in the art, when projection 222 sealingly engages seal 224, an annular differential pressure area is created across the upper sleeve 196 radially between where the seal 224 sealingly contacts the projection 222 and where the upper sleeve sealingly contacts the upper membrane 180. In this manner, a fluid pressure in the upper portion 174 of the axial flow passage 116 which is greater than a fluid pressure in the lower portion 176 of the axial flow passage will result in a force biasing the upper sleeve 196 axially upward. The same fluid pressures will, however, also result in an axially downwardly biasing force being applied to the expendable plug 102, as will be readily apparent to one of ordinary skill in the art.

Shear pin 198 prevents axial displacement of the upper sleeve 196 relative to the housing 184, until the axially upward biasing force exceeds a predetermined amount, at which point the shear pin 198 shears, permitting the upper sleeve 196 to displace upward. Shear pin 198 is sized so that it will shear before sufficient fluid pressure is present in the upper portion 174 of the axial flow passage 116 to shear the shear pin 216 in slot 214 on the mandrel 120.

Figure 7A:
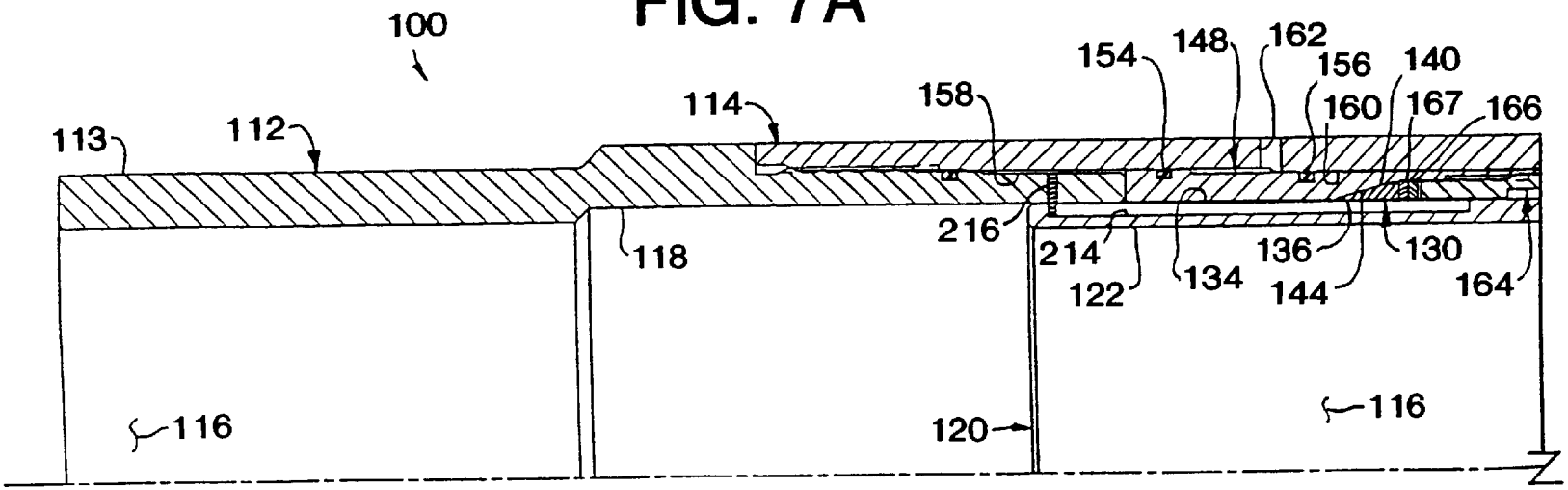
FIGS. 7A–7C are quarter-sectional views of successive axial portions of the second linear indexing apparatus, the apparatus being shown in a configuration in which the bidirectional disappearing plug has been expended from the apparatus.
Figure 7B:
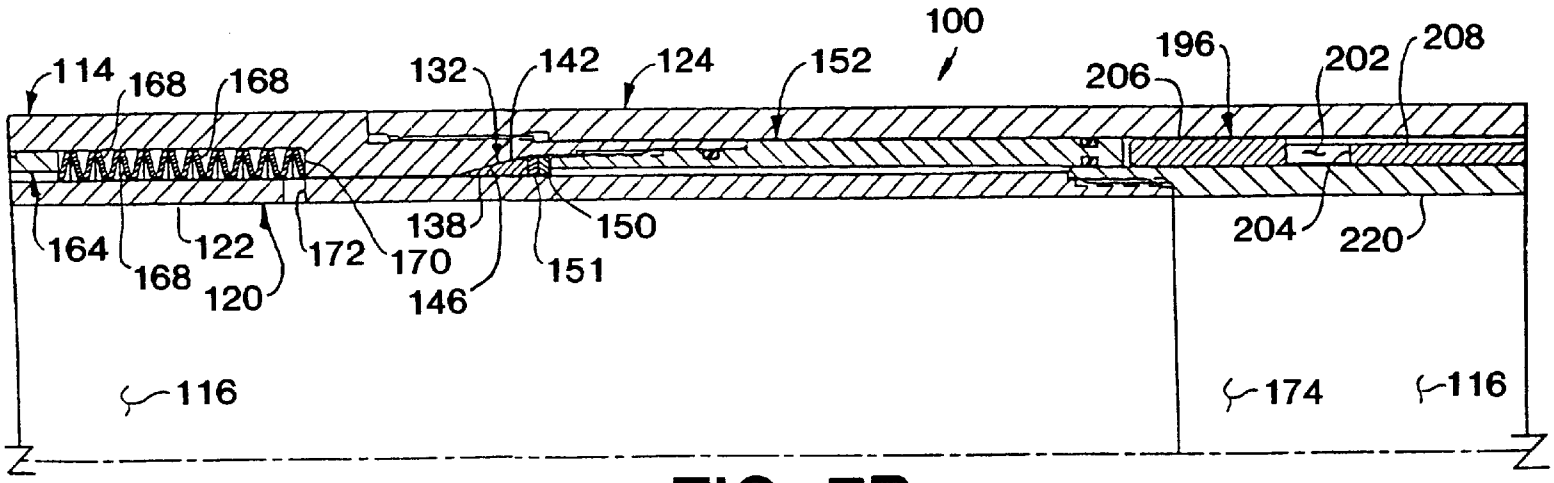
Figure 7C:
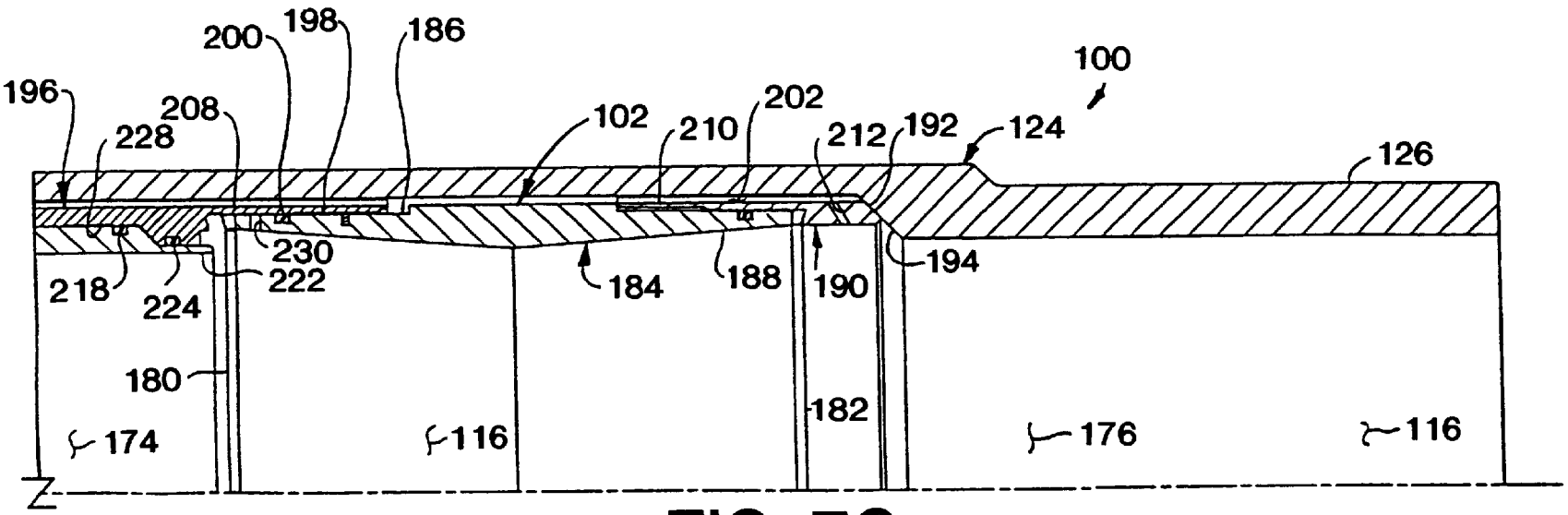

Referring additionally now to FIGS. 7A–7C, the apparatus 100 is shown in its representatively illustrated configuration in which shear pin 198 has been sheared by the axially upward biasing force applied to the upper sleeve 196. As shown in FIG. 7C, the upper sleeve 196 has axially upwardly displaced relative to the housing 184. Port 212 permits fluid to escape from the bypass flow passage 202 when the upper sleeve 196 is displaced axially upward.

At this point, the upper membrane 180 of the expendable plug 102 is no longer axially retained between the upper sleeve 196 and the housing 184. Fluid from the upper portion 174 of the axial flow passage 116 has thus been permitted to axially flow radially between the upper membrane 180 and the upper sleeve 196. The fluid has thence flowed radially inward through a port 230 formed radially through the housing 184 axially between the upper membrane 180 and the seal 200.

The fluid has mixed with the substance 178 and compromised its structural integrity by, for example, dissolving all or a portion of the substance, such that the substance no longer structurally supports the membranes 180, 182. Thereafter, minimal pressure applied to the membranes 180, 182 causes the membranes to fail, opening the axial flow passage 116 for flow therethrough from the upper portion 174 directly to the lower portion 176 axially through the housing 184. As shown in FIG. 7C, only small pieces of the membranes 180, 182 remain attached to the housing 184. Note that, if the mandrel 120 of the apparatus 100 were configured similar to the mandrel 30 of the apparatus 10 shown in FIGS. 1A–2C, the sharp edge 98 may pierce the upper membrane 180 to cause mixing of the fluid in the upper portion 174 with the substance 178.

Figure 8A:
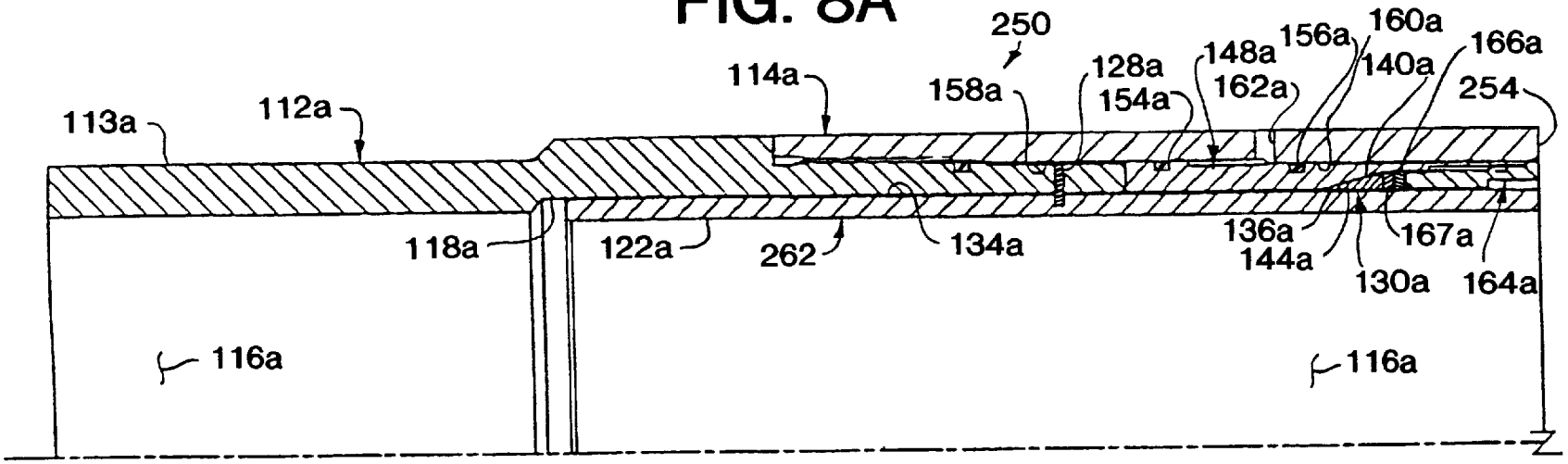
FIGS. 8A–8C are quarter-sectional views of successive axial portions of a third linear indexing apparatus embodying principles of the present invention, the apparatus being shown in a configuration in which it is run into a subterranean well with the bidirectional disappearing plug.
Figure 8B:
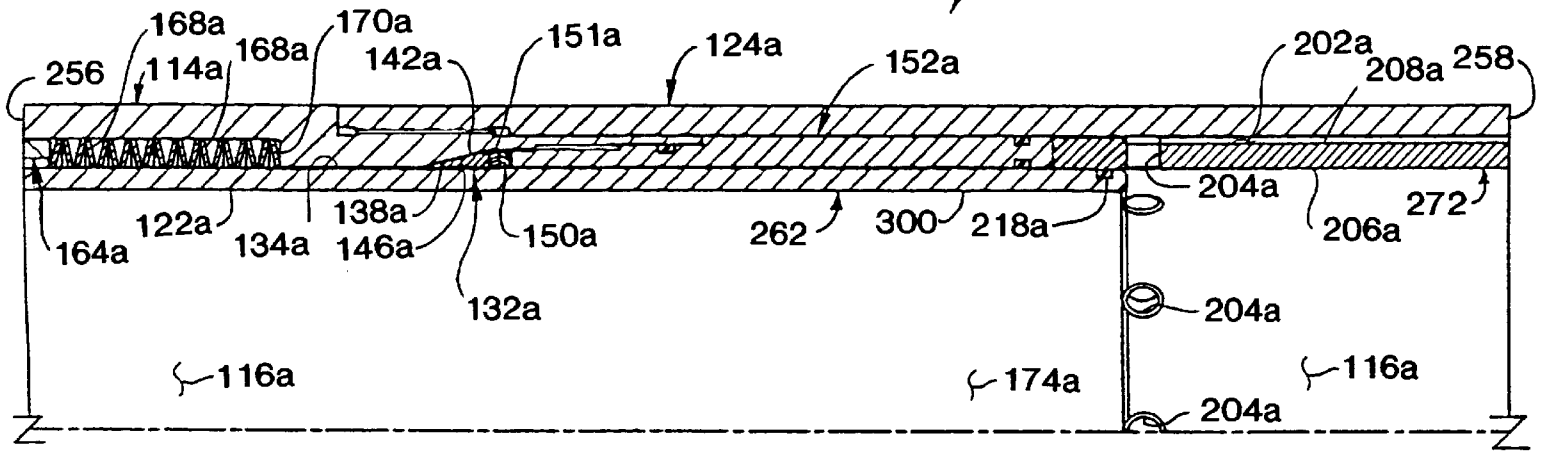
Figure 8C:
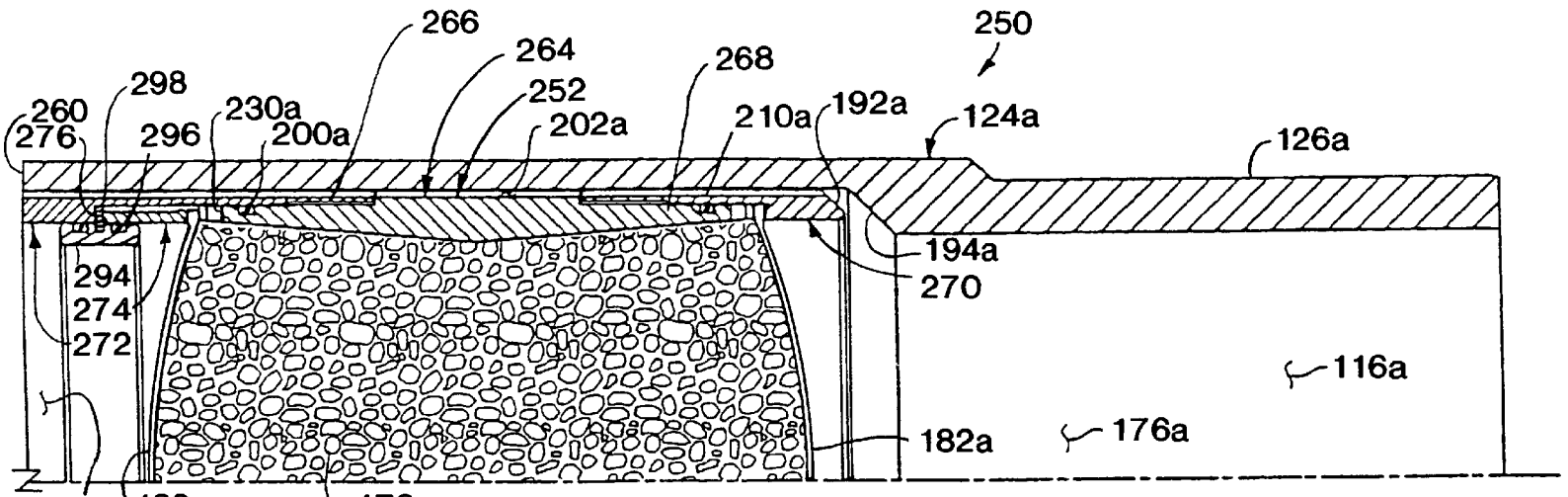

Referring additionally now to FIGS. 8A–8C, another alternate construction of a linear indexing apparatus 250 embodying principles of the present invention is representatively illustrated. The apparatus 250 demonstrates various modifications which may be made without departing from the principles of the present invention. Additionally, the apparatus 250 is shown incorporating an expendable plug 252 therein. The expendable plug 252 also demonstrates various modifications which may be made without departing from the principles of the present invention, but it is to be understood that it is not necessary for the apparatus 250 to incorporate the expendable plug 252 therein. The expendable plug 252 is capable of preventing fluid flow axially upwardly and downwardly through the apparatus, and is further capable of "disappearing", i.e., being expended and leaving no obstruction. The construction and manner of operating the expendable plug 252 is more fully described hereinbelow.

The apparatus 250 is shown in a configuration in which the apparatus is run into a subterranean well. In the following detailed description of the embodiment of the present invention representatively illustrated in the accompanying figures, directional terms, such as "upper", "lower", "upward", "downward", etc., are used in relation to the illustrated apparatus 250 as it is depicted in the accompanying figures, the upward direction being to the left, and the downward direction being to the right in the figures. It is to be understood that the apparatus 250 may be utilized in vertical, horizontal, inverted, or inclined orientations without deviating from the principles of the present invention.

For convenience of illustration, FIGS. 8A–8C show the apparatus 250 in successive axial portions, but it is to be understood that the apparatus is a continuous assembly, lower end 254 of FIG. 8A being continuous with upper end 256 of FIG. 8B, and lower end 258 of FIG. 8B being continuous with upper end 260 of FIG. 8C. Elements of apparatus 250 which are similar to elements previously described of apparatus 100 are indicated with the same reference numerals, with an added suffix "a".

The upper adapter 112*a* has an axially extending internal bore 118*a* formed thereon, in which a generally tubular mandrel 262 is axially and slidingly received. The mandrel 262 is somewhat similar to the mandrel 120 of the apparatus 100 previously described, but the mandrel 262 does not have a separate lower portion, such as lower portion 220 of the mandrel 120. The circumferential seal 218*a* is externally disposed on the mandrel 262 and is slidingly and sealingly received in the upper sleeve upper portion 206*a*. The axial flow passage 116*a* extends axially through an internal bore 122*a* formed on the mandrel 262.

The expendable plug 252 is contained within the lower housing 124*a*. As will be readily apparent to an ordinarily skilled artisan upon consideration of the further description thereof hereinbelow, the plug 252 functions primarily to selectively permit and prevent fluid communication between upper and lower portions 174*a*, 176*a*, respectively, of the axial flow passage 116*a*.

As with the plug 102 of the apparatus 100, the plug 252, as representatively illustrated in FIGS. 8A–12C, permits fluid communication between the upper and lower portions 174*a*, 176*a*, respectively, when the apparatus 250 is being run into the subterranean well, so that the tubing string may fill with fluids. When it is desired, the plug 252 may be operated to prevent such fluid communication by, for example, applying a fluid pressure to the upper portion 174*a* which is greater than a fluid pressure in the lower portion 176*a*.

Thereafter, when it is desired to again permit fluid communication between the upper and lower portions 174*a*, 176*a*, respectively, such as when it is desired to flow production or stimulation fluids through the axial flow passage 116*a*, the plug 252 may be expended by incrementally indexing the mandrel 262 axially downward in a manner more fully described hereinbelow. It is to be understood that fluid communication may be prevented or permitted between the upper and lower portions 174*a*, 176*a*, respectively, for purposes other than setting hydraulically set packers and flowing production or stimulation fluids therethrough without departing from the principles of the present invention.

The expendable plug 252 includes a dispersible solid substance 178*a* contained axially between upper and lower membranes 180*a*, 182*a*, respectively, and radially within a housing 264. The substance 178*a* is preferably granular and may be a mixture of sand and salt. The upper and lower membranes 180*a,* 182*a,* respectively, are preferably made of an elastomeric material, such as rubber. The construction and manner of manufacturing an expendable plug similar to expendable plug 252 is more fully described hereinbelow in the written description accompanying FIGS. 14A–19B.

The housing 264 is generally tubular and has upper and lower end portions 266, 268, respectively, formed thereon. The upper membrane 180*a* is circumferentially adhesively bonded to the upper end portion 266 at an outer edge of the upper membrane. In a similar manner, the lower membrane 182*a* is circumferentially adhesively bonded to the lower end portion 268 at an outer edge of the lower membrane. Thus, with the substance 178*a* contained within the housing 264 and membranes 180*a,* 182*a,* fluid flow axially through the housing 264 is prevented.

A generally tubular lower sleeve 270 is threadedly and sealingly attached to the lower end portion 268 and extends axially downward therefrom. The lower sleeve 270 is axially slidingly received within the lower housing 124*a*. A radially sloped and axially extending seat surface 192*a* is formed on the lower sleeve 270 axially opposite a complementarily shaped seal surface 194*a* internally formed on the lower housing 124*a*.

With the apparatus 250 in its configuration as representatively illustrated in FIGS. 8A–8C, fluid flow is permitted between the seat surface 192*a* and the seal surface 194*a*. However, as more fully described hereinbelow, when the lower sleeve 270 is axially downwardly displaced relative to the lower housing 124*a,* seat surface 192*a* may sealingly engage seal surface 194*a* to thereby prevent fluid flow therebetween. Note that lower sleeve 270 does not have a port, such as port 212 of apparatus 100, formed therethrough. Therefore, when seat surface 192*a* sealingly engages seal surface 194*a,* fluid flow axially through the bypass flow passage 202*a* is also prevented.

A generally tubular upper sleeve 272 radially outwardly overlaps the housing 264 and is threadedly and sealingly engaged therewith. A generally tubular bypass ring 274 is slidingly received within the upper sleeve 272 between the upper membrane 180*a* and a radially extending internal shoulder 276 formed on the upper sleeve. The bypass ring 274 sealingly engages the upper membrane 180*a* at its peripheral edge axially opposite the upper portion 266 of the plug housing 264.

Figure 13:
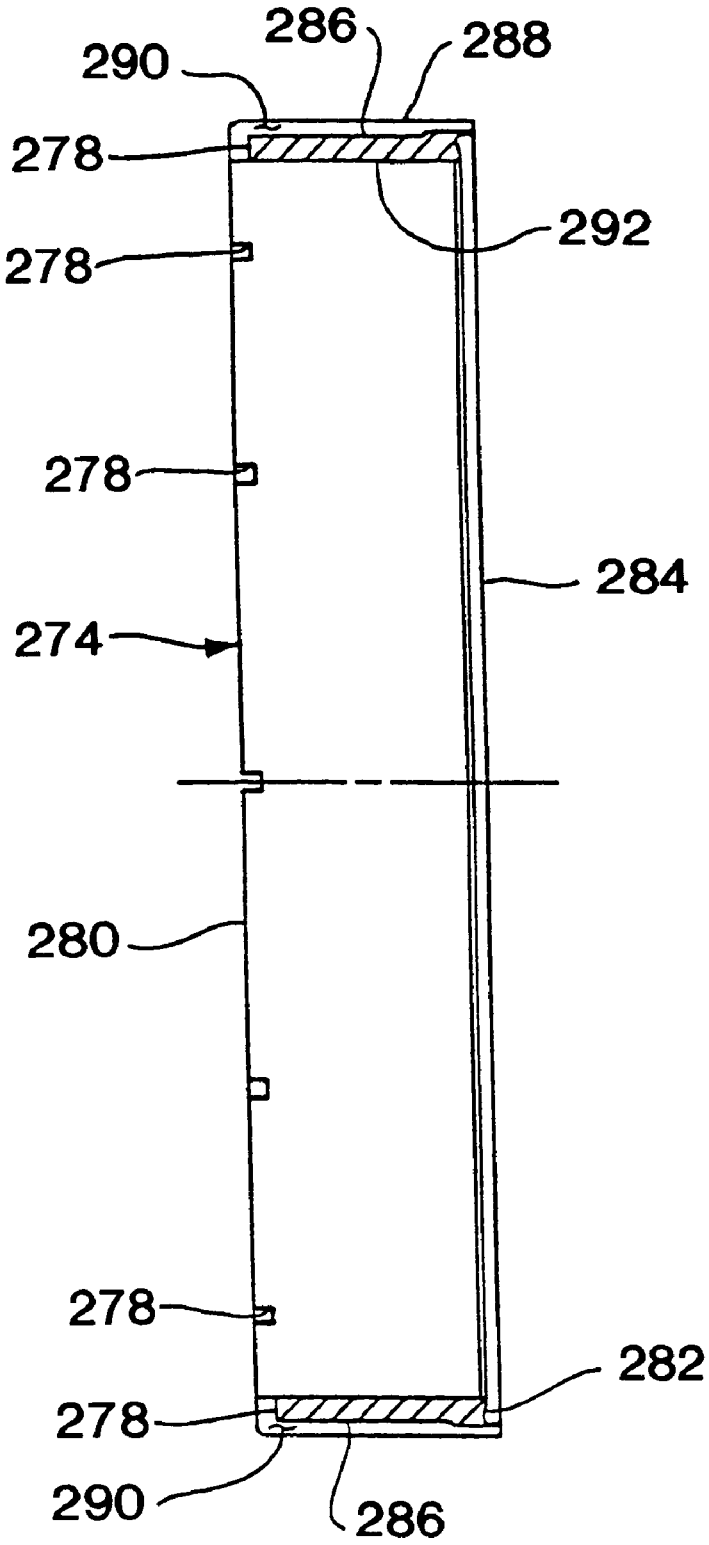
FIG. 13 is a cross-sectional view of a bypass ring of the third linear indexing apparatus.

Referring additionally now to FIG. 13, the bypass ring 274 is representatively illustrated at an enlarged scale. A circumferentially spaced apart series of radially extending slots 278 are formed on an upper end 280 of the bypass ring 274, and a circumferential profile 282 for complementarily and sealingly engaging the upper membrane 180*a* is formed on a lower end 284 of the bypass ring. A circumferentially spaced apart series of axially extending slots 286 are formed on an outer side surface 288 of the bypass ring 274. Each of the axial slots 286 intersects one of the radial slots 278, thereby collectively forming a circumferentially spaced apart series of flow paths 290 across the upper end 280 and the outer side surface 288. A polished inner bore 292 provides a sealing surface.

When the bypass ring 274 is operatively installed axially between the shoulder 276 and the upper membrane 180*a,* as shown in FIG. 8C, the profile 282 sealingly engages the upper membrane 180*a* and the flow paths 290 are in fluid communication with the port 230*a* which extends radially through the upper portion 266 of the plug housing 264. When it is desired to expend the plug 252, as more fully described hereinbelow, the flow paths 290 are placed in fluid communication with the upper portion 174*a* of the axial flow passage 116*a,* so that fluid may flow from the upper portion 174*a* to the substance 178*a* via the flow paths 290 and port 230*a*.

An axially extending seal ring 294 is slidingly received within the upper sleeve 272 and the bore 292 of the bypass ring 274. Two circumferential seals 296 are carried on the seal ring 294 and axially straddle the shoulder 276 and upper end 280, as shown in FIG. 8C. Thus, the seal ring 294 internally sealingly engages the upper sleeve 272 and the bypass ring 274, thereby preventing fluid communication between the upper portion 174*a* of the axial flow passage 116*a* and the flow paths 290.

The seal ring 294 is releasably secured in its axial position relative to the bypass ring 274 by two shear pins 298 (only one of which is visible in FIG. 8C). The shear pins are received radially within two of the radial slots 278 of the bypass ring 274 and extend radially into the seal ring 294. As more fully described hereinbelow, when it is desired to expend the plug 252, the mandrel 262 is incrementally indexed axially downward until it axially contacts the seal ring 294, shears the shear pins 298, and axially displaces the seal ring so that the seals 296 no longer axially straddle the shoulder 276 and upper end 280, thereby permitting fluid communication between the upper portion 174*a* of the axial flow passage 116*a* and the flow paths 290.

In the configuration shown in FIGS. 8A–8C, fluid is prevented from flowing through the axial flow passage 116*a* from the upper portion 174*a,* axially through the housing 264, and thence to the lower portion 176*a*. However, as with bypass flow passage 202 of the apparatus 100, bypass flow passage 202*a* permits fluid in the upper portion 174*a* to enter a series of circumferentially spaced apart and radially extending ports 204*a* formed through upper portion 206*a* of the upper sleeve 272, flow through axially extending channel 208*a* formed on the upper sleeve 272, flow radially between the housing 264 and the lower housing 124*a,* enter axially extending channel 210*a* formed on the lower sleeve 270, and flow between seat surface 192*a* and seal surface 194*a* into the lower portion 176*a*. Thus, it will be readily appreciated that, as long as the ports 204*a* are open, and the seat surface 192*a* is not sealingly engaging the seal surface 194*a,* fluid may flow axially through the bypass flow passage 202*a*.

Figure 9A:
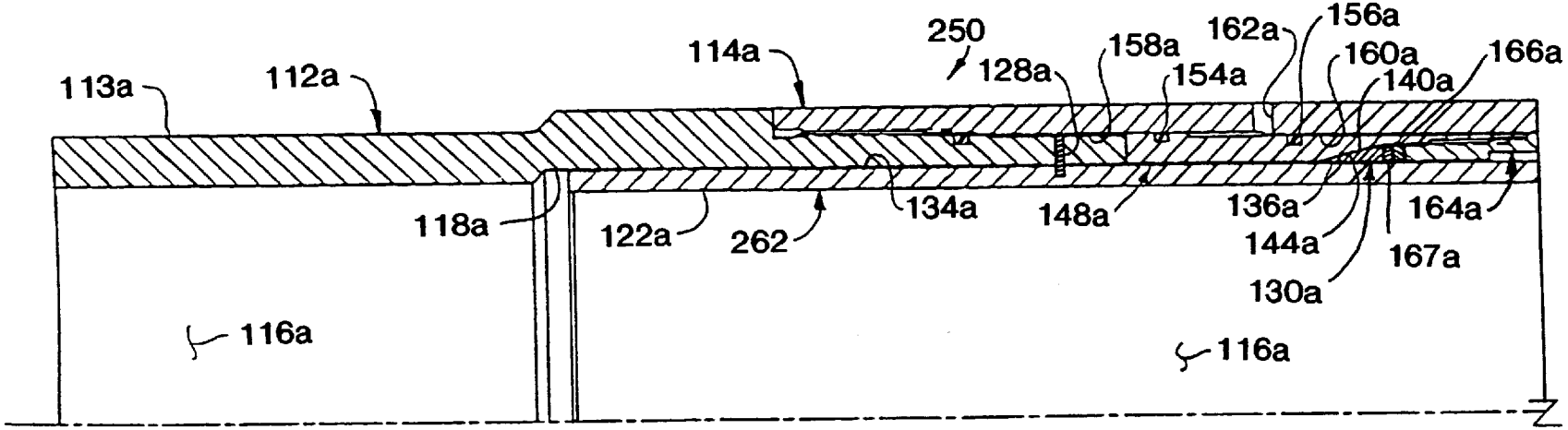
FIGS. 9A–9C are quarter-sectional views of successive axial portions of the third linear indexing apparatus, the apparatus being shown in a configuration in which it has been positioned in the well, the bidirectional disappearing plug preventing fluid flow in the first axial direction through the apparatus.
Figure 9B:
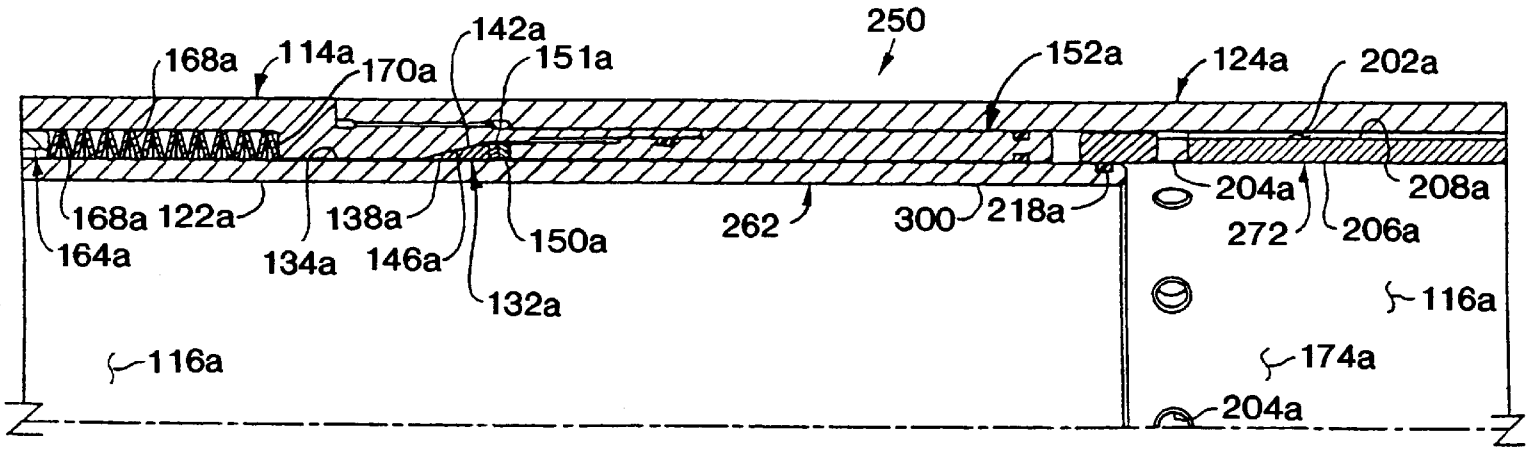
Figure 9C:
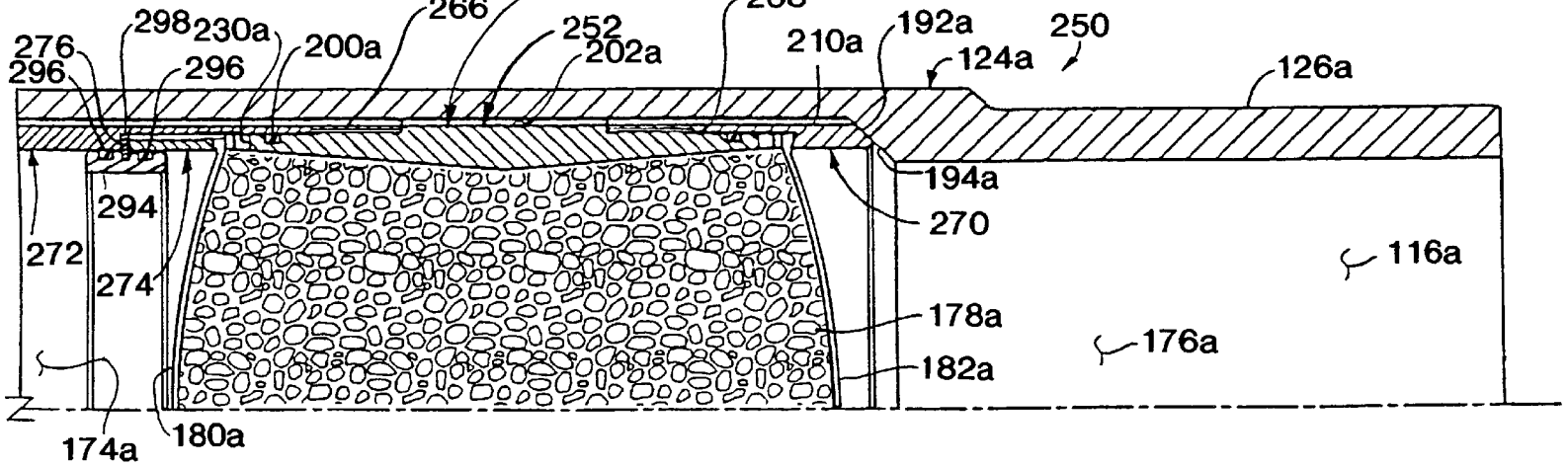

Referring additionally now to FIGS. 9A–9C, the apparatus 250 is representatively illustrated in a configuration in which the bypass flow passage 202*a* has been closed by axially downwardly shifting the plug 252 with respect to the lower housing 124*a*. Seat surface 192*a* now sealingly engages seal surface 194*a* to thereby prevent fluid flow therebetween.

Similar to the operation previously described for the apparatus 100, such axially downward shifting of the plug 252 is accomplished by flowing fluid from the upper portion 174*a* to the lower portion 176*a* of the axial flow passage 116*a* at a flow rate sufficient to cause a pressure differential axially across the plug and overcome any friction between the plug 252 and the lower housing 124*a*. When that flow rate is achieved, the plug 252 will displace axially downward until the seat surface 192*a* contacts the seal surface 194*a*.

Fluid flow from the upper to the lower portion 174*a,* 176*a,* respectively, may be accomplished by pumping the fluid from the earth's surface through the interior of the tubing string to the apparatus 250. When this method is utilized, fluid pressure in the tubing string and, thus, the upper portion 174*a,* will increase as the plug 252 is displaced axially downward and the seat surface 192*a* contacts the seal surface 194*a.* The fluid pressure increase in the upper portion 174*a* consequently produces an increase in the pressure differential axially across the plug 252, forcing the seat surface 192*a* to sealingly contact the seal surface 194*a.* At this point, fluid flow through the bypass flow passage 202*a* is prevented.

Figure 10A:
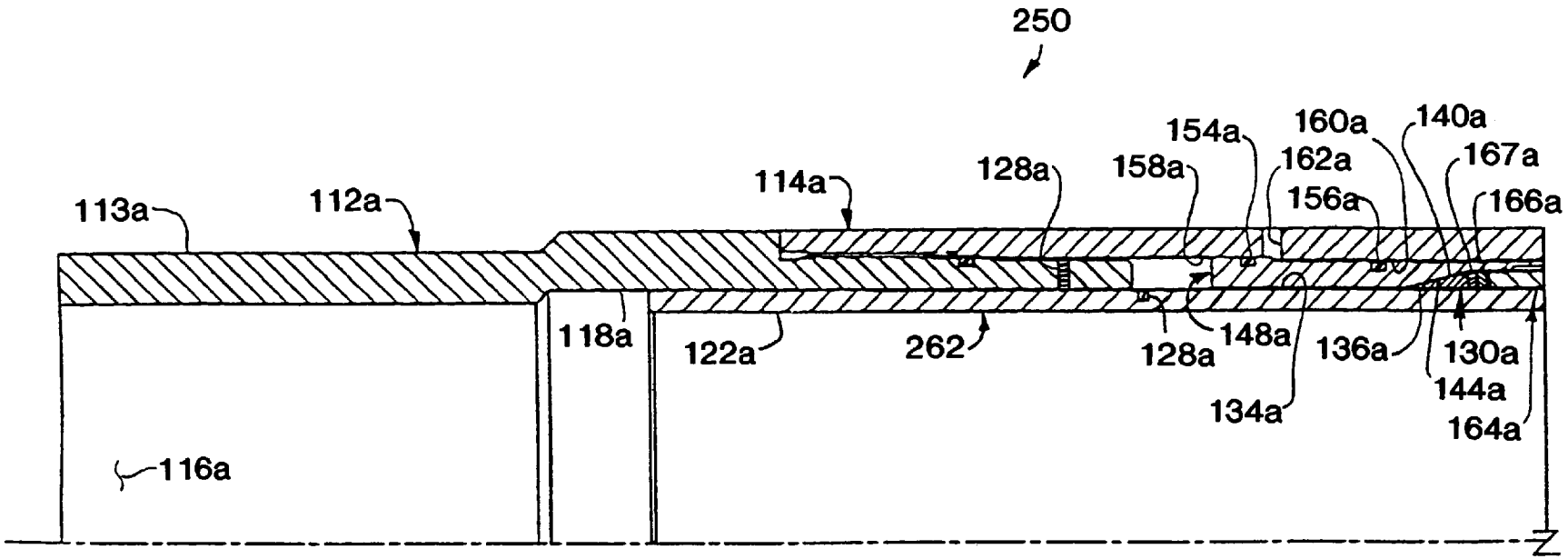
FIGS. 10A–10C are quarter-sectional views of successive axial portions of the third linear indexing apparatus, the apparatus being shown in a configuration in which a mandrel of the apparatus has been axially indexed.
Figure 10B:
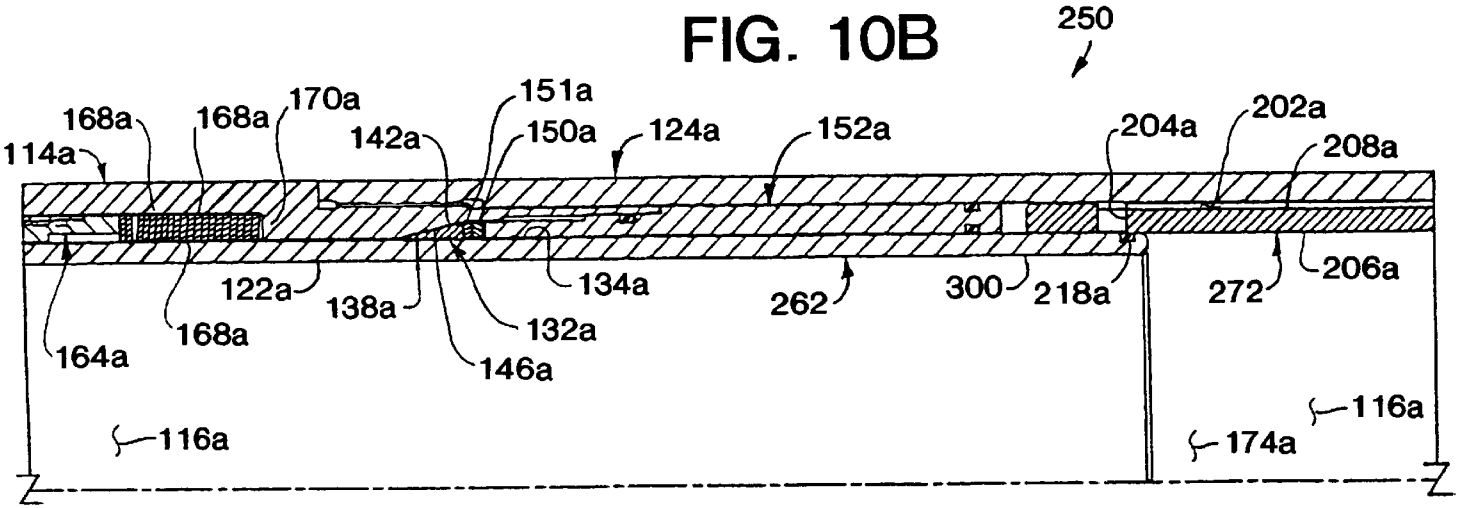
Figure 10C:
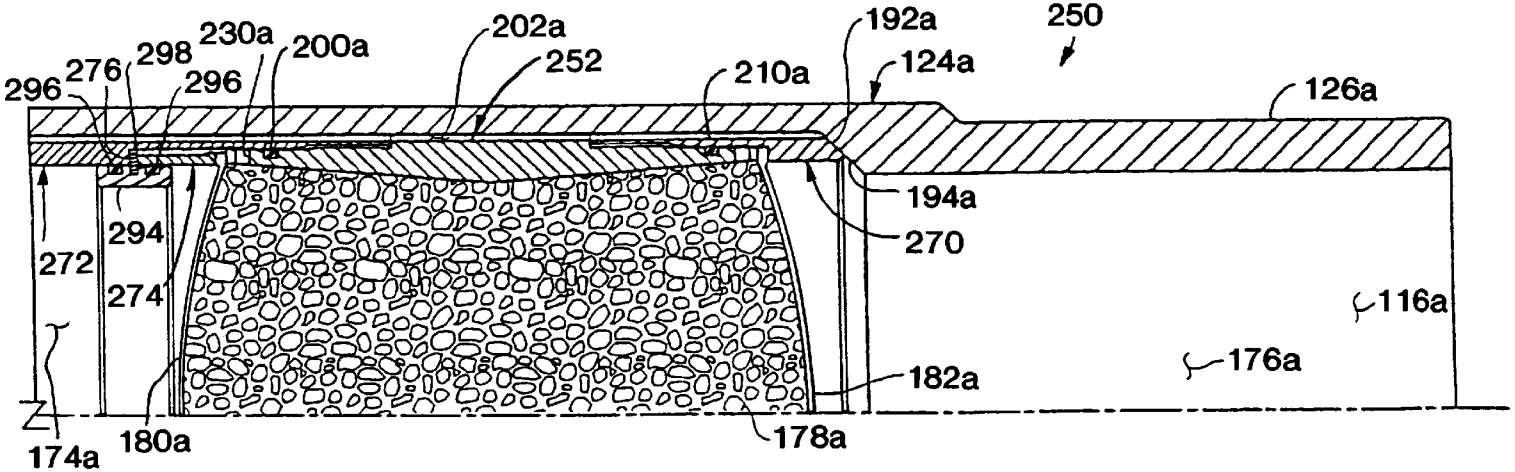

Referring additionally now to FIGS. 10A–10C, the apparatus 250 is representatively illustrated with the piston 148*a,* slip 130*a,* wavy spring 166*a,* washer 167*a,* retainer 164*a,* and mandrel 262 axially downwardly displaced relative to the upper housing 114*a.* The shear pin 128*a* has been sheared and the bellville spring washers 168*a* have been further axially compressed by such downward displacement. Note that, with the apparatus 250 in the configuration shown in FIGS. 10A–10C, the pressure differential is still being applied, the fluid pressure in the axial flow passage 116*a* exceeding the fluid pressure in the annulus external to the apparatus 250 by an amount sufficient to overcome the upwardly biasing force exerted by the bellville spring washers 168*a.*

Figure 11A:
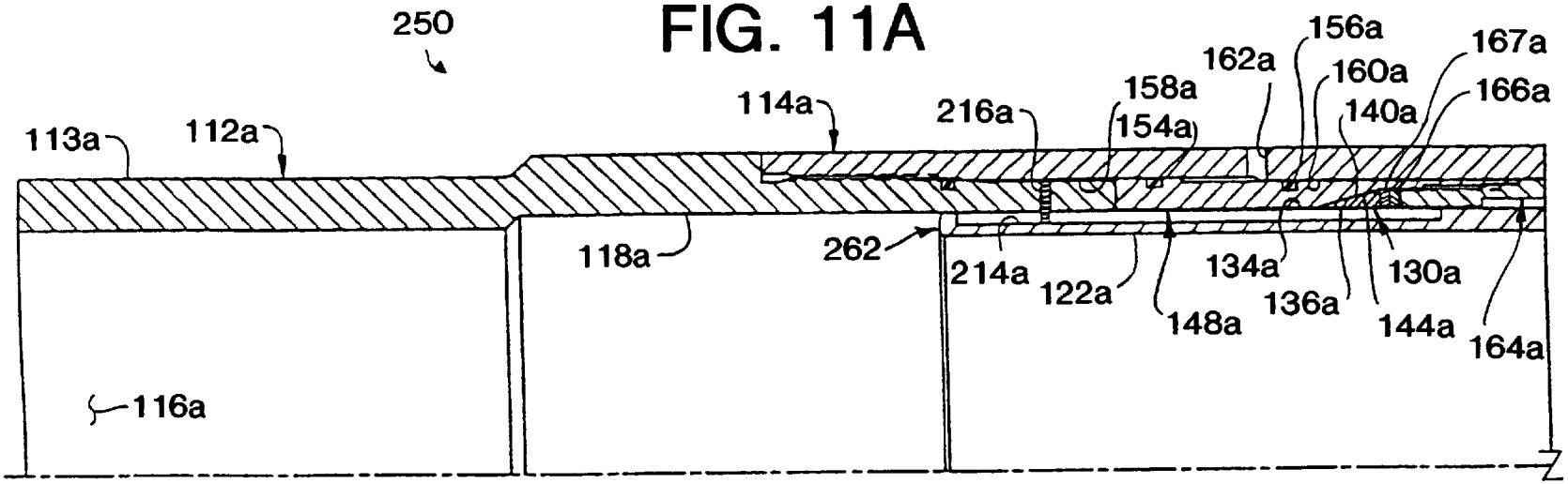
FIGS. 11A–11C are quarter-sectional views of successive axial portions of the third linear indexing apparatus, the apparatus being shown in a configuration in which the mandrel has been further axially indexed.
Figure 11B:
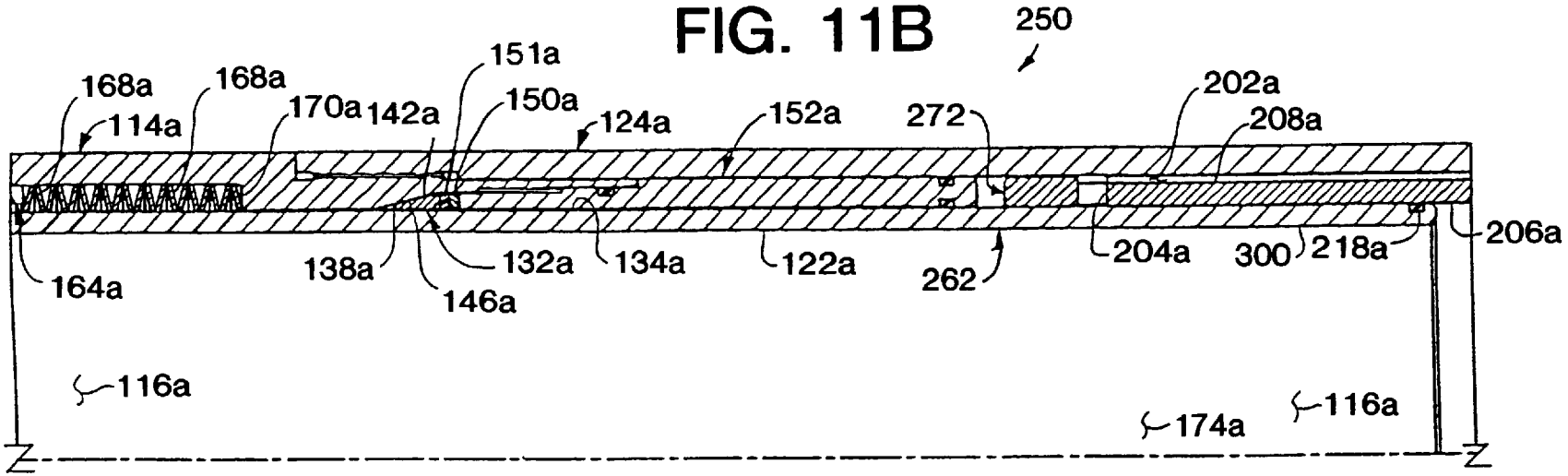
Figures 11C, 12C:
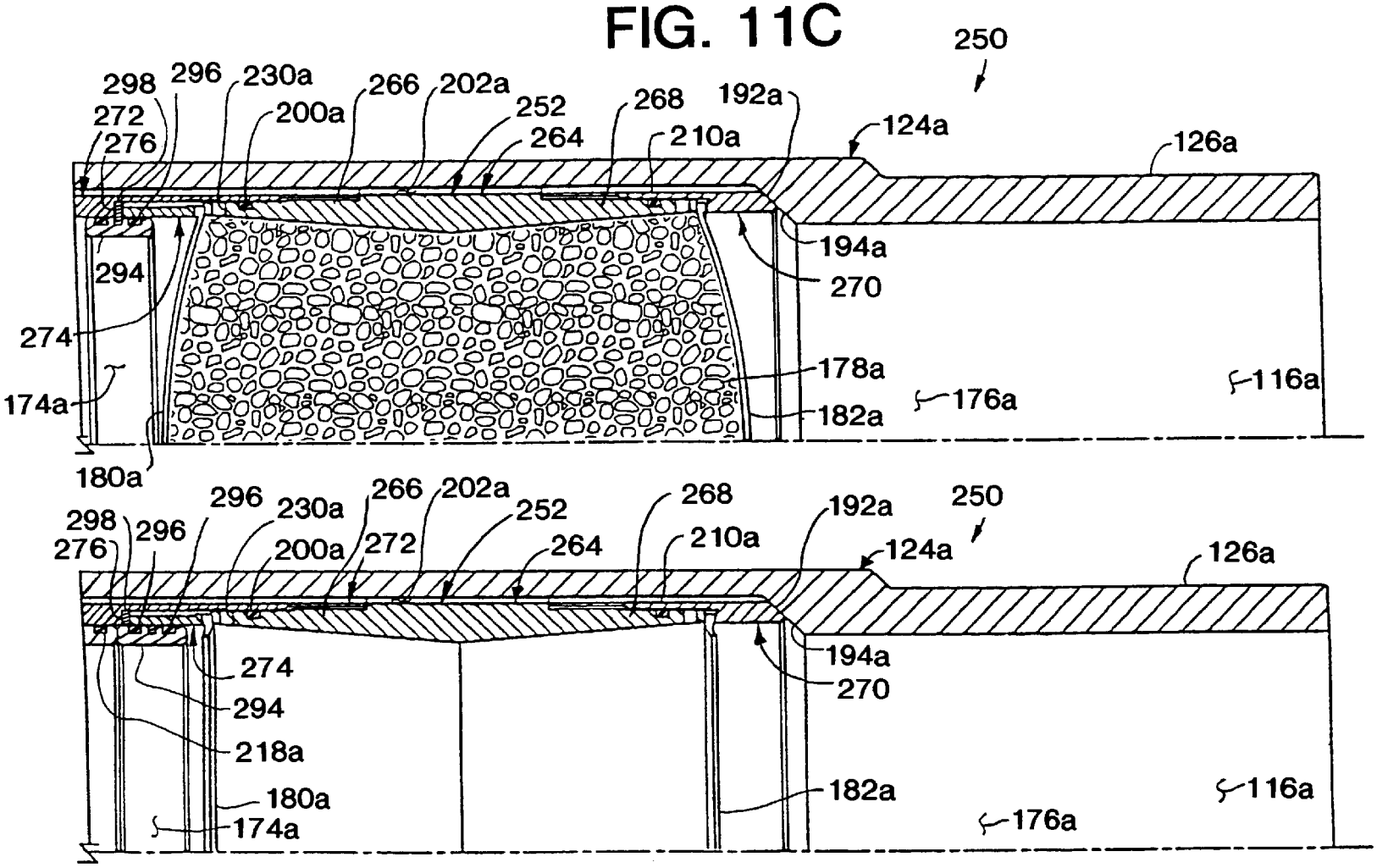

Referring additionally now to FIGS. 11A–11C, the apparatus 250 is representatively illustrated with the differential pressure having been reduced after a number of cycles of applying the differential pressure and then reducing the differential pressure. Representatively, five such cycles have been performed. The upwardly biasing force exerted by the bellville spring washers 168*a* on the retainer 164*a* has overcome the downwardly biasing force exerted by the pressure differential acting on the differential piston area between the bores 158*a,* 160*a* and the minimal gripping engagement between the upper slip 130*a* and the mandrel outer side surface 134*a.* The piston 148*a,* upper slip 130*a,* retainer 164*a,* wavy spring 166*a,* and washer 167*a* have axially upwardly displaced relative to the upper housing 114*a,* the piston again axially contacting the upper adapter 112*a.*

As shown in FIGS. 11A–11C, the mandrel 262 and upper adapter 112*a* have been rotated about their longitudinal axes by 90 degrees relative to their positions shown in FIGS. 10A–10C. A pair of axially extending slots 214*a* (only one of which is visible in FIG. 11A, the other of which is radially opposite the one which is visible) are externally formed on the outer side surface 134*a* of the mandrel 262. A pin 216*a,* installed radially through the upper adapter 112*a* is slidingly received in each of the slots 214*a.* The pins 216*a,* in cooperation with the slots 214*a,* prevent radial displacement of the mandrel 262 relative to the upper adapter 112*a* while permitting axially downward displacement of the mandrel 262 relative to the upper housing 114*a.*

Circumferential seal 218*a,* carried externally on a lower portion 300 of the mandrel 262, is now slidingly received within the upper sleeve upper portion 206*a* axially downward from the port 204*a.* The sealing engagement of seal 218*a* axially downward from the port 204*a* prevents fluid flow through the bypass flow passage 202*a,* and the expendable plug 252 seals against fluid pressure acting axially upward against its lower membrane 182*a.* In this manner, the upper portion 174*a* of the axial flow passage 116*a* may be placed in fluid and pressure isolation from the lower portion 176*a* of the axial flow passage.

Figure 12A:
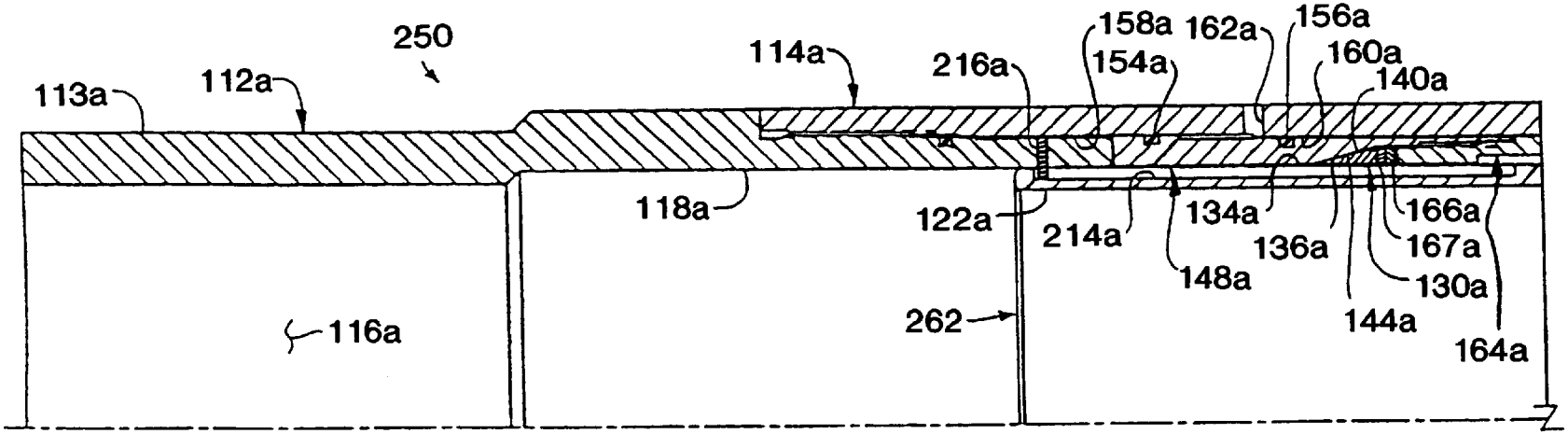
FIGS. 12A–12C are quarter-sectional views of successive axial portions of the third linear indexing apparatus, the apparatus being shown in a configuration in which the bidirectional disappearing plug has been expended from the apparatus.
Figure 12B:
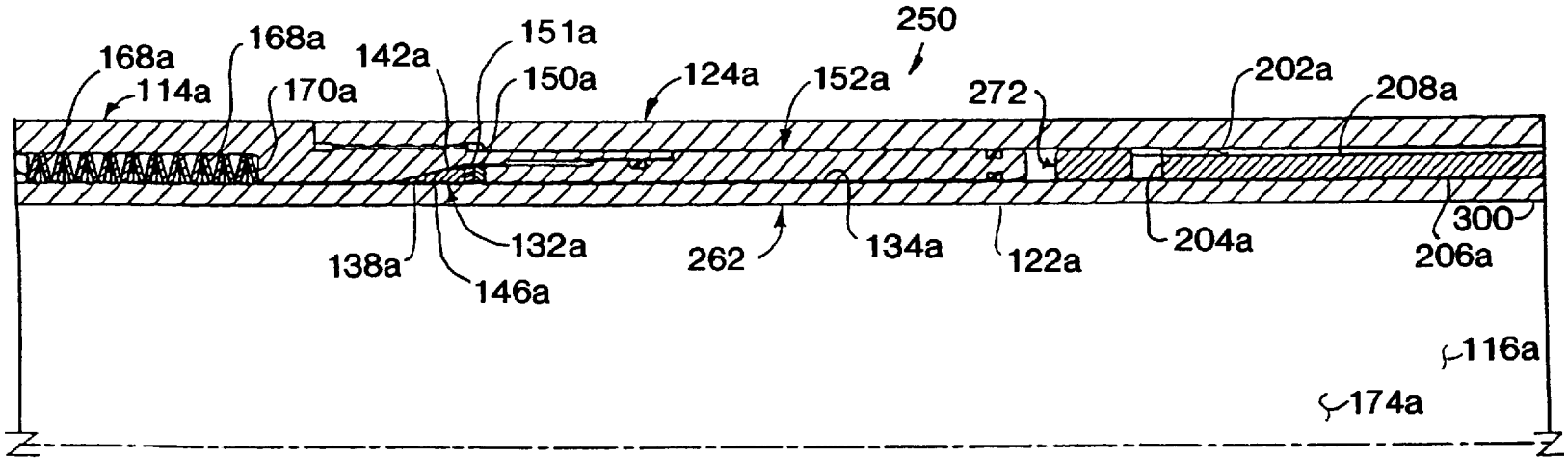

Referring additionally now to FIGS. 12A–12C, the apparatus 250 is shown in its representatively illustrated configuration in which shear pin 298 has been sheared by axially downward displacement of the mandrel 262. Lower portion 300 of the mandrel 262 has axially contacted the seal ring 294 and shifted the seal ring axially downward so that the seals 296 no longer axially straddle the shoulder 276 and upper end 280 of the bypass ring 274.

Fluid from the upper portion 174*a* of the axial flow passage 116*a* has flowed into the flow paths 290 of the bypass ring 274 and radially inward through the port 230*a* on the housing 264. The fluid has mixed with the substance 178*a* and compromised its structural integrity by, for example, dissolving all or a portion of the substance, such that the substance no longer structurally supports the membranes 180*a,* 182*a.* Thereafter, minimal pressure applied to the membranes 180*a,* 182*a* causes the membranes to fail, opening the axial flow passage 116*a* for flow therethrough from the upper portion 174*a* directly to the lower portion 176*a.* As shown in FIG. 12C, only small pieces of the membranes 180*a,* 182*a* remain attached to the housing 264.

Figure 20A:
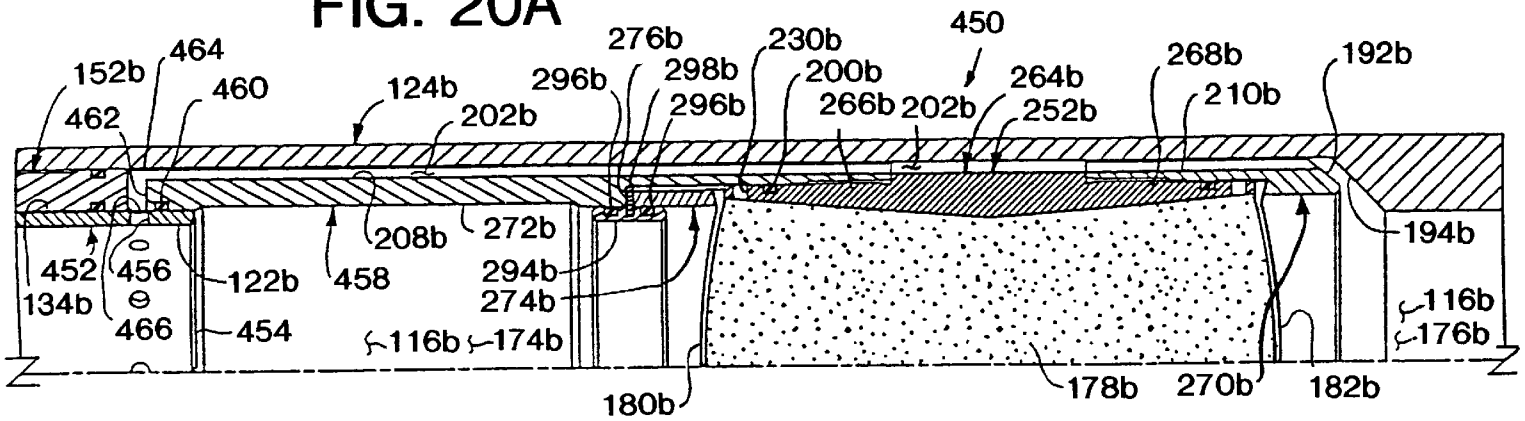
FIGS. 20A–20C are quarter-sectional views of an alternate construction of the third linear indexing apparatus embodying principles of the present invention, FIG. 20A showing the alternately-constructed third apparatus in a configuration in which it is run into the subterranean well with the bidirectional disappearing plug, FIG. 20B showing the alternately-constructed third apparatus in a configuration in which it has been positioned in the well, the bidirectional disappearing plug preventing fluid flow in the first axial direction through the apparatus, and FIG. 20C showing the alternately-constructed third apparatus in a configuration in which fluid flow is prevented through the apparatus in a second axial direction.
Figure 20B:
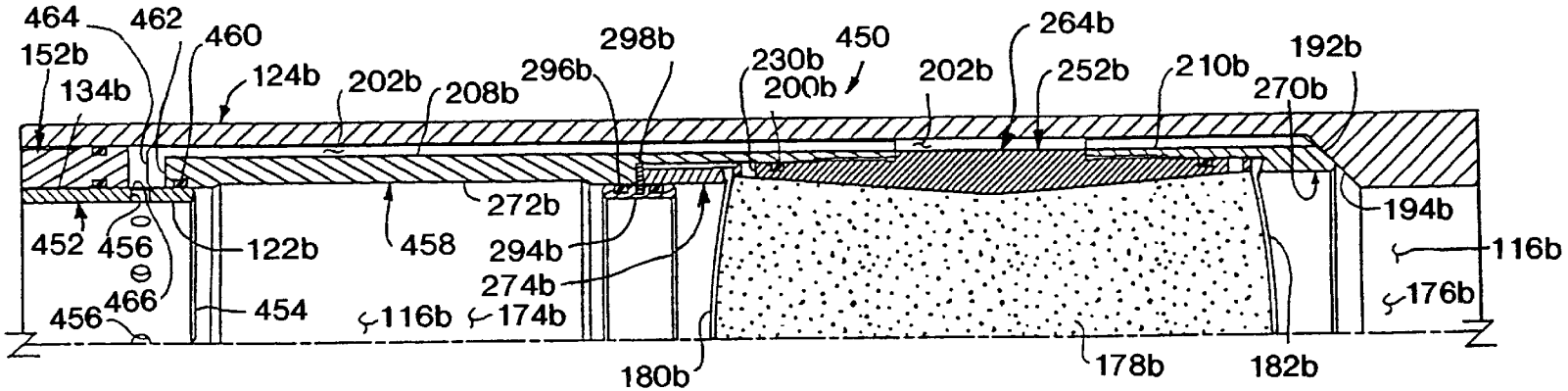
Figure 20C:
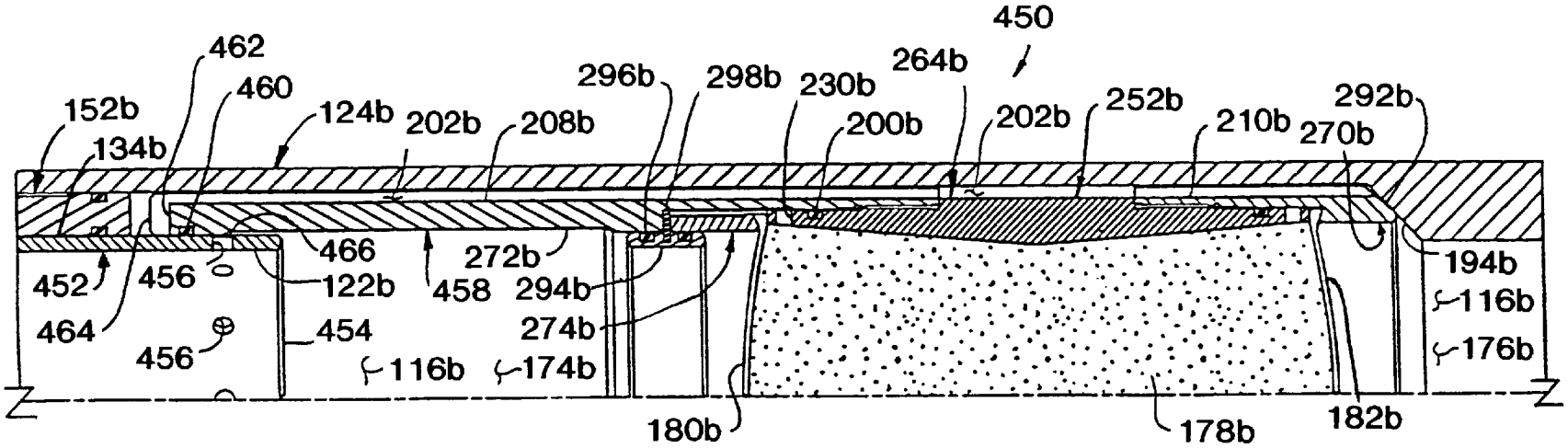

Referring additionally now to FIGS. 20A–20C, an alternately-constructed apparatus 450 is representatively illustrated, the apparatus 450 being substantially similar to the previously-described apparatus 250. For convenience, only that axial portion of the apparatus 450 which is dissimilar to the apparatus 250 is shown in FIGS. 20A–20B, but it is to be understood that the remaining unillustrated portions of the apparatus 450 are similar to the corresponding portions of the apparatus 250, as will be readily apparent to one of ordinary skill in the art upon consideration of the relevant drawing figures and the accompanying detailed description hereinbelow. Elements of apparatus 450 which are similar to elements previously described of apparatus 250 and/or apparatus 100 are indicated with the same reference numerals as previously used, with an added suffix "b".

Apparatus 450 includes a generally tubular mandrel 452 which is similar to the mandrel 262 of apparatus 250, except that a lower end portion 454 of the mandrel 452 has a circumferentially spaced apart series of ports 456 formed radially therethrough. Additionally, the lower end 454 of the mandrel 452 does not carry a circumferential seal externally thereon, such as seal 218*a* of the apparatus 250.

Apparatus 450 also includes a generally tubular upper sleeve 458 which is similar to the upper sleeve 272 of apparatus 250, except that the upper sleeve 458 has a circumferential seal 460 disposed internally thereon and a circumferentially spaced apart series of radially extending slots 462 (only one of which is visible in FIGS. 20A–20C) formed on an upper end 464 thereof. Seal 460 sealingly engages the outer side surface 134*b* of the mandrel 452 and permits fluid communication between the slots 462 and ports 456 to be prevented in a manner which will be more fully described hereinbelow. The slots 462 are in fluid communication with slot 208*b* and form a portion of the bypass flow passage 202*b.* Note that the upper sleeve 458 has no ports formed therethrough, such as ports 204*a* of the apparatus 250.

In operation, the apparatus 450 may be lowered into a subterranean well attached to a tubing string (not shown) as previously described for apparatus 250 and apparatus 100. Referring specifically now to FIG. 20A, when the apparatus 450 is being lowered into the well, fluid in the lower portion 176*b* of the axial flow passage 116*b* may flow between seat surface 192*b* and seal surface 194*b,* axially through the bypass flow passage 202*b,* radially inward through slots 462, and radially inward through the ports 456 to the upper portion 174*b* of the axial flow passage 116*b.* Such capability for bypass flow of fluid around the expendable plug 252*b* corresponds to that of the apparatus 250 representatively illustrated in FIGS. 8A–8C and described in the accompanying written description thereof.

Referring specifically now to FIG. 20B, when fluid pressure is initially applied to the upper portion 174*b* which is greater than fluid pressure in the lower portion 176*b* of the axial flow passage 116*b,* the expendable plug 252*b* is axially downwardly displaced and seat surface 192*b* sealingly engages seal surface 194*b* to thereby prevent axially downward bypass flow of fluid around the expendable plug. This configuration of the apparatus 450 corresponds to the configuration of the apparatus 250 representatively illustrated in FIGS. 9A–9C and described in the accompanying written description thereof.

Referring specifically now to FIG. 20C, when it is desired to prevent axially downward and axially upward bypass flow of fluid around the expendable plug 252*b,* the fluid pressure in the upper portion 174*b* is increased relative to the fluid pressure exterior to the apparatus 450 to thereby axially downwardly displace the mandrel 452 relative to the lower housing 124*b.* This configuration of the apparatus 450 corresponds somewhat to the configuration of the apparatus 250 representatively illustrated in FIGS. 11A–11C, except that, instead of the external seal 218*a* of the apparatus 250 passing axially downward across ports 204*a* on the upper sleeve 272 to sealingly engage the upper sleeve upper portion 206*a,* the ports 456 on the mandrel 452 of the apparatus 450 pass axially downward across the internal seal 460 so that the seal 460 sealingly engages the mandrel outer side surface 134*b* axially upward of the ports 456. In this manner, fluid communication between the slots 462 and the ports 456 is prevented.

A radially reduced outer diameter 466 is formed on the mandrel outer side surface 134*b* so that seal 460 is not damaged as the ports 456 pass axially thereacross. Additionally, reduced diameter 466 permits fluid communication between each of the ports 456 and each of the slots 462 when the ports are axially upwardly disposed relative to the seal 460 as shown in FIGS. 20A & 20B, thereby making it unnecessary to circumferentially align the ports with the slots 462.

Applicants prefer the alternately-constructed apparatus 450 for its ease of assembly, economy of manufacture, and enhanced reliability, among other reasons, as compared to the apparatus 250. It is to be understood, however, that other modifications and alternate constructions may be made without departing from the principles of the present invention. Note that further operation of the apparatus 450 may be accomplished similarly to those further operations described hereinabove for the apparatus 250, for example, the mandrel 452 of the apparatus 450 may be further axially downwardly displaced relative to the lower housing 124*b* to shear the pins 298*b* and axially downwardly displace the seal ring 294*b* in order to expend the expendable plug 252*b,* as shown in FIGS. 12A–12C for the apparatus 250.

Figure 14A:
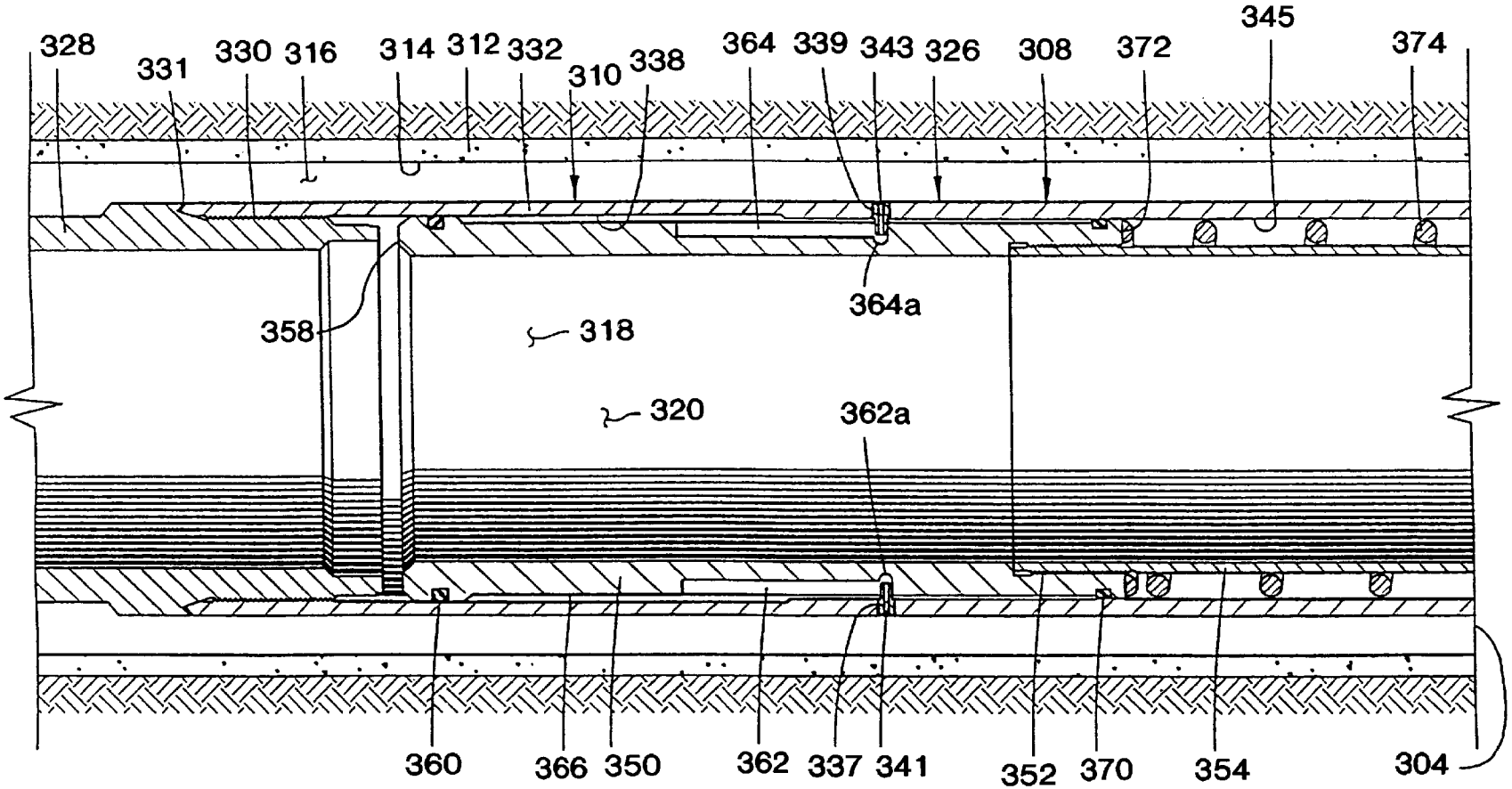
FIGS. 14A–14B are cross-sectional views of successive axial portions of a fourth apparatus, the apparatus being shown disposed in a subterranean well with the bidirectional disappearing plug.
Figure 14B:
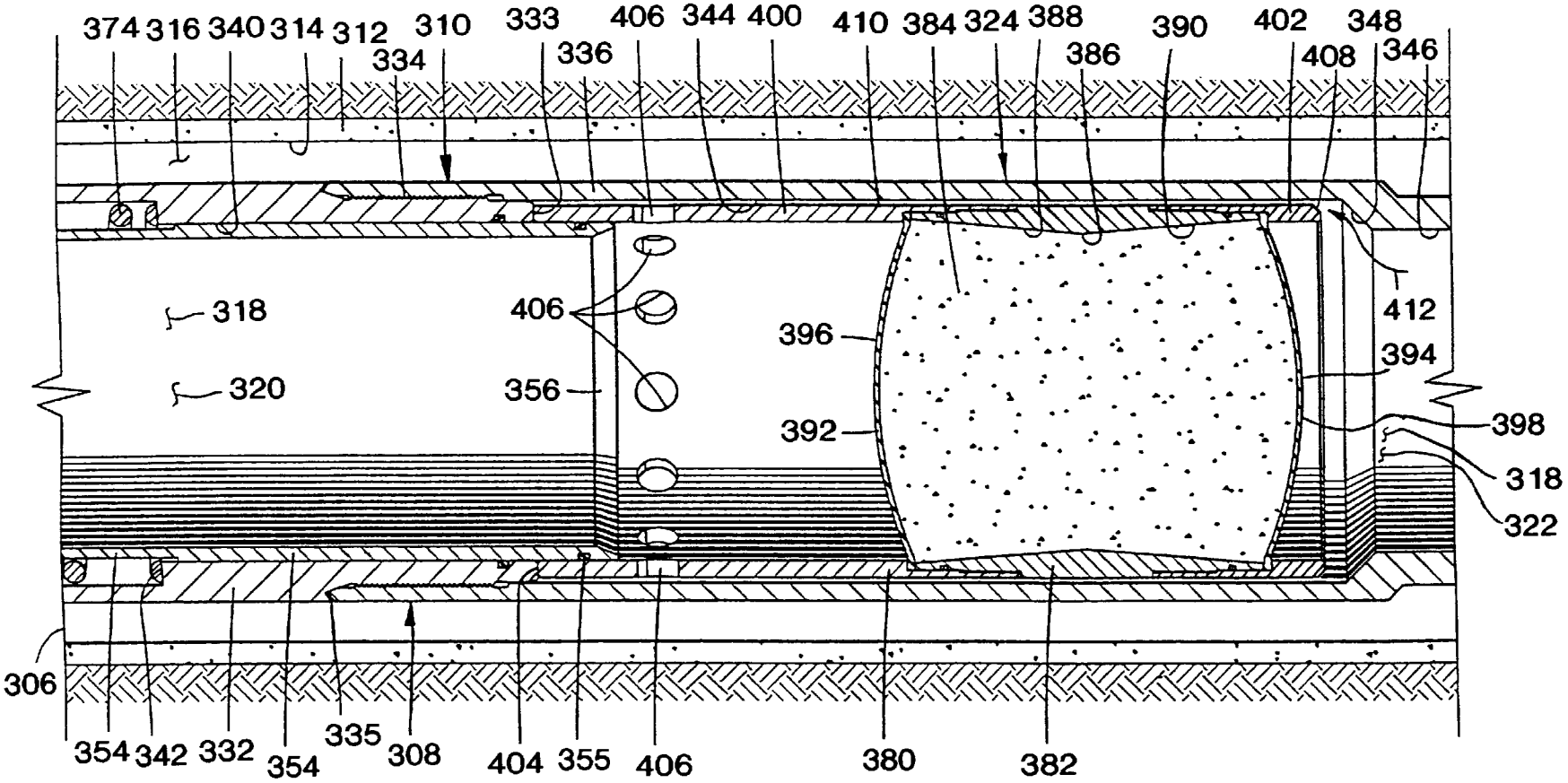

Turning now to FIGS. 14A–14B, another apparatus 308 is representatively illustrated operatively disposed within a subterranean wellbore 314. For convenience of illustration, the apparatus 308 and wellbore 314 are shown in successive axial sections, lower end 304 of FIG. 14A being continuous with upper end 306 of FIG. 14B, but it is to be understood that the apparatus 308 and wellbore 314 are continuous between FIGS. 14A and 14B. In the following detailed description of the embodiment of the present invention representatively illustrated in the accompanying figures, directional terms, such as "upper", "lower", "upward", "downward", etc., are used in relation to the illustrated apparatus 308 as it is depicted in the accompanying figures, the upward direction being to the left, and the downward direction being to the right in the figures. It is to be understood that the apparatus 308 may be utilized in vertical, horizontal, inverted, or inclined orientations without deviating from the principles of the present invention.

A tubing string section 310 incorporating the apparatus 308 is shown disposed within casing 312 lining the subterranean wellbore 314. The tubing string section 310 may be run into the cased law; wellbore 314 as a portion of a tubing string (not shown) extending to the earth's surface. An annulus 316 is thereby defined radially between the casing 12 and the tubing string section 310. The depicted tubing string section 310 may be connected to components (not shown) both above and below the apparatus 308. The tubing string section 310 also defines an interior flowbore 318 with an upper section 320 and a lower section 322, which are essentially separated by the apparatus 308.

The apparatus 308 includes a plug member section 324, which contains an expendable plug member 384, and a plug rupture section 326, which contains the means used to expend the plug member 384. Beginning at the top of FIG. 14A and working downward, an upper tubular member 328 is connected by threads 330 to a generally tubular plug rupture section housing 332. Preferably, the upper tubular member 328 is sealingly attached to the plug rupture section housing 332 utilizing a metal-to-metal seal 331 therebetween, but an elastomeric seal, such as an o-ring, could also be provided for such sealing attachment.

The plug rupture section housing 332 is affixed at its lower end by threads 334 to a generally tubular plug member section housing 336. Preferably, the plug rupture section housing 332 is sealingly attached to the plug member section housing 336 utilizing a metal-to-metal seal 335 therebetween, but an elastomeric seal, such as an o-ring, could also be provided for such sealing attachment.

The plug rupture section housing 332 has an inner downwardly facing shoulder 333 formed on a lower end thereof. The plug rupture section housing 332 also includes three bores formed internally thereon—a radially enlarged upper bore 338 proximate the plug rupture section housing's upper end, a radially reduced lower bore 340 proximate its lower end, and an intermediate bore 343 axially and radially between the other two bores 338, 340. A differential area is thus formed between the bores 338, 345, a purpose for which will be described in greater detail hereinbelow. The bores 338, 340 are separated by an internal upwardly facing shoulder 342.

A pair of lugs 337, 339 are threadedly installed radially through the plug rupture section housing 332 and project inwardly through the intermediate bore 345. Additionally, a pair of lateral fluid ports 341, 343 are formed through the lugs 337, 339, respectively. The ports 341, 343 provide fluid communication radially through the housing 332 from the annulus 316 to the bore 338. Although the ports 341, 343 are representatively illustrated as being formed through the lugs 337, 339, it is to be understood that the ports may be otherwise disposed, for example, the ports may be formed radially through the housing 332 to intersect the intermediate bore 345 axially and/or circumferentially spaced apart from the lugs.

The plug member section housing 336 contains an upper bore 344 and a reduced diameter lower bore 346. The upper and lower bores 344, 346 are separated by a sloped seat 348 internally formed on the housing 336. Seat 348 may be polished or otherwise formed to permit sealing engagement therewith, for purposes which will become apparent upon consideration of the further detailed description hereinbelow.

The upper plug rupture section housing bore 338 contains a generally tubular ratchet sleeve 350 which is reciprocably and rotatably disposed within the bores 338, 345. The ratchet sleeve 350 is secured by threads 352 to a generally tubular plug rupture sleeve 354 which has a downwardly facing cutting edge 356 formed on a lower end thereof. The plug rupture sleeve 354 also carries an external circumferential seal 355 proximate its lower end.

An upper circumferential seal 360 is carried externally on the ratchet sleeve 350 near an upper end 358 thereof. The seal 360 sealingly engages the upper bore 338.

An outer surface of the ratchet sleeve 350 has formed externally thereon a pair of generally circumferentially extending inscribed J-slots or ratchet paths 362, 364 into which the lugs 337, 339, respectively, radially inwardly extend. The ratchet paths 362, 364 are of the type well known to those skilled in the art, but include unique features which are more fully described hereinbelow. It is to be understood that, although the ratchet paths 362, 364 are representatively illustrated as being formed on the ratchet sleeve 350, it is not necessary for the ratchet paths to be so formed, for example, the ratchet paths could be formed on a separate cylindrical member (not shown) which could be separate from, but rotatably attached to, the ratchet sleeve 350.

An annular pressure receiving area 366 is also defined on the outer surface of the ratchet sleeve 350 axially between the seal 360 and a lower circumferential seal 370 carried externally on the ratchet sleeve 350 proximate its lower end 372. The seal 370 sealingly engages the intermediate bore 345. Thus, if fluid pressure in the upper flowbore portion 320 is greater than fluid pressure in the annulus 316, the ratchet sleeve 350 is thereby axially downwardly biased, due to the differential pressure area between bores 338, 345. If fluid pressure in the upper flowbore portion 320 is sufficiently greater than fluid pressure in the annulus 316, the ratchet sleeve 350 may be axially downwardly displaced relative to the housing 332, as more fully described hereinbelow. Conversely, if fluid pressure in the annulus 316 is greater than fluid pressure in the upper flowbore portion 320, the ratchet sleeve 350 is thereby axially upwardly biased.

Figure 15:
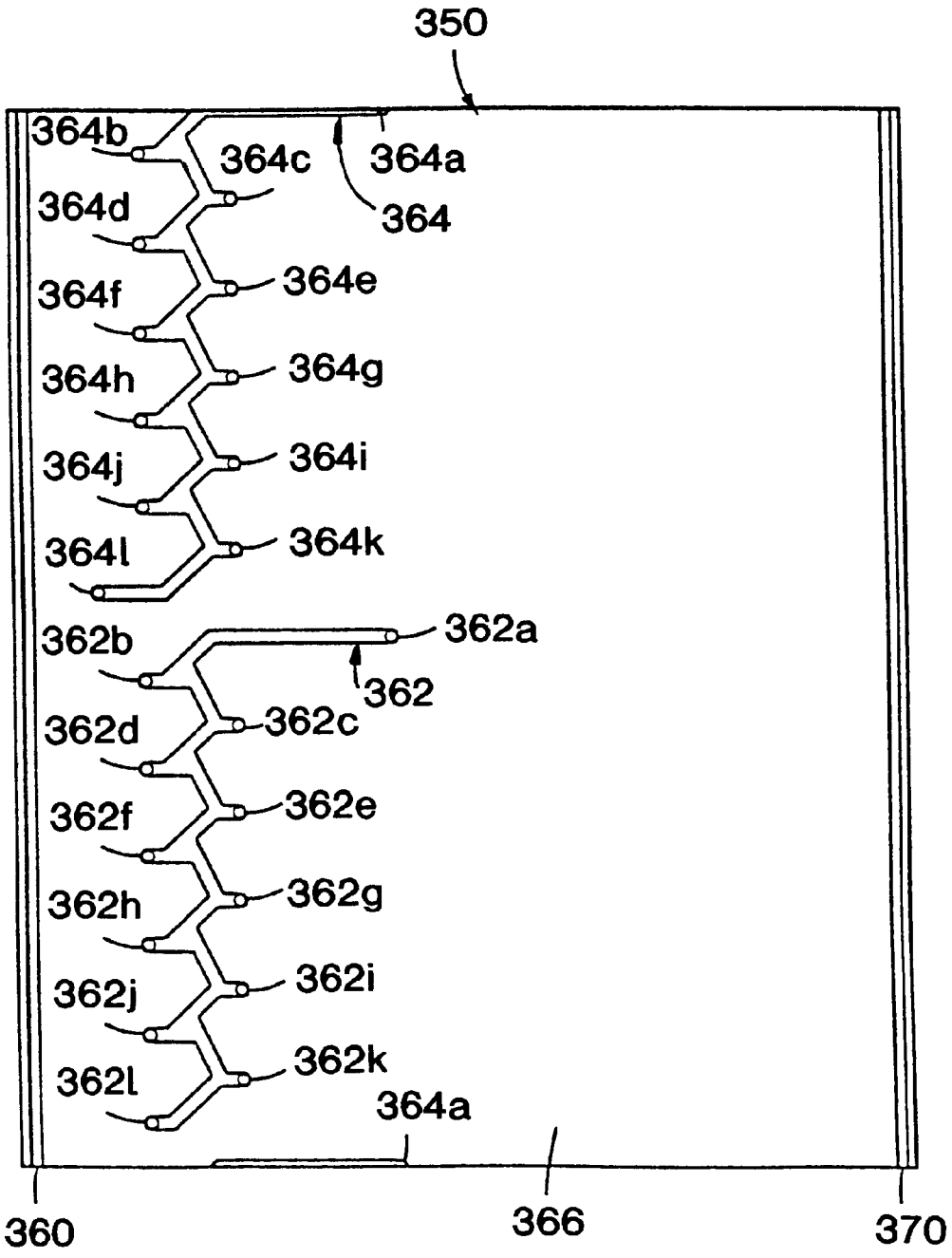
FIG. 15 is a side elevational view of a J-slot portion of the fourth apparatus.

Referring additionally now to FIG. 15, the pressure receiving area 366 and the ratchet paths 362, 364 may be seen in greater detail, the outer surface of the ratchet sleeve 350 being depicted in an "unrolled" fashion. The ratchet paths 362, 364 are substantially identical in most respects. Each ratchet path 362, 364 includes a number of lug stop positions, designated as 362*a*, 362*b*, . . . , 362*l*, and 364*a*, 364*b*, . . . , 364*l*. However, the ratchet path 364 has an extended final position 364*l* which is axially upwardly extended relative to the corresponding lug position 362*l*. Stop positions 362*a* and 364*a* correspond to the initial positions of lugs 337, 339, respectively, as shown in FIGS. 14A–14B.

Referring again to FIGS. 14A–14B, the lower end 372 of the ratchet sleeve 350 is in axial contact with a spring 374 which is disposed within the intermediate bore 345 of the plug rupture section housing 332. The spring 374 radially surrounds an upper portion of the rupture sleeve 354 and abuts, at its lower end, the shoulder 342.

As shown in FIG. 14B, the upper bore 344 of the plug section housing 336 axially reciprocably receives therein a plug member assembly 380 which includes a generally tubular plug sleeve 382. The plug sleeve 382 radially surrounds and secures the plug member 384 therein. The inner radial surface 386 of the plug sleeve 382 has upwardly and downwardly sloped portions 388, 390, respectively formed thereon. The sloped portions 388, 390 are axially oppositely configured, each of them being progressively radially enlarged as it extends outward from an axial midpoint of the sleeve 382.

Preferably, each of the sloped portions 388, 390 are tapered 3–5 degrees from a longitudinal axis of the plug sleeve 382. Applicants have found that such 3–5 degree taper of the sloped portions 388, 390 permits acceptable compression of the plug member 384 during its manufacture, provides sufficient structural support for the plug member 384 to prevent axial displacement thereof when pressure is applied thereto from the upper and/or lower flowbore portions 320, 322, and does not cause the inner surface 386 to unacceptably protrude into the flowbore 318.

The plug member 384 is preferably comprised of a compressed and consolidated sand/salt mixture of the type described in greater detail in U.S. Pat. No. 5,479,986 and application Ser. No. 08/561,754, or may be totally comprised of a binder material, such as compressed salt, or other, preferably granular, material.

Applicants have successfully constructed the plug member 384 utilizing the preferred sand/salt mixture, consolidated with approximately 220 tons compressive force. Preferably, the plug member 384 is formed with convex upper and lower surfaces 392, 394, although other shapes may be utilized without departing from the principles of the present invention. Applicants have found that such convex shapes of upper and lower surfaces 392, 394 of the plug member 384 permit the plug member to acceptably resist fluid pressure applied thereto from either or both of the upper and lower flowbore portions 320, 322, thus making the plug member "bidirectional".

The upper and lower surfaces 392, 394 of the plug member 384 are each encased by a protective, preferably elastomeric, membrane 396, 398, respectively, which prevent wellbore fluids from infiltrating to the plug member 384 and dissolving away the preferred salt/sand mixture. In one embodiment of the present invention, the membranes 396, 398 are constructed of a man-made substitute for natural rubber produced under the tradename NATSIN. A benefit derived from utilizing the NATSIN material is that it typically loses approximately 90–95% of its tensile strength after approximately 24 hours of exposure to hydrocarbons. Thus, membranes 396, 398 made of the NATSIN material may have a tensile strength of approximately 3600 psi when operatively installed in the wellbore 314 with the apparatus 308, but after 24 hours may only have a tensile strength of approximately 300 psi, making the membranes easy to pierce and expend from the apparatus.

The plug member assembly 380 also includes upper and lower guide sleeves 400, 402, respectively, which are threadedly and sealingly affixed to respective upper and lower axial ends of the plug sleeve 382. Among other functions further described hereinbelow, the guide sleeves 400, 402 assist in maintaining alignment of the plug member assembly 380 within the upper bore 344. The upper guide sleeve 400 has an upper end 404 formed thereon which axially contacts the shoulder 333 of the plug rupture section housing 332, as shown in FIG. 14B. The upper guide sleeve 400 also includes a plurality of circumferentially spaced apart and radially extending ports 406 formed therethrough. The lower guide sleeve 402 has a lower end 408 formed thereon which is generally complementarily shaped relative to the seat 348 of plug member section housing 336. Alternatively, end 408 may be otherwise formed to permit sealing engagement with the seat 348.

Figure 16A:
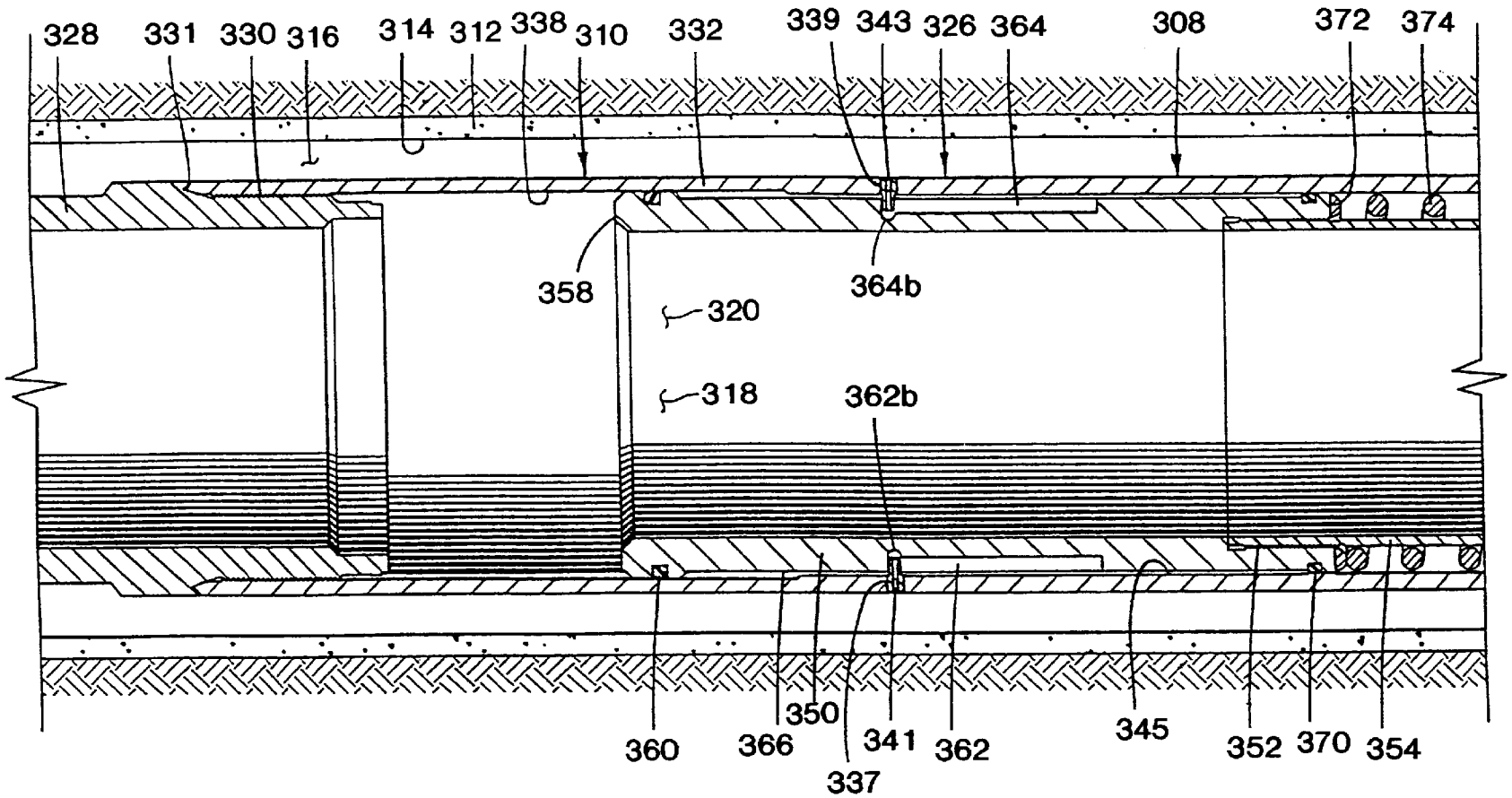
FIGS. 16A–16B are cross-sectional views of successive axial portions of the fourth apparatus, the apparatus being shown in a configuration in which a mandrel of the apparatus has been axially downwardly displaced.
Figure 16B:
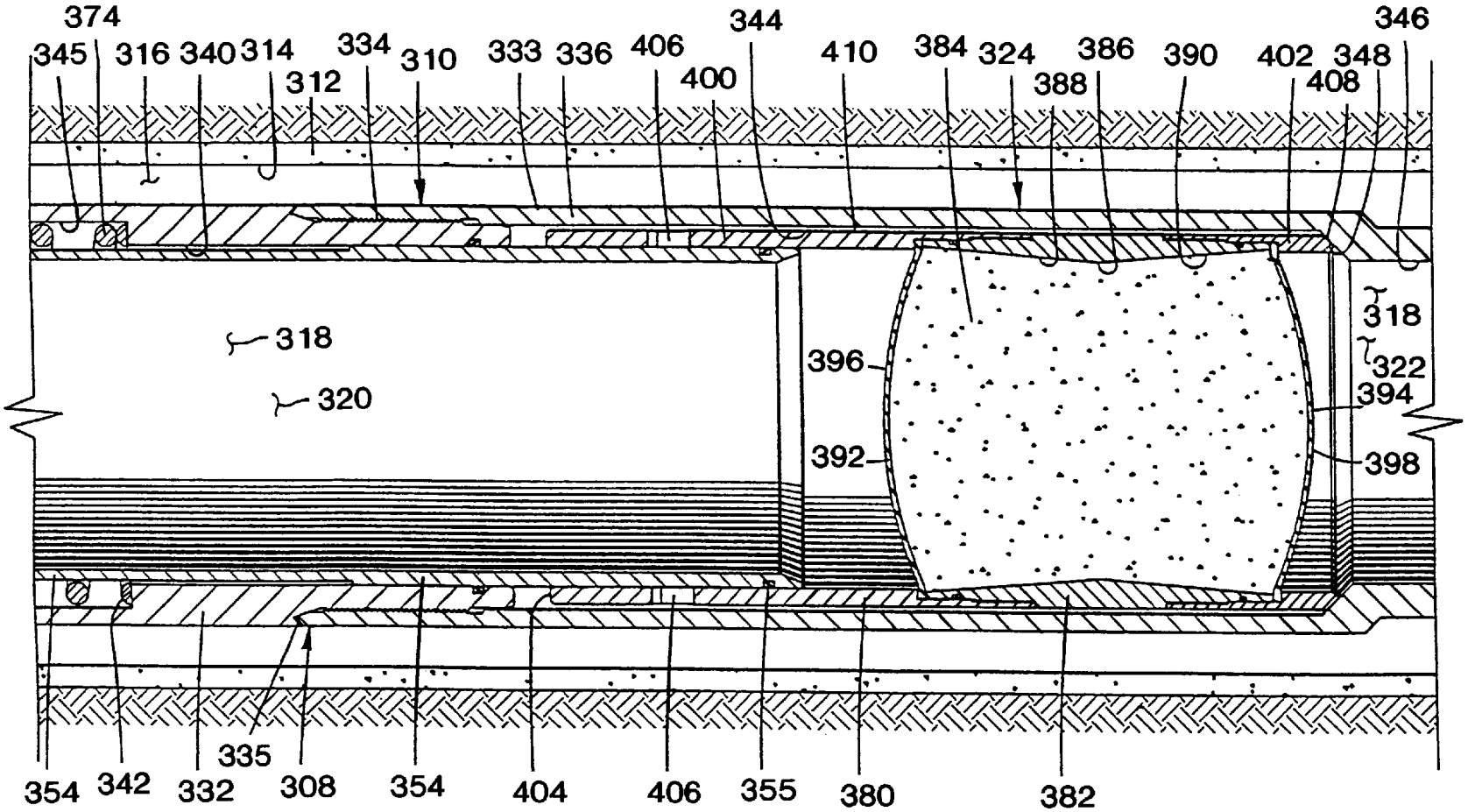

An axial fluid passage 410 is formed radially between the plug member assembly 380 and the bore 344 of the surrounding plug member section housing 336. Note that the plug member assembly 380 is axially reciprocable within bore 344 between an upper and a lower position. The upper position is illustrated in FIG. 14B and the lower position is illustrated in FIG. 16B, the assembly 380 being axially downwardly displaced relative to the housing 336 in its lower position as compared to its upper position.

In the upper position of the assembly 380, the upper end 404 of the upper guide sleeve 400 abuts the shoulder 333 of the plug rupture section housing 332, and the lower end 408 of the lower guide sleeve 402 is axially spaced apart from the seat 348 of the plug member section housing 336. When the plug member assembly 380 is in its upper position, fluid may be transmitted between the lower and upper flowbore portions 322, 320, respectively, by flowing the fluid between end 408 and seat 348, axially through passage 410, and inwardly through ports 406 in the upper guide sleeve 400.

Operation of an exemplary apparatus 308, from initial emplacement to ultimate destruction, is illustrated in FIGS. 14A–14B, 16A–16B, 17A–17B, 18A–18B and 19A–19B. The apparatus 308 is typically emplaced to block fluid flow through the flowbore 318 by being incorporated into the tubing string section 310 which is run into the wellbore 314. During the running-in process, the apparatus 308 is typically lowered to a desired depth or location within the wellbore 314, such as a position between two formations, and then the apparatus 308 is set so that the plug member assembly 380 blocks fluid flow through the flowbore 318. The tubing string section 310 can be filled with fluid as it is run into the wellbore 314 (the wellbore having fluid contained therein) despite the presence of the plug member 384 due to the unique structure and operation of the plug member section 380.

During the running-in process, fluid pressure in the lower portion 322 of the flowbore 318 (below the plug member 384) will axially displace the plug member section 380 upwardly and into its upper position, as shown in FIG. 14B. Fluid in the wellbore 314 may be flowed from the lower portion 322 of the flowbore 318 to the upper portion 320 as indicated generally by arrow 412, flowing between end 408 and seat 348, axially upward through passage 410, and inwardly through ports 406 in the upper guide sleeve 400 as the apparatus 308 is lowered into the wellbore.

During emplacement, the lugs 337 and 339 are positioned at ratchet positions 362*a* and 364*a*, respectively, as indicated in FIG. 14A. Upward biasing of the ratchet sleeve 350 by the spring 374 assists in maintaining the lugs 337 and 339 at these ratchet positions. For this purpose, the spring 374 is preferably somewhat compressed when it is initially operatively installed into the apparatus 308 as shown in FIGS. 14A–14B. Thus, for the ratchet sleeve 350 to be axially downwardly displaced relative to the housing 332, fluid pressure in the upper flowbore portion 320 must be sufficiently greater than fluid pressure in the annulus 316 to overcome the upward biasing of the ratchet sleeve by the spring 374. Extraneous forces, such as friction, must also be overcome thereby.

Once the apparatus 308 has been disposed to a desired depth or location within the wellbore 314, the apparatus may be closed to fluid flow axially downwardly therethrough, by application of fluid pressure within the upper portion 320 of the flowbore 318 which is greater than fluid pressure in the lower flowbore portion 322. The increased pressure in the upper portion 320 of the flowbore 318 biases the plug member assembly 380 to displace axially downward to its lower position, shown in FIG. 16B. Lower end 408 of the lower guide sleeve 402 thereby sealingly engages the seat 348, substantially preventing fluid flow downwardly through the axial fluid passage 410.

The ratchet sleeve 350 may then be axially downwardly displaced relative to the housing 332 by application of fluid pressure to the upper flowbore portion 320 which is sufficiently greater than fluid pressure in the annulus 316 to overcome the upwardly biasing force of the spring 374 on the ratchet sleeve and any friction forces. The ratchet sleeve 350 will thereby axially downwardly displace relative to the housing 332 until the lugs 337, 339 are moved axially upward relative to ratchet paths 362, 364, respectively, to reach ratchet positions 362*b*, 364*b* (see FIG. 16A) at which point axial contact between the lugs 337, 339 and the ratchet sleeve 350 prevents further displacement. Note that, at this point, preferably no more fluid pressure is applied to the upper flowbore portion 320 than is needed to ensure that the lugs 337, 339 are at ratchet positions 362*b*, 364*b*, respectively. When the ratchet sleeve 350 is moved axially downward to this position, axially downward displacement of the seal 355 below the ports 406 of the upper guide sleeve 400 blocks fluid flow through the ports 406. The plug assembly 380 (and, thus, the apparatus 308) is now considered to be set against fluid flow axially therethrough.

Figure 17A:
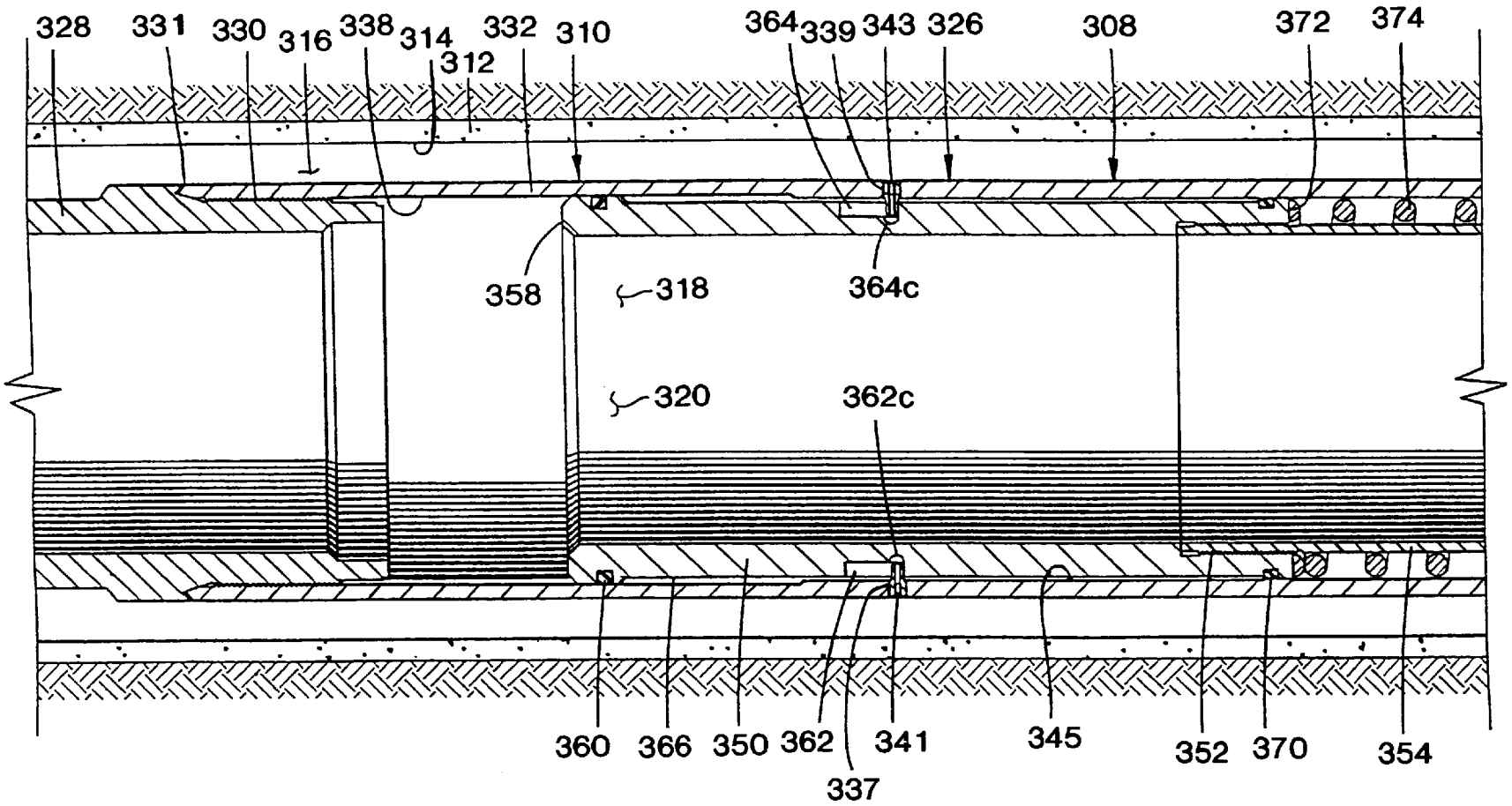
FIGS. 17A–17B are cross-sectional views of successive axial portions of the fourth apparatus, the apparatus being shown in a configuration in which the mandrel has been axially upwardly displaced relative to the configuration shown in FIGS. 16A–16B.
Figure 17B:
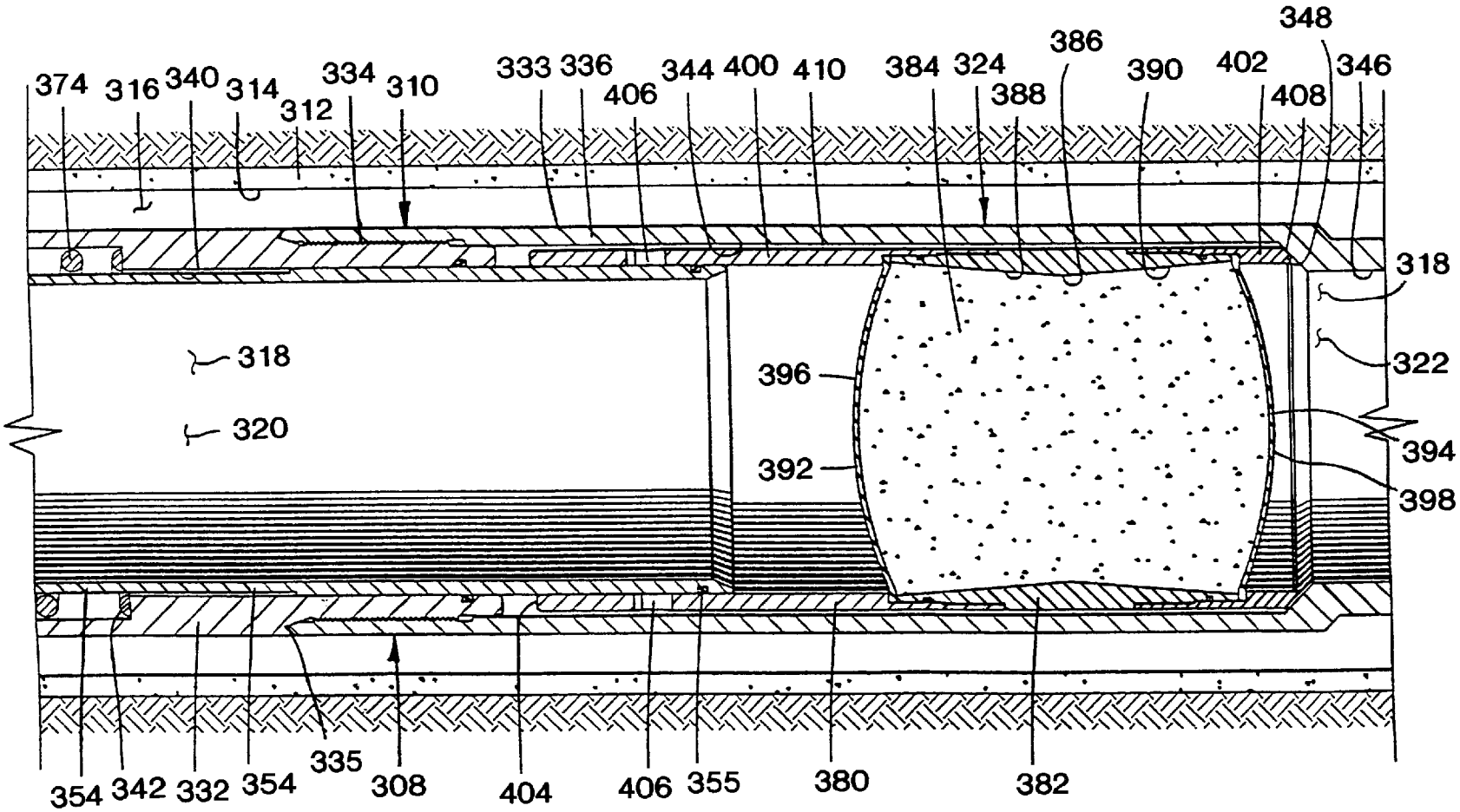

Once the apparatus 308 has been set to block fluid flow through the flowbore 318, pressure in the flowbore 318 and the annulus 316 may be significantly altered without structurally compromising the plug member 384. The fluid pressure in the upper flowbore portion 320 may then be decreased, or the fluid pressure in the annulus 316 may be increased, to permit the spring 374 to upwardly displace the ratchet sleeve 350 to an intermediate upper position (as depicted in FIGS. 17A–17B with lugs 337, 339 moved to lug positions 362*c*, 364*c*, respectively). The ratchet sleeve 350 may thereby move upward within the bore 338, but not to the extent that the ports 406 become uncovered to permit fluid flow therethrough, the ratchet paths 362, 364 preventing further axially upward displacement of the ratchet sleeve. Note that the ratchet sleeve 350 may be assisted in movement to the intermediate upper position by utilizing fluid pressure in the annulus 316. The annulus fluid pressure is communicated through ports 341, 343 to the pressure receiving area 366 on the outer surface of the ratchet sleeve 350, thereby biasing the ratchet sleeve 350 axially upward.

Figure 18A:
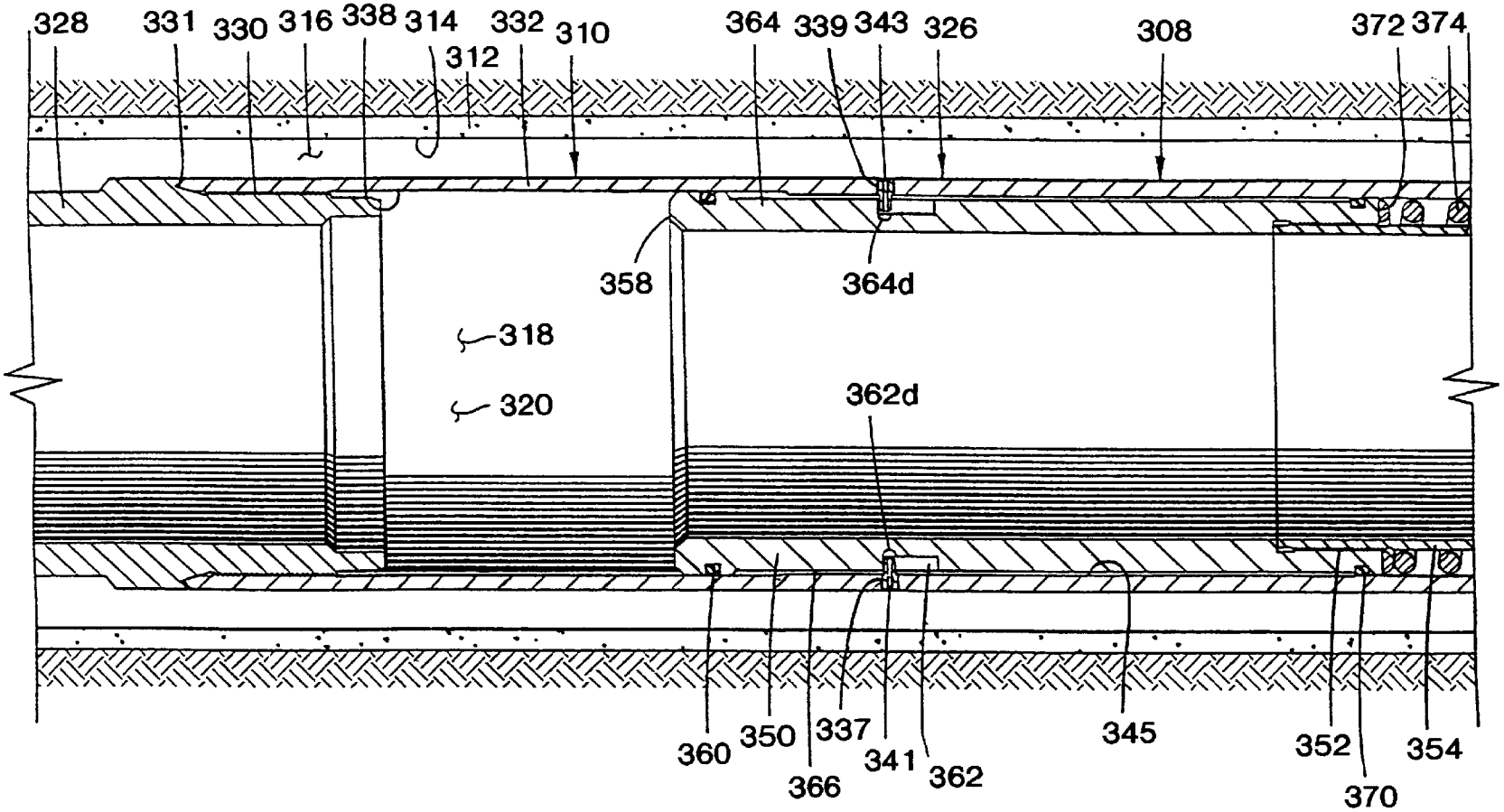
FIGS. 18A–18B are cross-sectional views of successive axial portions of the fourth apparatus, the apparatus being shown in a configuration in which the mandrel has been axially downwardly displaced relative to the configuration shown in FIGS. 17A–17B.
Figure 18B:
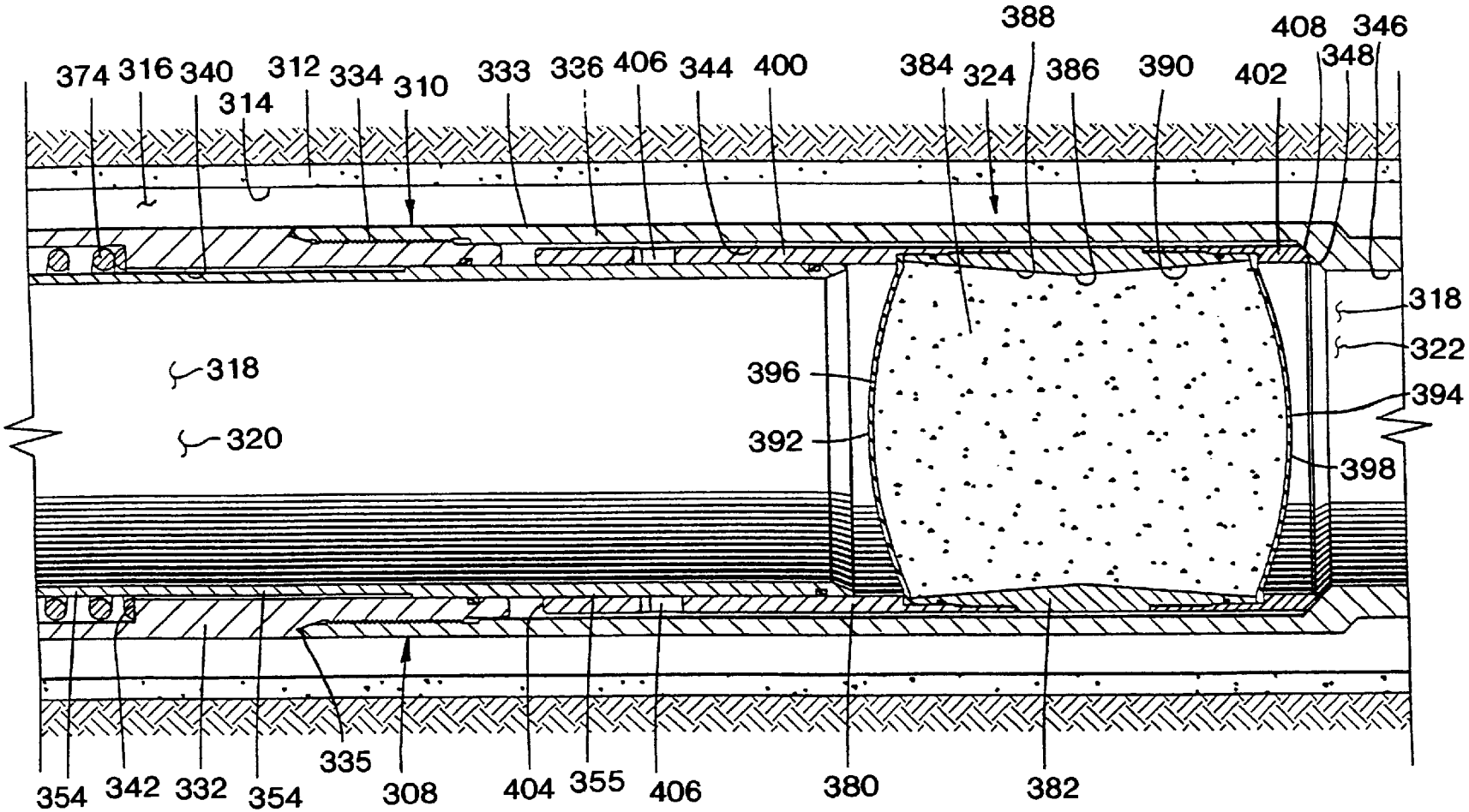
Figure 19A:
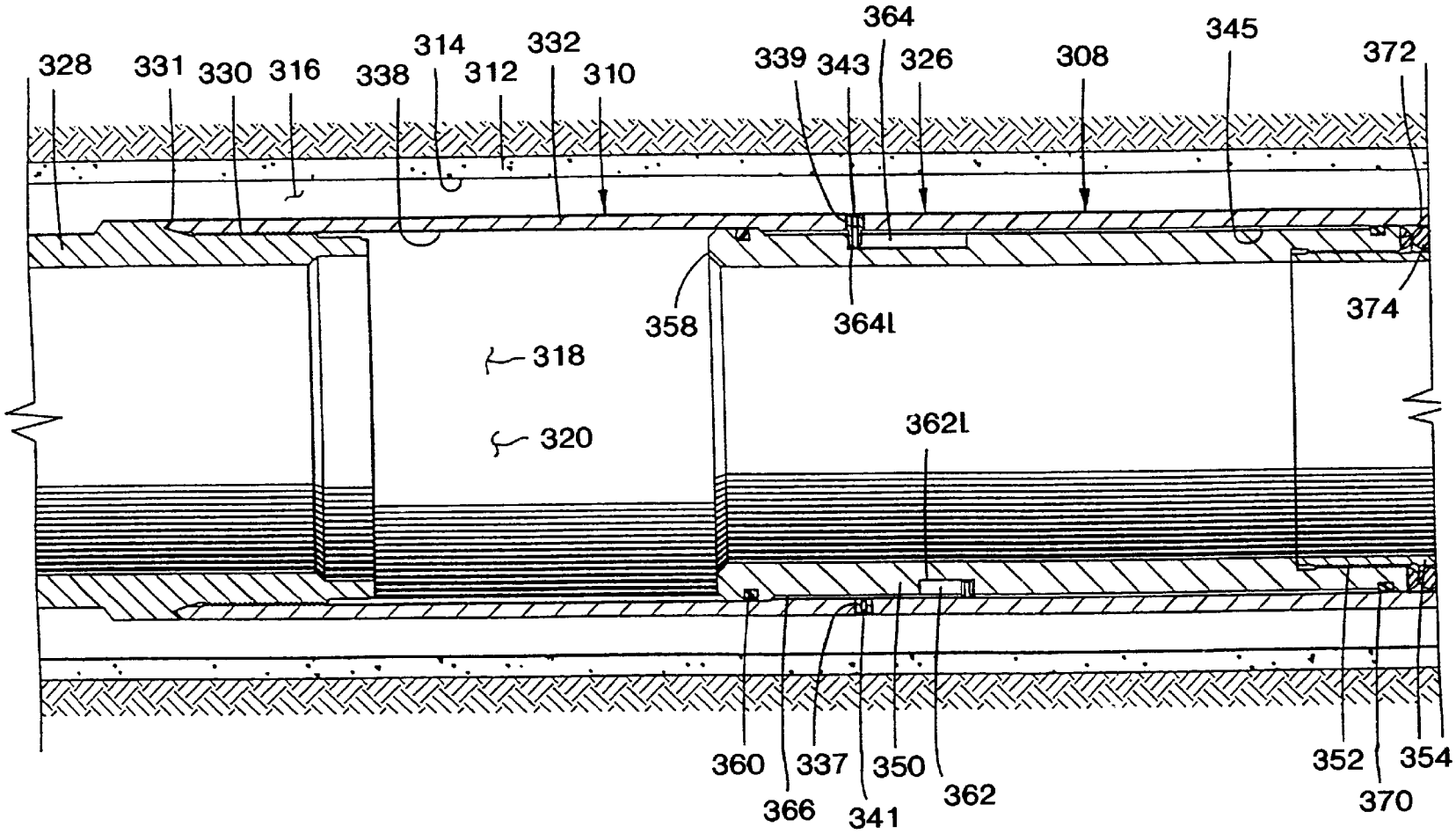
FIGS. 19A–19B are cross-sectional views of successive axial portions of the fourth apparatus, the apparatus being shown in a configuration in which the mandrel has been further axially downwardly displaced relative to the configuration shown in FIGS. 18A–18B, and the mandrel has pierced the bidirectional disappearing plug.
Figure 19B:
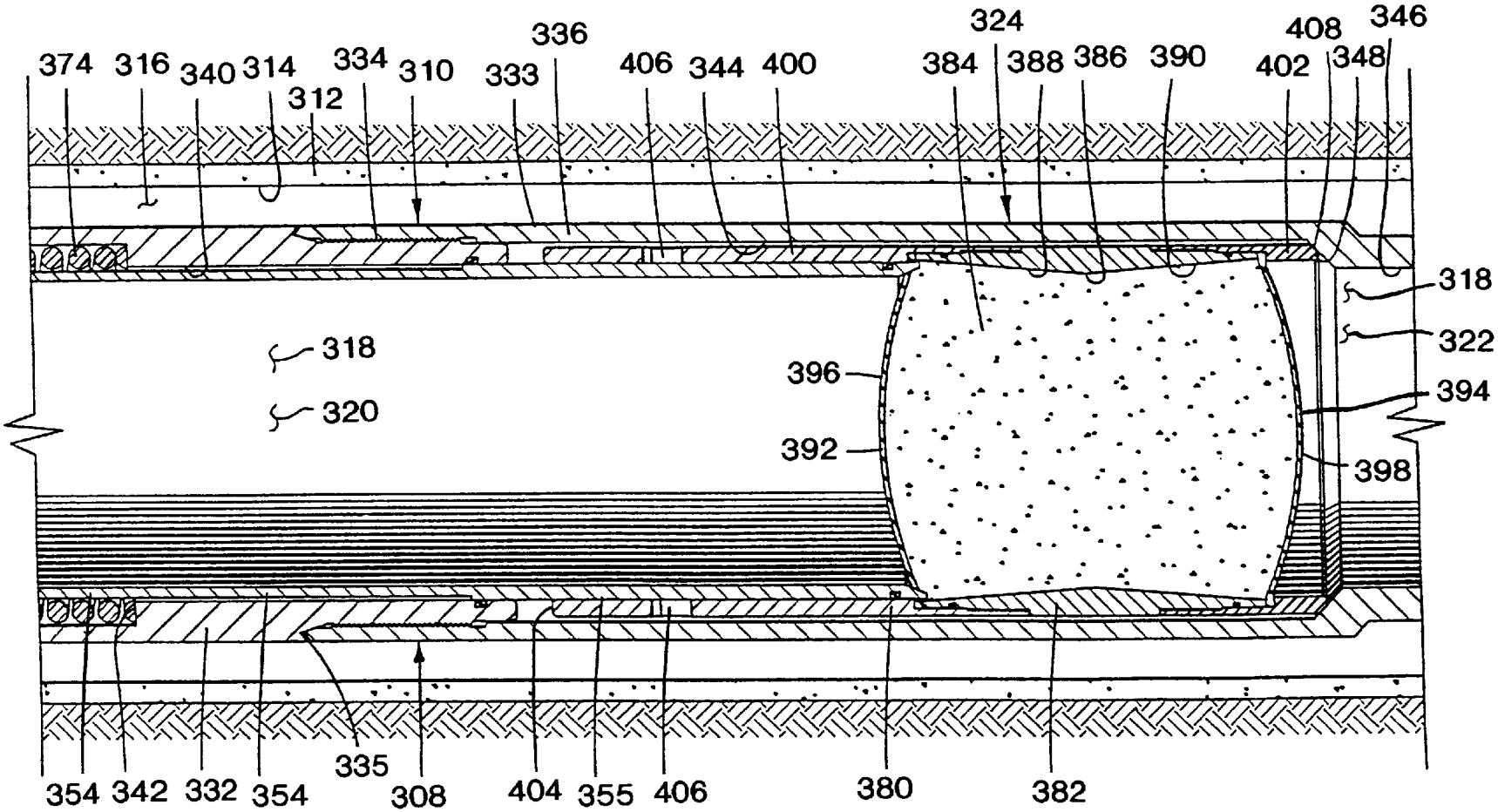

The result of a subsequent pressure increase in the upper flowbore portion 320 relative to the fluid pressure in the annulus 316 is illustrated in FIGS. 18A–18B. The ratchet sleeve 350 is moved downward to an intermediate lower position in which the cutting edge 356 is moved proximate the plug member 384 without contacting it. The lugs 337, 339 are moved, for example, to ratchet positions 362*d*, 364*d*, respectively.

Owing to the control of the ratchet sleeve 350 imposed by the ratchet paths 362, 364, fluid pressure in the upper flowbore portion 320 may be alternately decreased then increased relative to the fluid pressure in the annulus 316 a predetermined number of times following setting of the apparatus 308 before the upper membrane 396 will be pierced by the cutting edge 356 of the rupture sleeve 354. The predetermined number of times is dictated by the specific design of the ratchet paths 362, 364. In the exemplary embodiment depicted by FIGS. 14A–14B through 19A–19B, fluid pressure in the upper flowbore portion 320 relative to the fluid pressure in the annulus 316 may be increased a total of five times (the lugs 337, 339 being thereby located at corresponding successive positions 362*b*, 364*b*; 362*d*, 364*d*; 362*f*, 364*f*; 362*h*, 364*h*; and 362*j*, 364*j*, respectively) and alternately decreased a total of four times (the lugs 337, 339 being thereby located at corresponding successive positions 362*c*, 364*c*; 362*e*, 364*e*; 362*g*, 364*g*; 362*i*, 364*i*; and 362*k*, 364*k*) before expelling the plug member 384.

It is to be understood that the configuration of the ratchet paths 362, 364 will be based upon specifications desired by an end user and will reflect the number of times which it is desired to increase and decrease the fluid pressure in the flowbore portion 320 relative to the fluid pressure in the annulus 316 before expelling the plug member 384. If it were desired, intermediate pressure differential increases and decreases between setting of the apparatus 308 and expelling of the plug member 384 might be left out of the ratchet paths 362, 364.

When the predetermined number of pressure differential increases and decreases has occurred, lugs 337, 339 are disposed at lug positions 362*k*, 364*k*, respectively. The plug member 384 may then be expelled as follows. Fluid pressure is increased in the upper flowbore portion 320 relative to the fluid pressure in the annulus 316 to displace the ratchet sleeve 350 axially downward until lug 337 reaches lug position 3621. The pressure differential is then further increased, forcing the ratchet sleeve 350 further downward until lug 337 shears. Lug 339 remains in the ratchet path 364 and is disposed to ratchet position 364*l*. Because the lug position 364*l* is located closer to the upper portion of the ratchet sleeve 350 than any other ratchet position, the ratchet sleeve and threadedly affixed rupture sleeve 354 are moved downward to a position such that the cutting edge 356 of the rupture sleeve 354 axially contacts and penetrates the membrane 396 covering the upper face 392 of the plug member 384.

Pressurized wellbore fluids within the upper flowbore portion 320 quickly degrade and destroy the structural integrity of the plug member 384. The lower elastomeric membrane 398 is subsequently easily ruptured by any pressure differential between the upper and lower flowbore portions 320, 322 and unobstructed fluid flow is then possible through the flowbore 318.

The foregoing detailed description is to be clearly understood as being given by way of illustration and example only, the spirit and scope of the present invention being limited solely by the appended claims.

What is claimed is:

1. Apparatus operatively positionable in a subterranean well, the apparatus comprising:

a tubular outer housing having an inner axial flow passage formed therethrough; and an expendable plug member received in the outer housing, the plug member being capable of blocking fluid flow through the outer housing flow passage.

2. The apparatus according to claim 1, wherein the plug member includes a body portion enclosed within an outer case.

3. The apparatus according to claim 2, wherein at least a part of the body portion is dissolvable.

4. The apparatus according to claim 2, further comprising a mechanism selectively permitting and preventing fluid communication between the body portion and a fluid source.

5. The apparatus according to claim 4, wherein the fluid source is the outer housing flow passage.

6. The apparatus according to claim 2, wherein the body portion outwardly supports the outer case when the body portion is isolated from communication with a fluid, the outer case being unsupported by the body portion when the fluid contacts the body portion.

7. An expendable plug member operatively positionable within a subterranean well, the plug member comprising:

an outer case including a generally tubular housing and first and second end walls, the housing having interior and exterior side surfaces, and first and second opposite ends, and each of the first and second end walls blocking fluid flow through one of the first and second opposite ends; and a body portion disposed within the housing and between the first and second end walls.

8. The expendable plug member according to claim 7, wherein the body portion is at least partially dissolvable.

9. The expendable plug member according to claim 7, wherein the body portion outwardly supports each of the first and second end walls.

10. The expendable plug member according to claim 7, wherein the housing interior surface has a profile formed thereon.

11. The expendable plug member according to claim 10, wherein the profile resists displacement of the body portion relative to the housing.

12. The expendable plug member according to claim 11, wherein the profile includes first and second profile portions, the first profile portion resisting displacement of the body portion in a first direction relative to the housing, and the second profile portion resisting displacement of the body portion in a second direction relative to the housing.

13. The expendable plug member according to claim 7, wherein at least one of the end walls is made of a flexible material and is prevented from displacing relative to the housing by the body portion.

14. A method of blocking fluid flow through a flowbore using an expendable plug member, the method comprising the steps of:

disposing a plug assembly within the flowbore to block fluid flow through the flowbore, the plug assembly containing the expendable plug member; and expending the expendable plug member to thereby permit fluid flow through the flowbore.

15. The method according to claim 14, wherein the expending step further comprises placing a portion of the plug member in communication with a fluid source.

16. The method according to claim 15, wherein in the placing step, the fluid source is the flowbore.

17. The method according to claim 14, wherein the expending step further comprises applying fluid pressure to the plug assembly.

18. The method according to claim 17, wherein the applying step further comprises applying the fluid pressure to the flowbore.

19. The method according to claim 17, wherein the applying step further comprises applying a predetermined number of fluid pressure applications to the plug assembly.

20. The method according to claim 19, further comprising the step of incrementally displacing a structure relative to the plug member in response to the fluid pressure applications.

* * * * *